US011554585B2

(12) United States Patent
Okui

(10) Patent No.: US 11,554,585 B2
(45) Date of Patent: Jan. 17, 2023

(54) LIQUID EJECTING HEAD AND LIQUID EJECTING APPARATUS

(71) Applicant: Seiko Epson Corporation, Tokyo (JP)

(72) Inventor: Hiroaki Okui, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 51 days.

(21) Appl. No.: 17/335,226

(22) Filed: Jun. 1, 2021

(65) Prior Publication Data

US 2021/0370674 A1 Dec. 2, 2021

(30) Foreign Application Priority Data

Jun. 1, 2020 (JP) ..... JP2020-095323

(51) Int. Cl.
*B41J 2/14* (2006.01)

(52) U.S. Cl.
CPC .... *B41J 2/1433* (2013.01); *B41J 2002/14491* (2013.01); *B41J 2202/19* (2013.01)

(58) Field of Classification Search
CPC ..... B41J 2/1433
See application file for complete search history.

(56) References Cited

U.S. PATENT DOCUMENTS

2010/0194823 A1 8/2010 Yamanaka et al.
2016/0009087 A1* 1/2016 Okui ..... B41J 2/17546 29/830
2017/0008291 A1 1/2017 Owaki et al.
2017/0282553 A1 10/2017 Hayashi et al.
2017/0282562 A1* 10/2017 Mizuno ..... B41J 2/145
2018/0178511 A1* 6/2018 Kashimura ..... B41J 2/14233
2020/0079086 A1 3/2020 Asai et al.

FOREIGN PATENT DOCUMENTS

JP 2007-196455 8/2007
JP 2009-119766 6/2009
JP 2015-018921 1/2015
JP 2015-030181 2/2015
JP 2016-020031 2/2016
JP 2017-019153 1/2017

* cited by examiner

*Primary Examiner* — Jason S Uhlenhake
(74) *Attorney, Agent, or Firm* — Workman Nydegger

(57) ABSTRACT

A liquid ejecting head includes wiring members including a first-wiring member having a first-output terminal portion extending in a first-direction and a first-input terminal portion extending in the first-direction, and a second-wiring member having a second-output terminal portion extending in the first-direction and a second-input terminal portion extending in the first-direction; and a first-wiring substrate coupled to the first and second input terminal portions, in which a center of the first-output terminal portion is located in the first-direction with respect to a center of the second-output terminal portion in plan view, a center of the first-input terminal portion is disposed in a second-direction opposite to the first-direction with respect to the center of the first-output terminal portion in the plan view, and a center of the second-input terminal portion is disposed in the first-direction with respect to the center of the second-output terminal portion in the plan view.

20 Claims, 24 Drawing Sheets

LIQUID EJECTING HEAD AND LIQUID EJECTING APPARATUS

The present application is based on, and claims priority from JP Application Serial Number 2020-095323, filed Jun. 1, 2020, the disclosure of which is hereby incorporated by reference herein in its entirety.

BACKGROUND

1. Technical Field

The present disclosure relates to a liquid ejecting head and a liquid ejecting apparatus.

2. Related Art

A liquid ejecting apparatus represented by an ink jet printer normally has a liquid ejecting head that ejects a liquid such as ink. The liquid ejecting head is provided with a plurality of wiring members having an output terminal portion and an input terminal portion, and a wiring substrate coupled to the input terminal portion of each of the plurality of wiring members. The output terminal portion corresponds to a nozzle row for ejecting the liquid. For example, in JP-A-2017-19153, when a plurality of nozzle rows are used side by side in a direction intersecting an extending direction of the nozzle rows, a liquid ejecting apparatus that achieves high resolution by disposing the output terminal portions so as to be displaced in the extending direction is disclosed.

However, in the liquid ejecting head described above in the related art, since the output terminal portions are disposed so as to be displaced in the extending direction, the input terminal portions are also disposed so as to be displaced in the same manner. Therefore, there is a problem that an area where the input terminal portion is provided is increased and the size of the wiring substrate is increased.

SUMMARY

According to an aspect of a preferred aspect of the present disclosure, there is provided a liquid ejecting head that ejects a liquid, including a plurality of wiring members that includes a first wiring member having a first output terminal portion extending in a first direction and a first input terminal portion extending in the first direction, and a second wiring member having a second output terminal portion extending in the first direction and a second input terminal portion extending in the first direction; and a first wiring substrate coupled to the first input terminal portion and the second input terminal portion, in which a center of the first output terminal portion is located so as to be displaced in the first direction with respect to a center of the second output terminal portion in plan view in a direction ejecting the liquid, a center of the first input terminal portion is disposed so as to be displaced in a second direction opposite to the first direction with respect to the center of the first output terminal portion in the plan view, and a center of the second input terminal portion is disposed so as to be displaced in the first direction with respect to the center of the second output terminal portion in the plan view.

According to an aspect of a preferred aspect of the present disclosure, there is provided a liquid ejecting head including: a first nozzle row group in which a plurality of first nozzle rows extending in a first direction are disposed along a first virtual straight line intersecting the first direction; a second nozzle row group in which a plurality of second nozzle rows extending in the first direction are disposed along a second virtual straight line parallel to the first virtual straight line; a plurality of first wiring members corresponding to the plurality of first nozzle rows, respectively; a plurality of second wiring members corresponding to the plurality of second nozzle rows, respectively; and a first wiring substrate coupled to the plurality of first wiring members and the plurality of second wiring members, in which the plurality of first wiring members has a first input terminal portion extending in the first direction, respectively, the plurality of second wiring members has a second input terminal portion extending in the first direction, respectively, the first wiring substrate is coupled to the first input terminal portion and the second input terminal portion, the first nozzle row group is disposed in a fifth direction perpendicular to the first virtual straight line with respect to the second nozzle row group, a center of the first input terminal portion is disposed so as to be displaced in a sixth direction opposite to the fifth direction with respect to a center of the first nozzle row corresponding to the center of the first input terminal portion in plan view in a direction ejecting a liquid, and a center of the second input terminal portion is disposed so as to be displaced in the fifth direction with respect to a center of the second nozzle row corresponding to the center of the second input terminal portion in the plan view.

According to an aspect of a preferred aspect of the present disclosure, there is provided a liquid ejecting apparatus including: the liquid ejecting head described above; and a transport portion that transports a medium.

DESCRIPTION OF EXEMPLARY EMBODIMENTS

Hereinafter, embodiments for performing the present disclosure will be described with reference to the drawings. However, in each figure, the dimensions and scale of each part are appropriately different from the actual ones. In addition, since the embodiments described below are suitable specific examples of the present disclosure, various technically preferable limitations are added, and the scope of the present disclosure is not limited to these embodiments unless otherwise stated in the following description to particularly limit the present disclosure.

1. First Embodiment

A liquid ejecting apparatus 100 according to a first embodiment will be described.

1.1. Outline of Liquid Ejecting Apparatus 100

Figure 1:
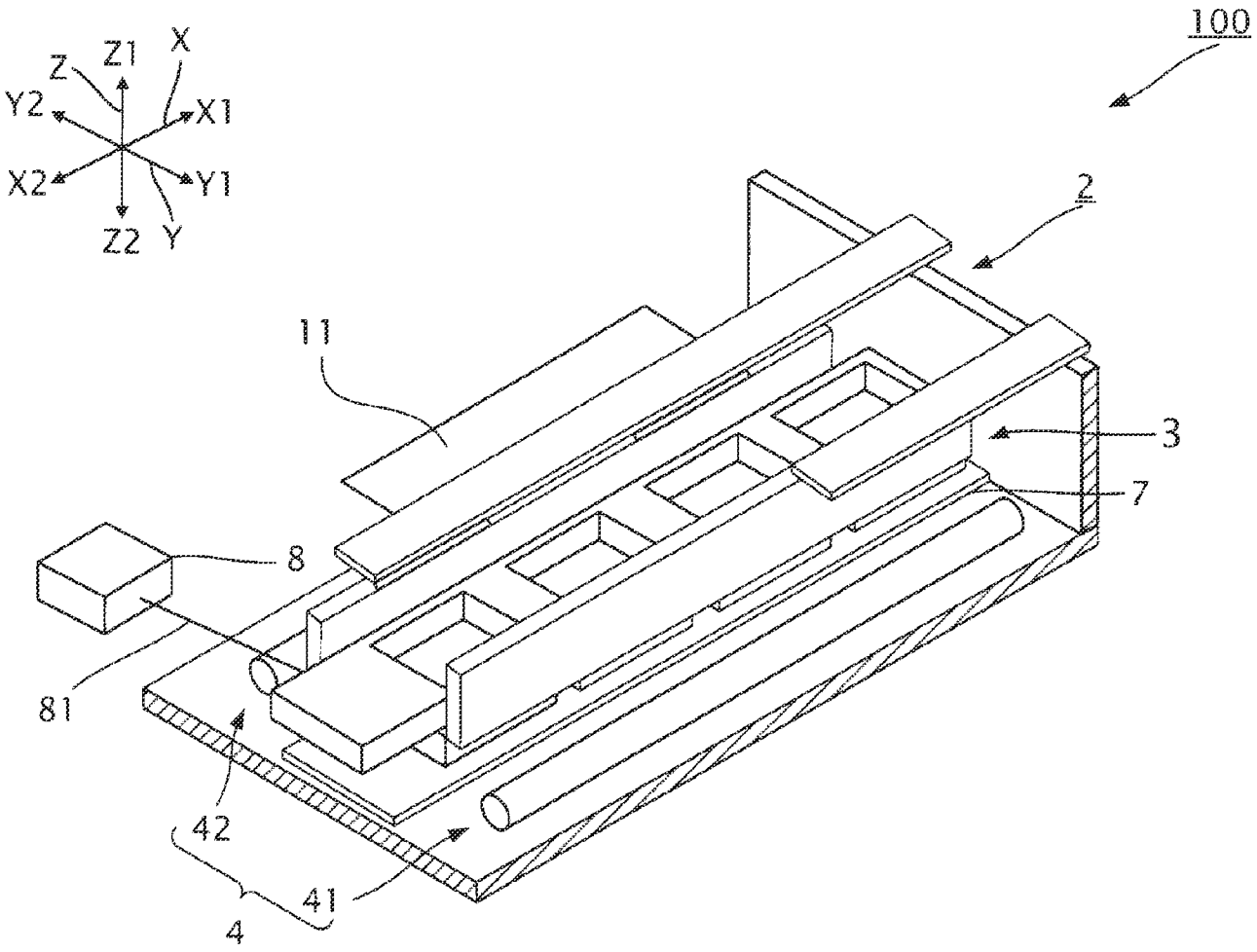
FIG. 1 is a perspective view of a liquid ejecting apparatus according to a first embodiment.

FIG. 1 is a perspective view of a liquid ejecting apparatus 100 according to the first embodiment. The liquid ejecting apparatus 100 is an ink jet printing apparatus that ejects a liquid such as ink as a droplet onto a medium 11. The medium 11 is, for example, a printing paper. The medium 11 is not limited to the printing paper, and may be a printing target of any material such as a resin film or cloth.

The liquid ejecting apparatus 100 is mounted with a liquid container (not illustrated in FIG. 1). The liquid container stores ink. Examples of specific aspects of the liquid container include a cartridge that can be attached to and detached from the liquid ejecting apparatus 100, a bag-shaped ink pack made of a flexible film, and an ink tank that can be refilled with ink. The type of ink stored in the liquid container is predetermined.

As illustrated in FIG. 1, the liquid ejecting apparatus 100 includes an apparatus main body 2, a head module 3 having a plurality of liquid ejecting heads 30, a transport portion 4 for transporting the medium 11, and a support member 7 that supports the medium 11 facing the head module 3. Furthermore, the liquid ejecting apparatus 100 includes a control unit 8. The control unit 8 includes, for example, a processing circuit such as a central processing unit (CPU) or a field programmable gate array (FPGA) and a storage circuit such as a semiconductor memory, and controls the operation of each element of the liquid ejecting apparatus 100. The control unit 8 is electrically coupled to the head module 3 via a signal cable 81, and controls the ink ejection operation in the head module 3. As the signal cable 81, for example, a flat cable or a flexible flat cable can be adopted.

The transport portion 4 transports the medium 11 in the Y1 direction under the control of the control unit 8. Hereinafter, the Y1 direction and the Y2 direction, which is a direction opposite to the Y1 direction, are collectively referred to as a Y axis direction.

Under the control of the control unit 8, the head module 3 ejects the ink supplied from the liquid container in the Z2 direction. The Z2 direction is a direction orthogonal to the Y1 direction. Hereinafter, the Z2 direction and the Z1 direction, which is a direction opposite to the Z2 direction, may be collectively referred to as a Z axis direction. The ejected ink lands on a surface of the medium 11. An image is formed on the surface of the medium 11 by ejecting ink from the head module 3 in parallel with the transport of the medium 11 by the transport portion 4. The head module 3 will be described with reference to FIG. 2.

Figure 2:
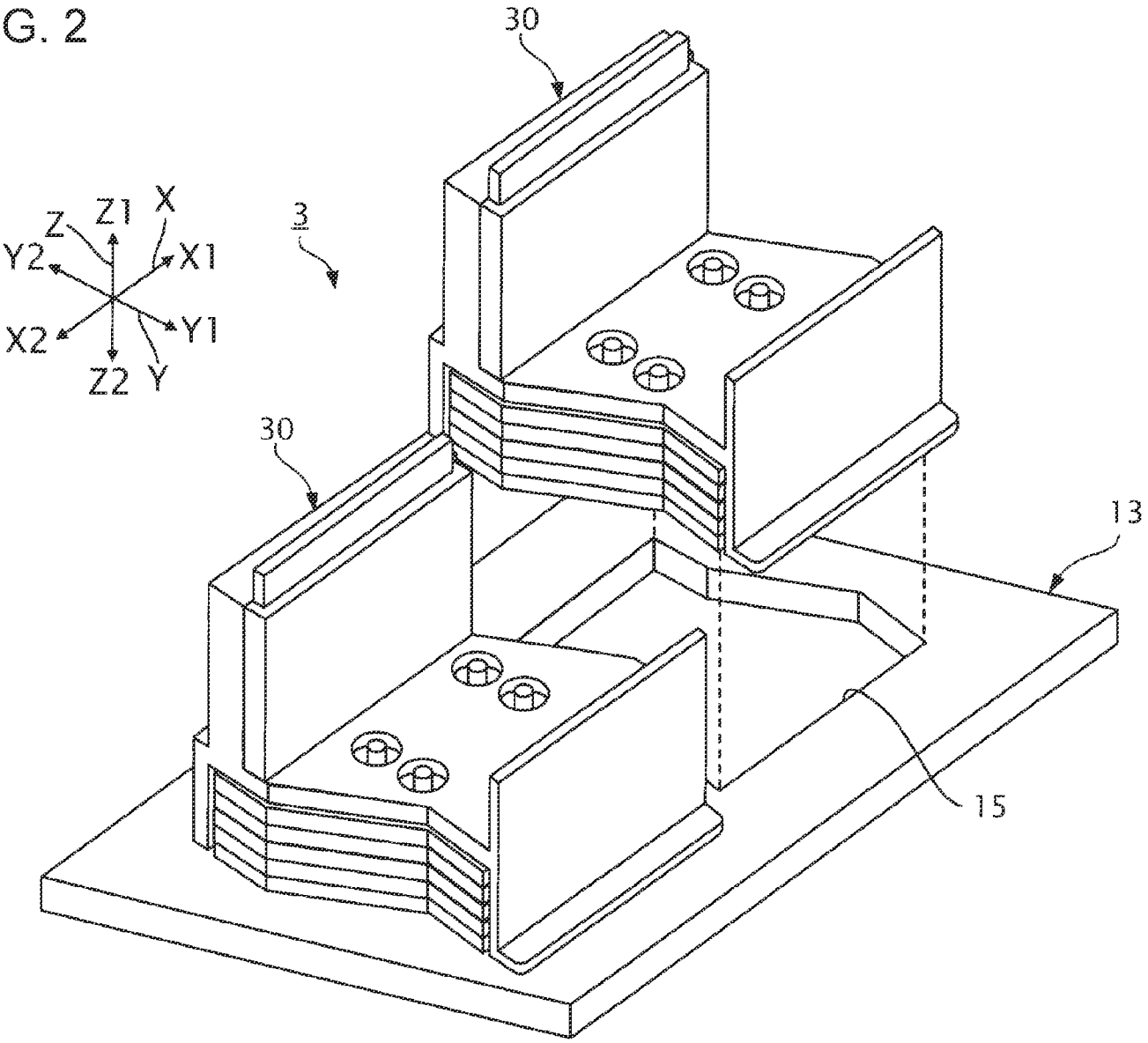
FIG. 2 is a perspective view of a head module.

FIG. 2 is a perspective view of the head module 3. The head module 3 includes a plurality of liquid ejecting heads 30 and a head fixing substrate 13 that holds the plurality of liquid ejecting heads 30. The head modules 3 are disposed side by side in the X1 direction and the X2 direction, where are directions orthogonal to the Y1 direction serving as the transport direction, and are fixed to the head fixing substrate 13. The X2 direction is a direction opposite to the X1 direction. Hereinafter, the X1 direction and the X2 direction may be collectively referred to as an X axis direction. However, the number of liquid ejecting heads 30 and the aspect of arrangement of the plurality of liquid ejecting heads 30 are not limited to the above examples. The head fixing substrate 13 includes a plurality of mounting holes 15 for mounting the liquid ejecting head 30. The liquid ejecting head 30 is supported by the head fixing substrate 13 in a state of being inserted into the mounting hole 15.

The head fixing substrate 13 is a substrate for fixing the plurality of liquid ejecting heads 30 so that the nozzles N of the plurality of liquid ejecting heads 30 face the medium 11, and is fixed to the apparatus main body 2.

The description is returned to FIG. 1. The transport portion 4 transports the medium 11 to the head module 3 in the Y axis direction. The transport portion 4 includes, for example, a first transport roller 41 provided for the head module 3 along the Y1 direction, which is the transport direction of the medium 11, and a second transport roller 42. The medium 11 is transported in the Y1 direction by the first transport roller 41 and the second transport roller 42. The transport portion 4 for transporting the medium 11 is not limited to the transport roller, and may be a belt, a drum, or the like.

The support member 7 supports the medium 11 transported by the transport portion 4 at a position facing the head module 3. The support member 7 is made of, for example, a metal or resin having a rectangular cross section, and is provided between the first transport roller 41 and the second transport roller 42 so as to face the head module 3.

The support member 7 may be provided with an adsorption unit for adsorbing the transported medium 11 on the support member 7. Examples of the adsorption unit include those that suck and adsorb the medium 11 by sucking the medium 11, and those that electrostatically adsorb the medium 11 by electrostatic force. In addition, for example, when the transport portion 4 is a belt or a drum, the support member 7 supports the medium 11 on the belt or the drum at a position facing the head module 3.

1.2. Overall Configuration of Liquid Ejecting Head 30

Figure 3:
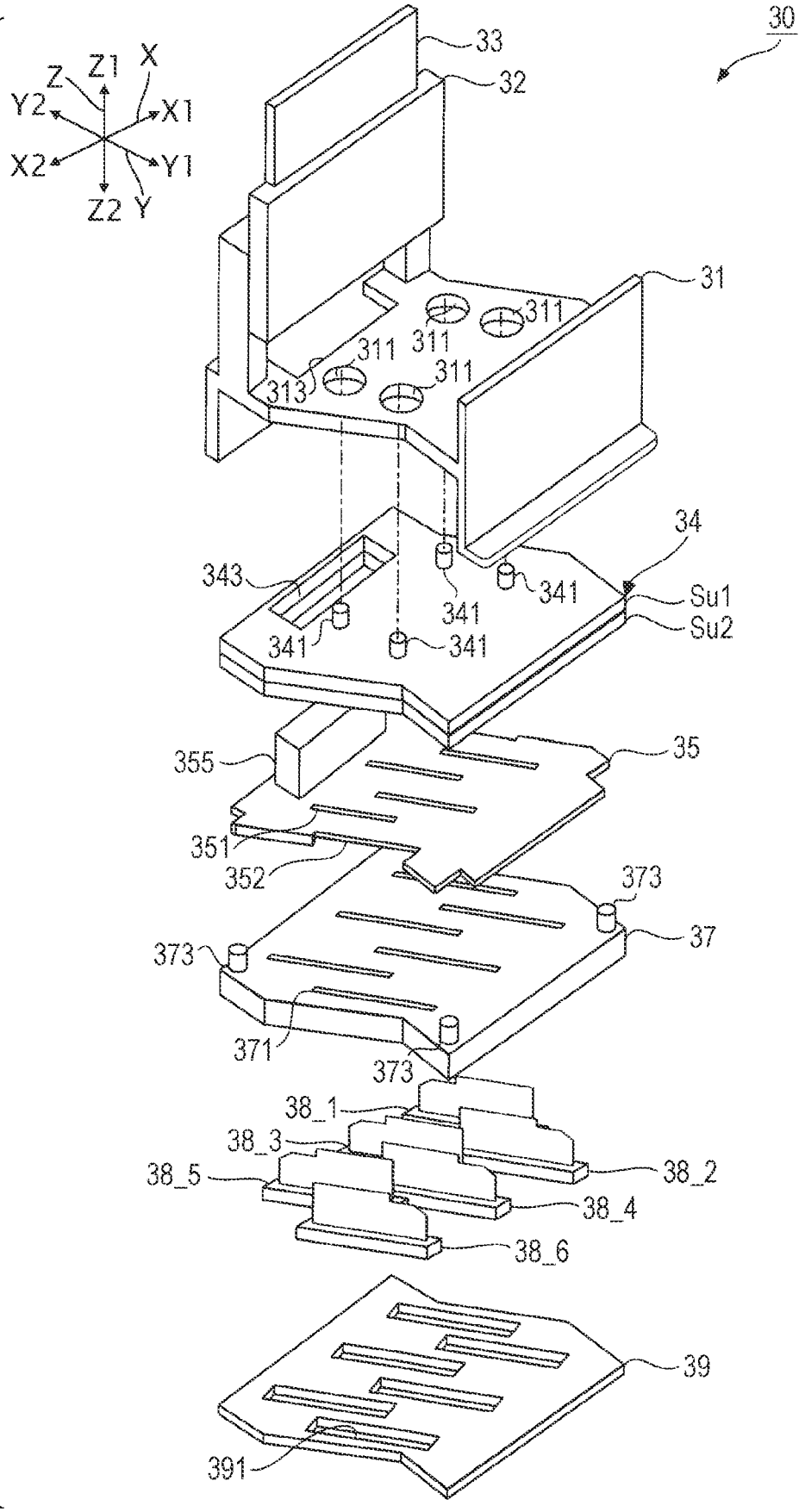
FIG. 3 is an exploded perspective view of a liquid ejecting head.

FIG. 3 is an exploded perspective view of the liquid ejecting head 30. As illustrated in FIG. 3, the liquid ejecting head 30 includes a housing 31, a cover substrate 32, an aggregate substrate 33, a flow path structure 34, a wiring substrate 35, a flow path distribution portion 37, and a fixing plate 39. Furthermore, the liquid ejecting head 30 includes head units 38_1, 38_2, 38_3, 38_4, 38_5, and 38_6. When the head units 38_1, 38_2, 38_3, 38_4, 38_5, and the head unit 38_6 are not distinguished, these head units are referred to as a head unit 38. In addition, the flow path structure 34 includes a flow path plate Su1, a flow path plate Su2, four supply coupling portions 341, and a connector hole 343.

The housing 31 supports the flow path structure 34, the wiring substrate 35, the flow path distribution portion 37, and the fixing plate 39. Furthermore, the housing 31 includes four supply holes 311 and an aggregate substrate hole 313. Any one of the four supply coupling portions 341 is inserted and fitted into each of the four supply holes 311. The aggregate substrate 33 is inserted into the aggregate substrate hole 313. The housing 31 is made of metal or resin. Alternatively, the housing 31 may be made of a member whose surface is covered with a metal film.

The cover substrate 32 interposes the aggregate substrate 33 with a portion of the housing 31 extending in the Z1 direction. The aggregate substrate 33 is a substrate on which wiring for transmitting various control signals and power supply voltages to the head unit 38 is formed. The aggregate substrate 33 is a plate-shaped member extending parallel to the XZ plane, and is directly or indirectly coupled to the signal cable 81 illustrated in FIG. 1. Here, "parallel" is a concept that includes a case where it is parallel in design, but for example, it can be regarded as parallel when considering an error generated due to the manufacturing error of the liquid ejecting head 30, in addition to a case where it is completely parallel.

The flow path structure 34 is a structure in which a flow path of ink is formed. The flow path structure 34 is disposed between the housing 31 and the wiring substrate 35. The flow path plate Su1 and the flow path plate Su2 included in the flow path structure 34 are laminated in the Z1 direction. The flow path plate Su1 and the flow path plate Su2 are bonded to each other by an adhesive or the like. The flow path plate Su1 and the flow path plate Su2 are formed, for example, by ejection molding of a resin. Each of the four supply coupling portions 341 is provided on the flow path plate Su1 in the Z1 direction and protrudes from the flow path plate Su1 in the Z1 direction. A connector 355 included in the wiring substrate 35 is inserted into the connector hole 343. A filter that catches foreign matter may be provided inside the flow path structure 34.

The wiring substrate 35 is a mounting component for electrically coupling the liquid ejecting head 30 to the control unit 8. The wiring substrate 35 is a substrate on which wiring for transmitting various control signals and power supply voltages to the head unit 38 is formed. The wiring substrate 35 is a plate-shaped member extending parallel to the XY plane, and is disposed between the flow path structure 34 and the flow path distribution portion 37. The wiring substrate 35 is a rigid substrate. The wiring substrate 35 will be described in detail with reference to FIG. 4.

Figure 4:
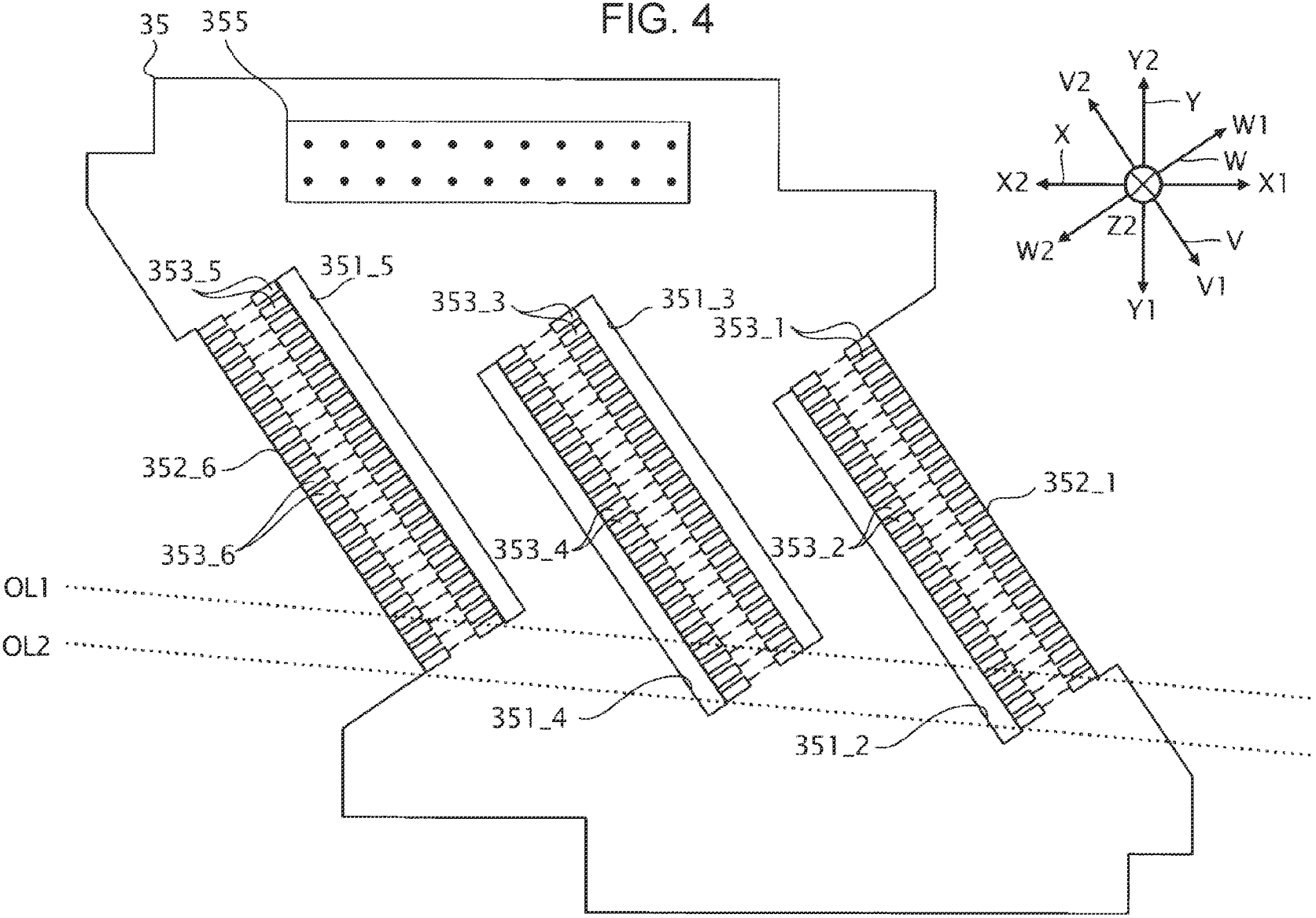
FIG. 4 is a plan view of a wiring substrate as viewed in a Z2 direction.

FIG. 4 is a plan view of the wiring substrate 35 as viewed in the Z2 direction. The wiring substrate 35 includes a cutout portion 352_1, opening portions 351_2, 351_3, 351_4, and 351_5, a cutout portion 352_6, a plurality of terminals 353_1, a plurality of terminals 353_2, a plurality of terminals 353_3, a plurality of terminals 353_4, a plurality of terminals 353_5, a plurality of terminals 353_6, and a connector 355. When the opening portions 351_2, 351_3, 351_4, and 351_5 are not distinguished, the opening portion is referred to as an opening portion 351. Similarly, when the cutout portions 352_1 and 352_6 are not distinguished, the cutout portion is referred to as a cutout portion 352. Similarly, when the plurality of terminals 353_1, the plurality of terminals 353_2, the plurality of terminals 353_3, the plurality of terminals 353_4, the plurality of terminals 353_5, and the plurality of terminals 353_6 are not distinguished, the terminal is referred to as a terminal 353. The wiring substrate 35 may have an opening portion 351 different from the opening portions 351_2, 351_3, and 351_4, instead of having one or both of the cutout portions 352_1 and 352_6.

Each of the four opening portions 351 extends in the V1 direction. In addition, one side of the cutout portion 352_1 formed and one side of the cutout portion 352_6 formed extend in the V1 direction. In addition, the plurality of terminals 353_1 are arranged in the V1 direction, the plurality of terminals 353_2 are arranged in the V1 direction, the plurality of terminals 353_3 are arranged in the V1 direction, the plurality of terminals 353_4 are arranged in the V1 direction, the plurality of terminals 353_5 are arranged in the V1 direction, and the plurality of terminals 353_6 are arranged in the V1 direction. The V1 direction intersects the X1 direction and the Y1 direction. Hereinafter, the V1 direction and the V2 direction are collectively referred to as a V axis direction. Furthermore, a direction closer to the X1 direction is referred to as a W1 direction of the two directions orthogonal to the Z1 direction and the V1 direction. In addition, a direction closer to the X2 direction is referred to as a W2 direction of the two directions orthogonal to the Z1 direction and the V1 direction. In other words, the W1 direction is a direction containing the components in the X1 direction and the Y2 direction of the two directions orthogonal to the Z1 direction and the V1 direction, and the W2 direction is a direction containing the components in the X2 direction and the Y1 direction of the two directions orthogonal to the Z1 direction and the V1 direction. Furthermore, the W1 direction and the W2 direction are collectively referred to as a W axis direction.

A wiring member 388 included in the head unit **38_*i* described later is inserted into the opening portion 351_*i*. i is an integer from 2 to 5. One side of the cutout portion 352_*j*** extending in the V1 direction is fitted with the wiring member 388 included in the head unit 38_*j*. j is 1 or 6. A plurality of input terminals 3886 provided in the input terminal portion 3882 of the wiring member 388 included in the head unit 38_*k* come into contact with the plurality of terminals 353_*k*. k is an integer from 1 to 6.

As illustrated in FIG. 4, the arrangement of the four opening portions 351 and the two cutout portions 352 has a zigzag pattern. More specific arrangements of the six opening portions 351 are as follows. One side of the cutout portion 352_1 extending in the V1 direction, the opening portion 351_2, the opening portion 351_3, the opening portion 351_4, the opening portion 351_5, and the cutout portion 352_6 are disposed in this order in the W axis direction. Furthermore, each of the cutout portion 352_1, the opening portions 351_2 to 351_5, and the cutout portion 352_6 is disposed along one of a virtual straight line OL1 and a virtual straight line OL2 parallel to the virtual straight line OLE The virtual straight line OL1 and the virtual straight line OL2 are directions orthogonal to the Z axis direction and intersecting both the X axis direction and the Y axis direction. Specifically, one side of the cutout portion 352_1 extending in the V1 direction, the opening portion 351_3, and the opening portion 351_5 are disposed along the virtual straight line OL1, and the opening portion 351_2, the opening portion 351_4, and one side of the cutout portion 352_6 extending in the V1 direction are disposed along the virtual straight line OL2. In other words, each of one side of the cutout portion 352_1 extending in the V1 direction, the opening portions 351_2 to 351_5, and one side of the cutout portion 352_6 extending in the V1 direction are disposed so as to alternately follow two virtual straight lines in the W axis direction.

The description that "the cutout portion 352 and the opening portion 351 are disposed along the virtual straight line" means that an end portion of the cutout portion 352 in the V1 direction and an end portion of the opening portion 351 in the V1 direction are disposed along the virtual straight line in plan view. The description that "the cutout portion 352 and the opening portion 351 are disposed along the virtual straight line" may mean that the end portion of the cutout portion 352 in the V2 direction and the end portion of the opening portion 351 in the V2 direction are disposed along the virtual straight line in plan view, or may mean that a center of the cutout portion 352 in the V axis direction and a center of the opening portion 351 in the V axis direction are disposed along the virtual straight line in plan view. The center of the cutout portion 352 in the V axis direction is the center of the width of the cutout portion 352, in other words, the center of the cutout portion 352 in the longitudinal direction. The center of the opening portion 351 in the V axis direction is the center of the width of the opening portion 351, in other words, the center of the opening portion 351 in the longitudinal direction.

In other words, the description that "the cutout portion 352 and the opening portion 351 are disposed along the virtual straight line" means that the end portion of the cutout portion 352 in the V1 direction and the end portion of the opening portion 351 in the V1 direction are disposed side by side so as to overlap the virtual straight line in plan view. The description that "the cutout portion 352 and the opening portion 351 are disposed along the virtual straight line" may mean that the end portion of the cutout portion 352 in the V2 direction and the end portion of the opening portion 351 in the V2 direction are disposed side by side so as to overlap the virtual straight line in plan view, or may mean that the center of the cutout portion 352 in the V axis direction and the center of the opening portion 351 in the V axis direction are disposed side by side so as to overlap the virtual straight line in plan view.

The description is returned to FIG. 3. The flow path distribution portion 37 is disposed between the wiring substrate 35 and the fixing plate 39, and is fixed to the fixing plate 39 with an adhesive. Therefore, the flow path distribution portion 37 reinforces the fixing plate 39. The flow path distribution portion 37 is made of, for example, resin or metal. From the viewpoint of the above-described reinforcement, the thickness of the flow path distribution portion 37 is preferably thicker than the thickness of the fixing plate 39. The liquid ejecting head 30 may not be provided with the flow path distribution portion 37, and the fixing plate 39 and the plurality of head units 38 may be fixed to each other.

Figure 5:
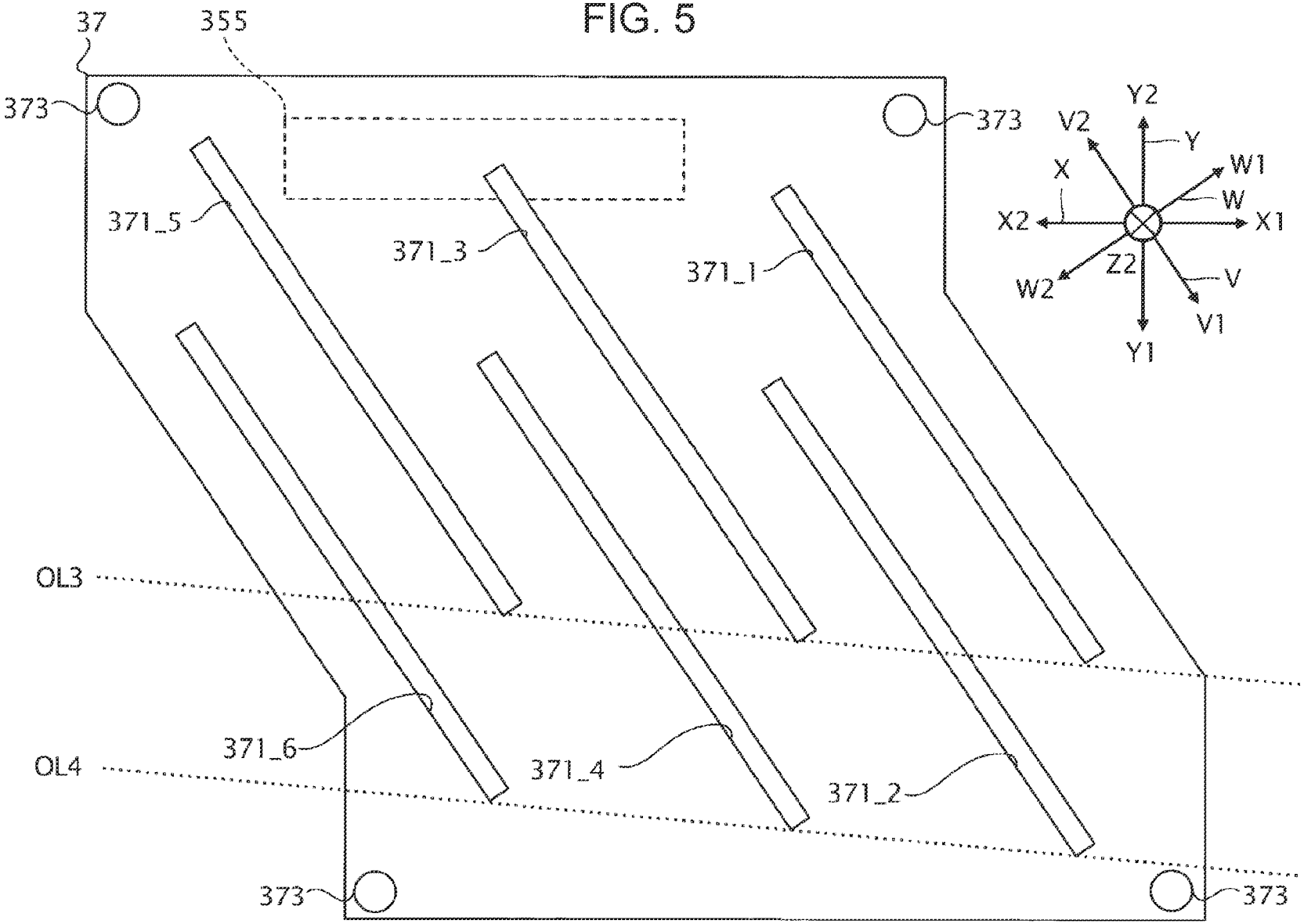
FIG. 5 is a plan view of a flow path distribution portion as viewed in the Z2 direction.

FIG. 5 is a plan view of the flow path distribution portion 37 as viewed in the Z2 direction. The flow path distribution portion 37 is a flow path member in which a plurality of substrates are laminated. Four introduction coupling portions 373 are provided on the surface of the flow path distribution portion 37 on the Z1 direction side. The four introduction coupling portions are flow path pipes protruding in the Z1 direction from the surface of the flow path distribution portion 37 on the Z1 direction side, and are disposed at the four corners of the flow path distribution portion 37. The four introduction coupling portions 373 communicate with four flow path holes formed on the surface of the flow path structure 34 on the Z2 direction side (not illustrated), and allow the liquid to introduce from the flow path structure 34 into the flow path distribution portion 37. The flow path distribution portion 37 includes a flow path for distributing the liquid supplied from the flow path structure 34 to each head unit 38.

The flow path distribution portion 37 includes a plurality of opening portions 371_1, 371_2, 371_3, 371_4, 371_5, and 371_6 penetrating in the Z axis direction. When the plurality of opening portions 371_1 to 371_6 are not distinguished, the plurality of opening portions are referred to as the opening portion 371. The wiring members 388 included in each of the plurality of head units 38 are inserted into the six opening portions 371. The arrangement of each of the six opening portions 371 has a zigzag pattern along either a virtual straight line OL3 and a virtual straight line OL4 parallel to the virtual straight line OL3, similarly to the opening portion 351 of the wiring substrate 35. The extending direction of the virtual straight line OL3 and the virtual straight line OL4 is the same as the extending direction of the virtual straight line OL1 and the virtual straight line OL2. Specifically, the end portions of the opening portions 371_1, 371_3, and 371_5 in the V1 direction are disposed along the virtual straight line OL1 in plan view. In addition, the end portions of the opening portions 371_2, 371_4, and 371_6 in the V1 direction are disposed along the virtual straight line OL3 in plan view. The virtual straight line OL3 may be the same straight line as the virtual straight line OL1.

The opening portion 371 is an opening portion that is longer in the V axis direction than the opening portion 351 of the wiring substrate 35. Specifically, the opening portion 371_1 communicates with the cutout portion 352_1 of the wiring substrate 35, and extends in the V2 direction rather than one side of the opening portion 351_1 extending in the V1 direction in plan view viewed in the Z2 direction. Hereinafter, the plan view viewed in the Z2 direction is simply referred to as a "plan view". The opening portion 371_2 communicates with the opening portion 351_2 of the wiring substrate 35, and extends in the V1 direction from the opening portion 351_2 in plan view. The opening portion 371_3 communicates with the opening portion 351_3 of the wiring substrate 35 and extends in the V2 direction from the opening portion 351_3 in plan view. The opening portion 371_4 communicates with the opening portion 351_4 of the wiring substrate 35 and extends in the V1 direction from the opening portion 351_4 in plan view. The opening portion 371_5 communicates with the opening portion 351_5 of the wiring substrate 35 and extends in the V2 direction from the opening portion 351_5 in plan view. The opening portion 371_6 communicates with the cutout portion 352_6 of the wiring substrate 35 and extends in the V1 direction from the cutout portion 352_6 in the V1 direction in plan view.

The connector 355 is electrically coupled to the aggregate substrate 33 via the connector hole 343. As illustrated in FIG. 5, the connector 355 overlaps a portion of the opening portion 371_3 of the flow path distribution portion 37 in plan view.

The head unit 38 includes M nozzles N1 and M nozzles N2. M is an integer greater than or equal to 2. Hereinafter, the nozzle N1 and the nozzle N2 may be collectively referred to as a nozzle N. The arrangement of each of the six head units 38 has a zigzag pattern, similar to the opening portion 351 of the wiring substrate 35. The head unit 38_1 will be described with reference to FIGS. 6 and 7.

Figure 6:
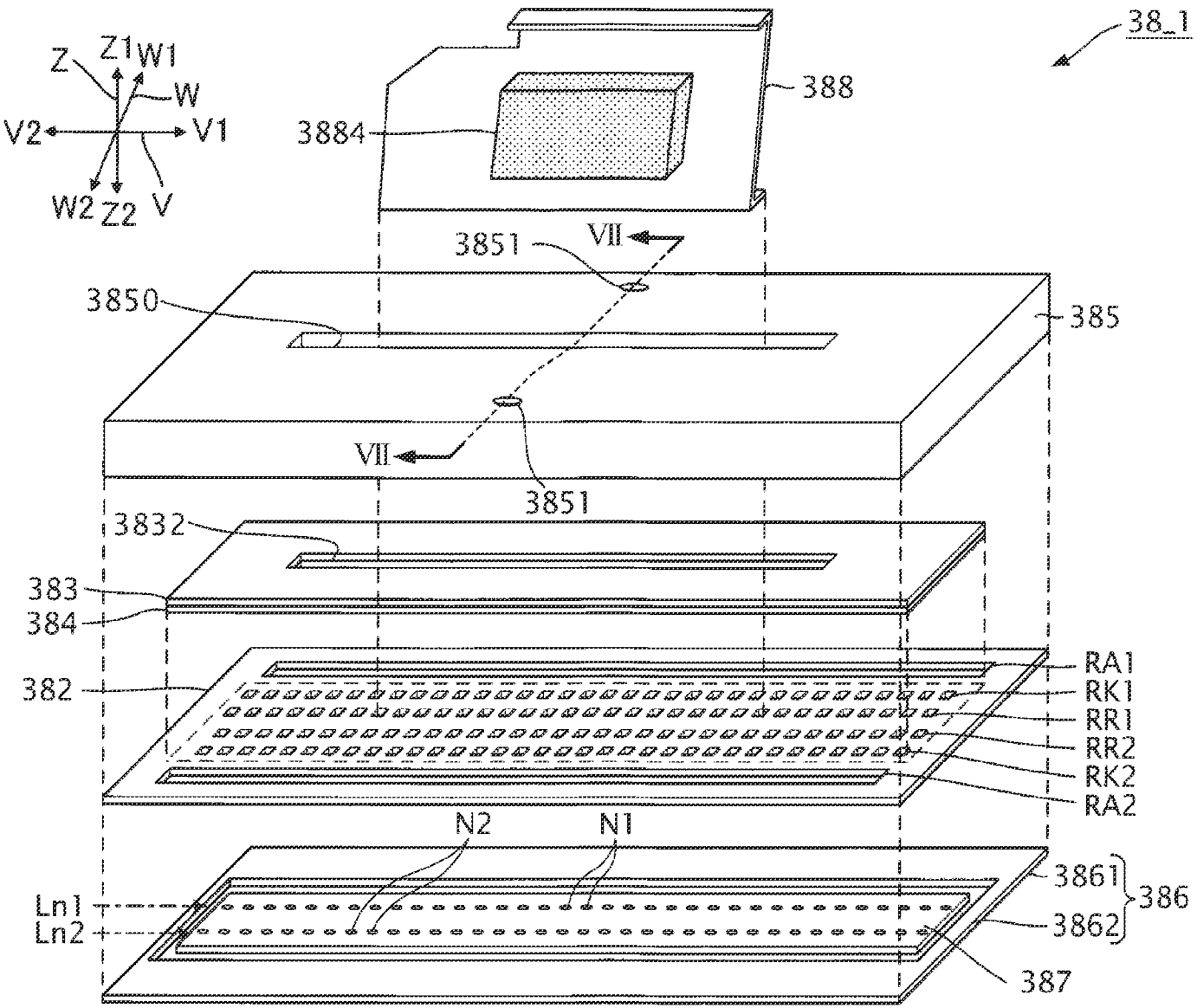
FIG. 6 is an exploded perspective view of a head unit.
Figure 7:
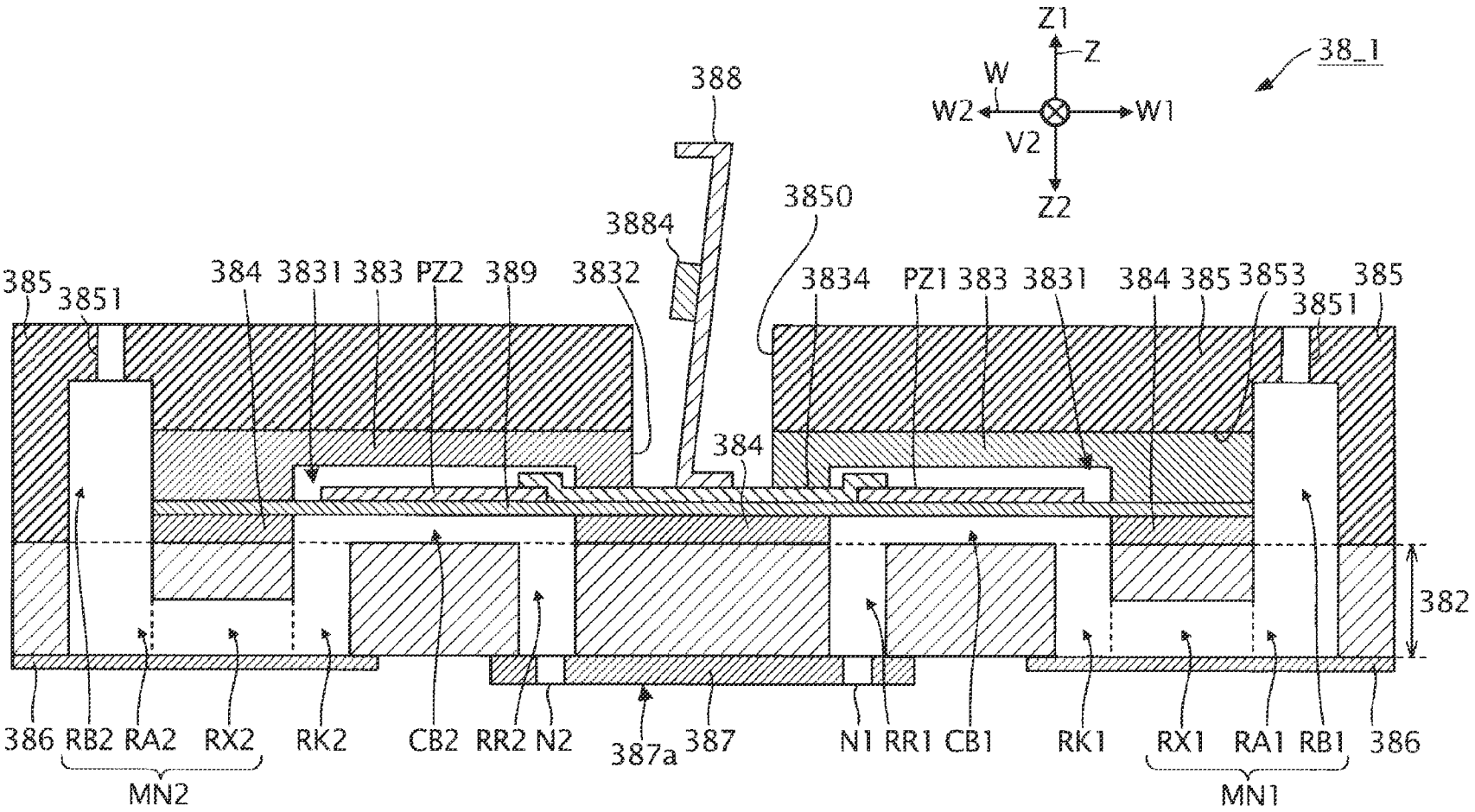
FIG. 7 is a cross-sectional view taken along the line VII-VII in FIG. 6.

FIG. 6 is an exploded perspective view of the head unit 38_1. FIG. 7 is a cross-sectional view taken along the line VII-VII in FIG. 6. The VII-VII line is a virtual line segment that passes through an introduction path 3851 and passes through the nozzle N1 and the nozzle N2.

The head unit 38_1 includes a wiring member 388, a case 385, a protective substrate 383, a flow path forming substrate 384, a communication plate 382, a compliance substrate 386, and a nozzle plate 387. A plurality of members included in the head unit 38_1 are bonded by an adhesive or the like.

A pressure chamber CB1 and a pressure chamber CB2 partitioned by a plurality of partition walls are disposed side by side in the V axis direction on the flow path forming substrate 384 by anisotropic etching from one surface side. In the following description, the pressure chamber CB1 and the pressure chamber CB2 are collectively referred to as a pressure chamber CB. The V axis direction coincides with a juxtaposed direction of the plurality of nozzles N. In addition, a row of pressure chambers CB1 and a row of pressure chambers CB2 are provided side by side in the V axis direction on the flow path forming substrate 384. The rowing direction where the two rows of the pressure chamber CB are provided is the W axis direction.

In addition, the flow path forming substrate 384 may be provided a supply path having a smaller opening area than that of the pressure chamber CB and imparting a flow path resistance of ink flowing into the pressure chamber CB on one end portion side of the pressure chamber CB in the W axis direction.

A communication plate 382 is bonded to the surface of the flow path forming substrate 384 in the Z2 direction. In addition, a nozzle plate 387 provided with a plurality of nozzles N communicating with each pressure chamber CB is bonded to the surface of the communication plate 382 in the Z2 direction. In the first embodiment, the surface of the nozzle plate 387 in the Z1 direction where the nozzle N opens is a liquid ejecting surface 387*a*.

The communication plate 382 is provided with a nozzle communication passage RR1 that communicates with the pressure chamber CB1 and the nozzle N1, and a nozzle communication passage RR2 that communicates with the pressure chamber CB2 and the nozzle N2. Hereinafter, the nozzle communication passage RR1 and the nozzle communication passage RR2 are collectively referred to as a nozzle communication passage RR. The communication plate 382 has a larger area than that of the flow path forming substrate 384, and the nozzle plate 387 has a smaller area than that of the flow path forming substrate 384. By making the area of the nozzle plate 387 relatively small in this manner, the cost can be reduced.

In addition, the communication plate 382 is provided with a supply communication passage RA1 forming a portion of the manifold MN1 and a coupling communication passage RX1. The supply communication passage RA1 is provided so as to penetrate the communication plate 382 in the Z axis direction. The coupling communication passage RX1 is provided halfway in the Z axis direction by opening to the nozzle plate 387 side of the communication plate 382 without penetrating the communication plate 382 in the Z axis direction. Similarly, the communication plate 382 is provided with a supply communication passage RA2 forming a portion of the manifold MN2 and a coupling communication passage RX2. Hereinafter, the manifold MN1 and the manifold MN2 are collectively referred to as a manifold MN. Similarly, the supply communication passage RA1 and the supply communication passage RA2 are collectively referred to as a supply communication passage RA. Similarly, the coupling communication passage RX1 and the coupling communication passage RX2 are collectively referred to as a coupling communication passage RX. The supply communication passage RA2 is provided so as to penetrate the communication plate 382 in the Z axis direction. The coupling communication passage RX2 is provided halfway in the Z axis direction by opening to the nozzle plate 387 side of the communication plate 382 without penetrating the communication plate 382 in the Z axis direction.

Furthermore, in the communication plate 382, a pressure chamber communication passage RK1 communicating with the end portion of the pressure chamber CB1 in the W1 direction and a pressure chamber communication passage RK2 communicating with the end portion of the pressure chamber CB2 in the W2 direction are independently provided for each pressure chamber CB. The pressure chamber communication passage RK1 communicates with the coupling communication passage RX1 and the pressure chamber CB1. The pressure chamber communication passage RK2 communicates with the coupling communication passage RX2 and the pressure chamber CB2.

The nozzle plate 387 is formed with the nozzles N that communicate with each of the pressure chambers CB via the nozzle communication passage RR. A plurality of nozzles N are disposed side by side in the V axis direction, a plurality of nozzles N1 disposed side by side form a nozzle row Ln1, a plurality of nozzles N2 disposed side by side form a nozzle row Ln2, and the nozzle row Ln1 and the nozzle row Ln2 are disposed side by side in the W axis direction. In the first embodiment, each of the nozzle row Ln1 and the nozzle row Ln2 can eject one type of liquid.

A diaphragm 389 is formed on the surface of the flow path forming substrate 384 in the Z1 direction. In addition, a piezoelectric element PZ1 and a piezoelectric element PZ2 are formed on the diaphragm 389. Hereinafter, the piezoelectric element PZ1 and the piezoelectric element PZ2 are collectively referred to as a piezoelectric element PZ. Normally, one electrode included in the piezoelectric element PZ is used as a common electrode, and the other electrode and a piezoelectric layer are patterned for each pressure chamber CB.

In addition, the protective substrate 383 having substantially the same size as that of the flow path forming substrate 384 in plan view is bonded to the surface of the flow path forming substrate 384 in the Z1 direction. The protective substrate 383 includes a holding portion 3831 which is a space for protecting the piezoelectric element PZ. In addition, the protective substrate 383 is provided with a through-hole 3832 penetrating in the Z axis direction. The end portion of a lead electrode 3834 drawn from the electrode of the piezoelectric element PZ is extended so as to be exposed in the through-hole 3832, and the lead electrode 3834 and the wiring member 388 are electrically coupled to each other in the through-hole 3832.

In addition, a case 385 that defines the manifold MN communicating with a plurality of pressure chambers CB is fixed to the protective substrate 383 and the communication plate 382. The case 385 has substantially the same shape as that of the above-described communication plate 382 in plan view, and is bonded to the protective substrate 383 and also to the above-described communication plate 382. Specifically, the case 385 includes a recessed portion 3853 having a depth for accommodating the flow path forming substrate 384 and the protective substrate 383 on the surface in the Z2 direction. The recessed portion 3853 has a wider opening area than that of the surface on which the protective substrate 383 is bonded to the flow path forming substrate 384. The opening portion surface of the recessed portion 3853 in the Z2 direction is sealed by the communication plate 382 in a state where the flow path forming substrate 384 and the like are accommodated in the recessed portion 3853. As a result, the supply communication passage RB1 and the supply communication passage RB2 are defined by the case 385, the flow path forming substrate 384, and the protective substrate 383 on an outer peripheral portion of the flow path forming substrate 384. The supply communication passage RB1 and the supply communication passage RB2 may be collectively referred to as a supply communication passage RB2. The manifold MN1 includes the supply communication passage RB1 and the supply communication passage RA1 and the coupling communication passage RX1 provided on the communication plate 382. Similarly, the manifold MN2 includes the supply communication passage RB2 and the supply communication passage RA2 and the coupling communication passage RX2 provided on the communication plate 382.

Each of the supply communication passage RA, the coupling communication passage RX, and the supply communication passage RB constituting the manifold MN is disposed symmetrically with the nozzle row Ln1 and the nozzle row Ln2 interposed therebetween. As a result, it is possible to eject different inks for each of the nozzle row Ln1 and the nozzle row Ln2. The arrangement of the manifold MN is not limited to the first embodiment.

One manifold common to the two rows of the nozzle row Ln1 and the nozzle row Ln2 may be used. In addition, in the first embodiment, the liquid ejecting head 30 has two nozzle rows Ln, and may have one nozzle row Ln. The color of the ink ejected from each nozzle N of the nozzle rows Ln1 of the head units 38_1 to 38_6 is cyan or magenta, and the color of the ink ejected from each nozzle N of the nozzle rows Ln2 of the head units 38_1 to 38_6 is yellow or black. The color of the ink is not limited to the above aspect. For example, the color of the ink ejected from each nozzle N of the nozzle rows Ln1 of the head units 38_1, 38_3, and 38_5 is magenta, and the color of the ink ejected from each nozzle N of the nozzle rows Ln2 of the head units 38_1, 38_3, and 38_5 is cyan. The color of the ink ejected from each nozzle N of the nozzle rows Ln1 of the head units 38_2, 38_4, and 38_6 is yellow, and the color of the ink ejected from each nozzle N of the nozzle rows Ln2 of the head units 38_2, 38_4, and 38_6 is black.

In addition, a compliance substrate 386 is provided on the surface of the communication plate 382 where the supply communication passage RA and the coupling communication passage RX are opened. The compliance substrate 386 seals the opening of the supply communication passage RA and the coupling communication passage RX.

In the first embodiment, such a compliance substrate 386 includes a sealing film 3861 and a fixed substrate 3862. The sealing film 3861 is made of a flexible thin film or the like. For example, the sealing film 3861 is made of polyphenylene sulfide or stainless steel. In addition, the fixed substrate 3862 is made of a hard material such as a metal such as stainless steel.

In addition, the case 385 is provided with four introduction paths 3851 for supplying ink to the manifold MN. In addition, the case 385 is provided with a coupling port 3850 into which the wiring member 388 is inserted so as to communicate with the through-hole 3832 of the protective substrate 383. The coupling port 3850 is an opening penetrating in the Z axis direction, and communicates with the opening portion 351 of the wiring substrate 35 and the opening portion 371 of the flow path distribution portion 37, or the cutout portion 352 of the wiring substrate 35 and the opening portion 371 of the flow path distribution portion 37.

The wiring member 388 is a flexible substrate for electrically coupling the wiring substrate 35 and each head unit 38. The wiring member 388 is, for example, a flexible substrate such as chip on film (COF), flexible printed circuits (FPC), or flexible flat cable (FFC). From the viewpoint of manufacturing cost, the wiring member 388 is preferably COF or FPC. The wiring member 388 will be described with reference to FIG. 8.

Figure 8:
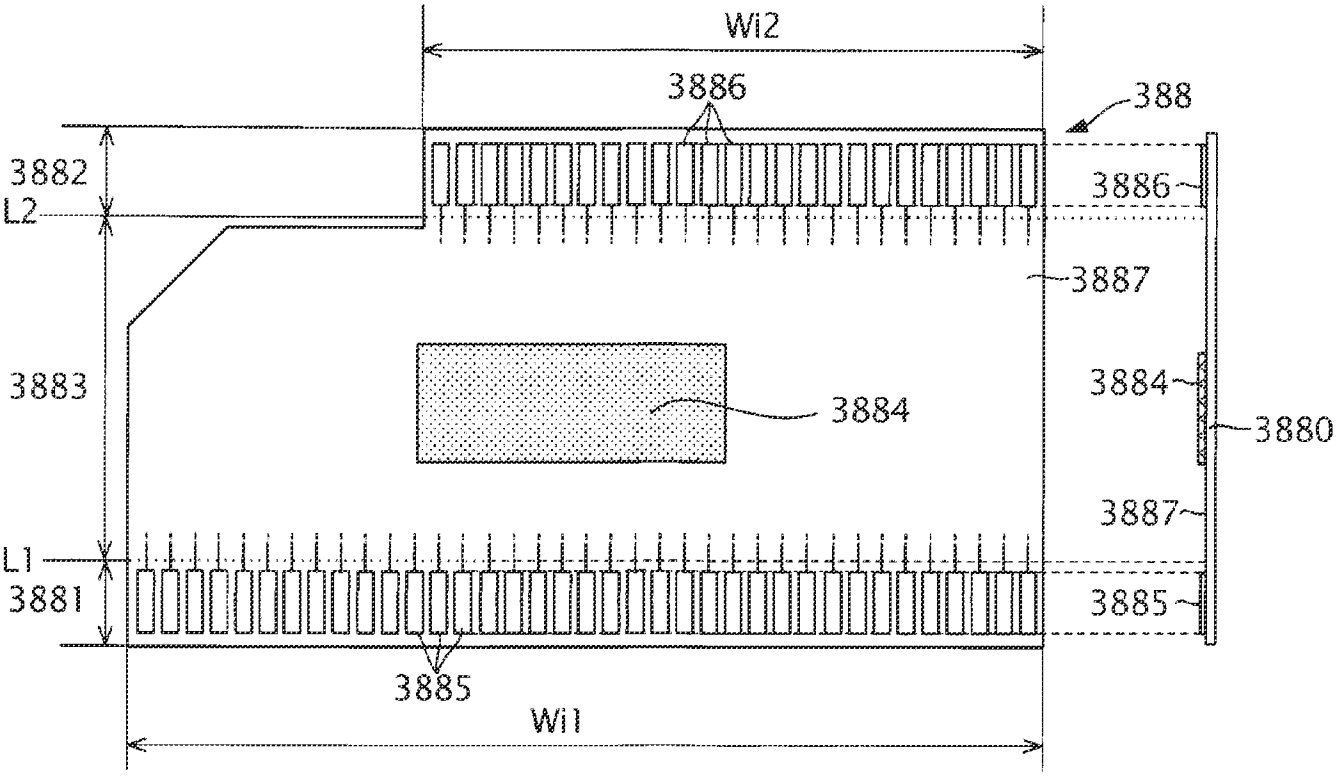
FIG. 8 is a plan view and a side view of a wiring member.

FIG. 8 is a plan view and a side view of the wiring member 388. The wiring member 388 is configured to include a flexible base material 3880 and a plurality of wirings formed on a wiring forming surface 3887 of the base material 3880. The wiring member 388 illustrated in FIG. 8 is in a state where no external force is applied to the wiring member 388. Wiring for transmitting the control signal and the power supply voltage supplied from the wiring substrate 35 to the head unit 38 is formed on the wiring forming surface 3887.

The wiring member 388 includes an output terminal portion 3881, an input terminal portion 3882, and a relay portion 3883. As illustrated in FIG. 8, the output terminal portion 3881 and the input terminal portion 3882 are portions located at both ends of the wiring member 388. That is, in the wiring member 388, the relay portion 3883 is located between the output terminal portion 3881 and the input terminal portion 3882. In FIG. 8, a boundary L1 of the output terminal portion 3881 and the relay portion 3883 and a boundary L2 of the input terminal portion 3882 and the relay portion 3883 are illustrated.

As illustrated in FIG. 8, a width Wi2 of the input terminal portion 3882 is smaller than a width Wi1 of the output terminal portion 3881. Furthermore, the width Wi2 is larger than half of the width Wi1.

Furthermore, as illustrated in FIGS. 6 and 8, the wiring member 388 has a shape in which the input terminal portion 3882 is closer to one side with respect to the entire width of the wiring member 388. Specifically, in the example of FIG. 8, the input terminal portion 3882 is closer to the right side. More specifically, when viewed from the upper part of the wiring member 388, the right end of the input terminal portion 3882 and the right end of the output terminal portion 3881 overlap each other, and the left end of the input terminal portion 3882 is located on the right side as compared with the left end of the output terminal portion 3881.

As illustrated in FIG. 8, a plurality of output terminals 3885 electrically coupled to each piezoelectric element PZ are formed on the wiring forming surface 3887 of the output terminal portion 3881, and a plurality of input terminals 3886 electrically coupled to the wiring substrate 35 are formed on the wiring forming surface 3887 of the input terminal portion 3882. In addition, a drive circuit 3884 is mounted on the relay portion 3883. The drive circuit 3884 uses the control signal and the power supply voltage supplied from the wiring substrate 35 to generate a drive signal for each piezoelectric element PZ. The drive signal generated by the drive circuit 3884 is supplied to the head unit 38 via the output terminal 3885.

As illustrated in FIGS. 6 and 7, in the wiring member 388, the output terminal portion 3881 is bent at the boundary L1 with respect to the relay portion 3883, and the input terminal portion 3882 is bent at the boundary L2 with respect to the relay portion 3883.

Figure 9:
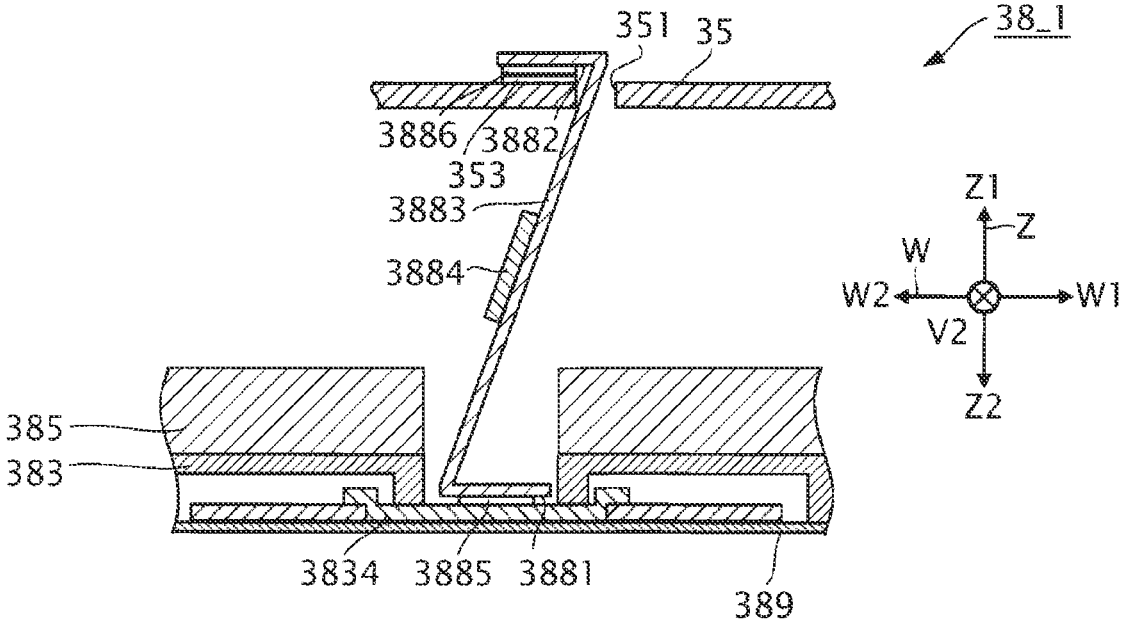
FIG. 9 is a diagram illustrating an example of contact between an output terminal and an input terminal.

FIG. 9 is a diagram illustrating an example of contact between the output terminal 3885 and the input terminal 3886. The figure illustrated in FIG. 9 is a view of a cross section when the vicinity of the wiring member 388 is broken in parallel with the WZ plane, viewed in the V2 direction. In FIG. 9, the display of the flow path distribution portion 37 is omitted for simplification of the illustration. The input terminal 3886 comes into contact with the terminal 353 of the wiring substrate 35 in a state where the output terminal 3885 and the lead electrode 3834 are in contact with each other.

The description is returned to FIGS. 6 and 7. When ejecting ink, the head unit 38_1 takes in ink from the liquid container via the supply coupling portion 341 and the introduction path 3851, and fills the inside of the flow path with ink from the manifold NM to the nozzle N. Thereafter, the drive circuit 3884 bends and deforms the diaphragm 389 together with the piezoelectric element PZ by supplying the drive signal to the piezoelectric element PZ. As a result, the pressure in the pressure chamber CB increases, and ink droplets are ejected from the nozzle N.

The description is returned to FIG. 3. Although the head unit 38_1 is described with reference to FIGS. 4 to 9, the configuration of the head units 38_2 to 38_6 is also the same as the configuration of the head unit 38_1. However, the wiring members 388 of the head units 38_1, 38_3, and 38_5 are disposed in an orientation where the input terminal portion 3882 is closer to the V1 direction. On the other hand, the wiring members 388 of the head units 38_2, 38_4, and 38_6 are disposed in the orientation where the input terminal portion 3882 is closer to the V2 direction. Each of the wiring members 388 of the head units 38_1 to 38_6 all has the same shape. The wiring members 388 of the head units 38_2, 38_4, and 38_6 are disposed in an orientation rotated by 180 degrees with the Z axis direction as an axis based on the orientation of the wiring member 388 of the head unit 38_1. The wiring member 388 of the head unit 38_1 and the wiring member 388 of the head unit 38_2 are disposed so as to be point-symmetrical to each other. The wiring member 388 of the head unit 38_3 and the wiring member 388 of the head unit 38_4 are also disposed so as to be point-symmetrical to each other. The wiring member 388 of the head unit 38_5 and the wiring member 388 of the head unit 38_6 are also disposed so as to be point-symmetrical to each other.

The fixing plate 39 is adhered to the surface of the compliance substrate 386 in the Z2 direction. That is, the six exposed opening portions 391 provided in the fixing plate 39 have an opening area wider than the area of the nozzle plate 387, and expose the liquid ejecting surface 387*a* of the nozzle plate 387 within the exposed opening portion 391. The arrangement of each of the six exposed opening portions 391 has a zigzag pattern, similar to the opening portion 351 and the cutout portion 352 of the wiring substrate 35.

1.3. Summary of First Embodiment

Figure 10:
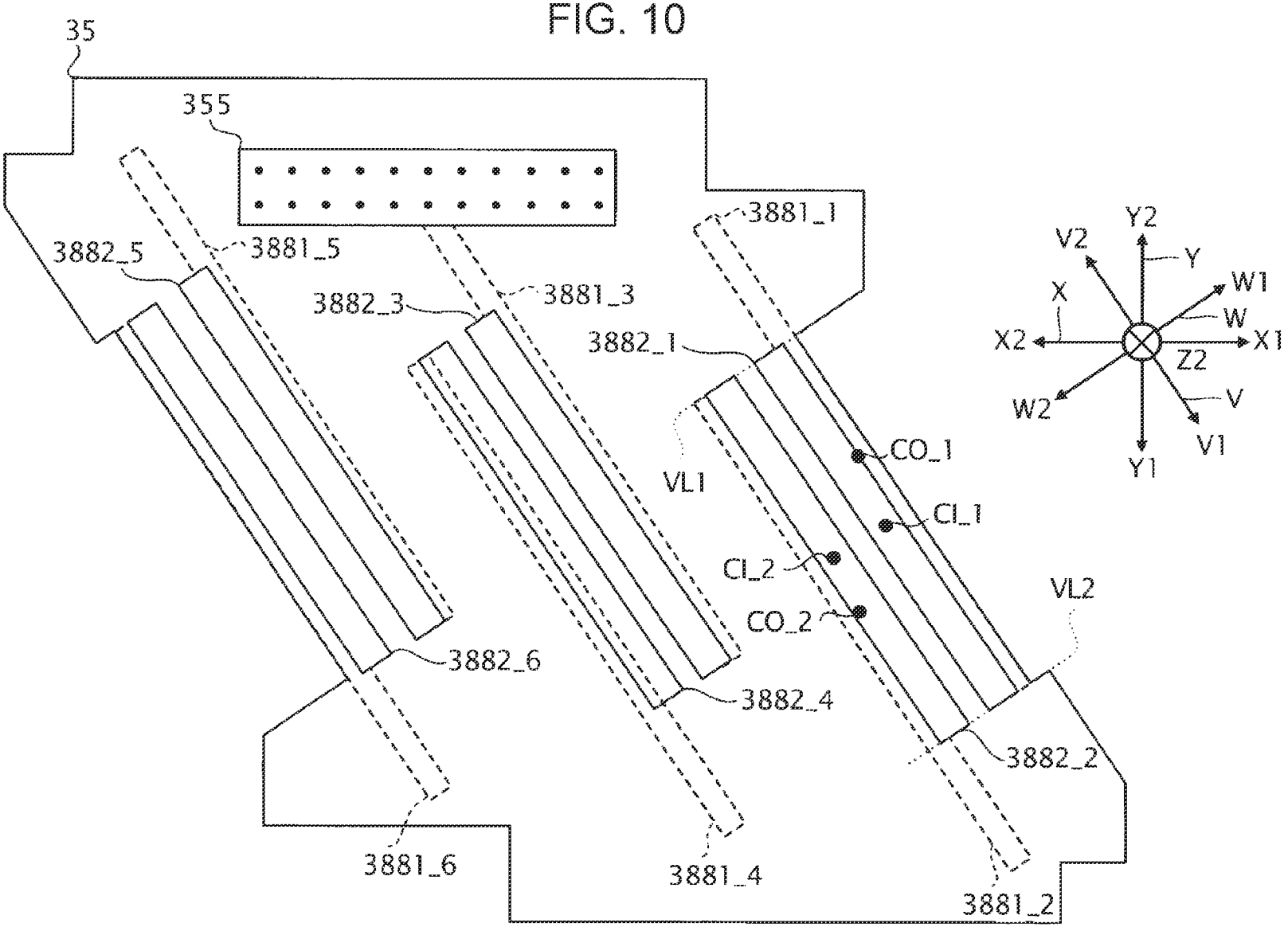
FIG. 10 is a diagram illustrating a positional relationship between the wiring member and the wiring substrate.

FIG. 10 is a diagram illustrating a positional relationship between the wiring member 388 and the wiring substrate 35. The figure illustrated in FIG. 10 is a view of the wiring substrate 35 viewed in the Z2 direction. However, in FIG. 10, the display of the opening portion 351 and the terminal 353 is omitted in order to prevent the illustration from being complicated. Furthermore, in FIG. 10, the output terminal portion 3881 is illustrated by a broken line. Furthermore, in the following description and FIGS. 10 and 11, the wiring member 388 included in the head unit 38_*i* is referred to as an wiring member 388_*i*, the output terminal portion 3881 included in the wiring member 388_*i* is referred to as an output terminal portion 3881_*i*, and the input terminal portion 3882 included in the wiring member 388_*i* is referred to as an input terminal portion 3882_*i*. i is an integer from 1 to 6. When the wiring substrate 35 is viewed in the Z2 direction, the input terminal portion 3882 is the only member of the wiring member 388 which is not shaded by other members.

In each of i from 1 to 6, the output terminal portion 3881_*i* and the input terminal portion 3882_*i* extend in the V1 direction. In other words, the plurality of output terminals 3885 constituting the output terminal portion 3881_*i* are disposed in the V1 direction, and the plurality of input terminals 3886 constituting the input terminal portion 3882_*i* are disposed in the V1 direction. In each of i from 1 to 6, the input terminal portion 3882_*i* is coupled to the wiring substrate 35. The wiring substrate 35 is an example of the "first wiring substrate".

As illustrated in FIG. 10, the center CO_1 of the output terminal portion 3881_1 is located so as to be displaced in the V2 direction with respect to the center CO_2 of the output terminal portion 3881_2. A wiring member 388_1 is an example of the "first wiring member". A wiring member 388_2 is an example of the "second wiring member". The output terminal portion 3881_1 is an example of the "first output terminal portion". The input terminal portion 3882_1 is an example of the "first input terminal portion". The output terminal portion 3881_2 is an example of the "second output terminal portion". The input terminal portion 3882_2 is an example of the "second input terminal portion". The center of the output terminal portion 3881 is the center of the width of the output terminal portion 3881, and is the center of the output terminal portion 3881_1 in the longitudinal direction (V axis direction). The V2 direction is an example of the "first direction". The center CI_1 of the input terminal portion 3882_1 is disposed so as to be displaced in the V1 direction with respect to the center CO_1 of the output terminal portion 3881_1 in plan view. The center of the input terminal portion 3882 is the center of the width of the input terminal portion 3882, and is the center of the input terminal portion 3882 in the longitudinal direction (V axis direction). The V1 direction is an example of the "second direction". The center CI_2 of the input terminal portion 3882_2 is disposed so as to be displaced in the V2 direction with respect to the center CO_2 of the output terminal portion 3881_2 in plan view.

According to the first embodiment, even when the wiring members 388 are disposed so as to be displaced in the V axis direction, by bringing the plurality of input terminal portions 3882 closer to each other, the opening portions 351 of the wiring substrate 35 into which the input terminal portions 3882 are inserted come close to each other, and the opening portions 351 and the cutout portion 352 come close to each other. Therefore, since the region forming the opening portion 351 and the region forming the cutout portion 352 in the wiring substrate 35 can be reduced, the wiring substrate 35 can be miniaturized in the V axis direction.

In addition, as illustrated in FIG. 8, the width Wi2 of the input terminal portion 3882 is smaller than the width Wi1 of the output terminal portion 3881. According to the first embodiment, as compared with the aspect in which the width Wi2 and the width Wi1 have the same length, by disposing the head unit 38 inverted, it is easy to bring the plurality of input terminal portions 3882 closer to each other. By bringing the plurality of input terminal portions 3882 closer to each other, the wiring substrate 35 can be miniaturized in the V axis direction.

In addition, at least a portion of the input terminal portion 3882_1 and at least a portion of the input terminal portion 3882_2 overlap each other in the W1 direction orthogonal to the V2 direction. The W1 direction is an example of "a direction orthogonal to the first direction". By overlapping at least a portion of the input terminal portion 3882_1 and at least a portion of the input terminal portion 3882_2, as compared with the aspect in which the input terminal portion 3882_1 and the input terminal portion 3882_2 do not overlap each other, the opening portions 351 of the wiring substrate 35 into which the input terminal portion 3882 is inserted are closer to each other, and the opening portion 351 and the cutout portion 352 are closer to each other. Therefore, since the region forming the opening portion 351 and the region forming the cutout portion 352 in the wiring substrate 35 can be reduced, the wiring substrate 35 can be miniaturized.

The entire input terminal portion 3882_1 may overlap the entire input terminal portion 3882_2, or a portion of the input terminal portion 3882_1 may overlap a portion of the input terminal portion 3882_2. From the viewpoint of miniaturizing the wiring substrate 35, it is preferable that all of the input terminal portions 3882_1 overlap all of the input terminal portions 3882_2. In the example of FIG. 10, as illustrated by the virtual straight line VL1, the position of the end portion of the input terminal portion 3882_1 in the V2 direction and the position of the end portion of the input terminal portion 3882_2 in the V2 direction are the same as each other in the V axis direction. Here, "the same as each other" is a concept including a case where the design is the same and it can be regarded as the same when considering an error generated due to, for example, a manufacturing error of the liquid ejecting head 30, in addition to a case when these are completely the same. Furthermore, as illustrated by the virtual straight line VL2, the position of the end portion of the input terminal portion 3882_1 in the V1 direction and the position of the end portion of the input terminal portion 3882_2 in the V1 direction are the same as each other in the V axis direction. Therefore, the entire input terminal portion 3882_1 overlaps the entire input terminal portion 3882_2.

In addition, the wiring member 388_1 and the wiring member 388_2 have the same shape and are disposed so as to be point-symmetrical with each other. According to the first embodiment, the liquid ejecting head 30 can be easily manufactured as compared with the aspect in which the wiring member 388_1 and the wiring member 388_2 have different shapes. More specifically, since the head unit 38_2 is disposed to be point-symmetrical with the head unit 38_1 with the Z axis direction as an axis, the head unit 38_2 can include a member common to the head unit 38_1. That is, the liquid ejecting head 30 can be include a common head unit 38. By sharing the head unit 38, the cost required for manufacturing the liquid ejecting head 30 can be reduced, and the manufacturing of the liquid ejecting head 30 can be facilitated.

In addition, as illustrated in FIG. 8, the width Wi2 of the input terminal portion 3882_1 is larger than half the width Wi1 of the output terminal portion 3881_1, and the width Wi2 of the input terminal portion 3882_2 is larger than half the width Wi1 of the output terminal portion 3881_2. When the nozzle N has a high density, the width of the input terminal portion 3882 is larger than the width of the output terminal portion 3881, and even in such a configuration, by bringing the plurality of input terminal portions 3882 closer to each other, the opening portions 351 of the wiring substrate 35 into which the input terminal portions 3882 are inserted come close to each other, and the opening portion 351 and the cutout portion 352 come close to each other. Therefore, since the region forming the opening portion 351 and the region forming the cutout portion 352 in the wiring substrate 35 can be reduced, the wiring substrate 35 can be miniaturized in the V axis direction.

Figure 11:
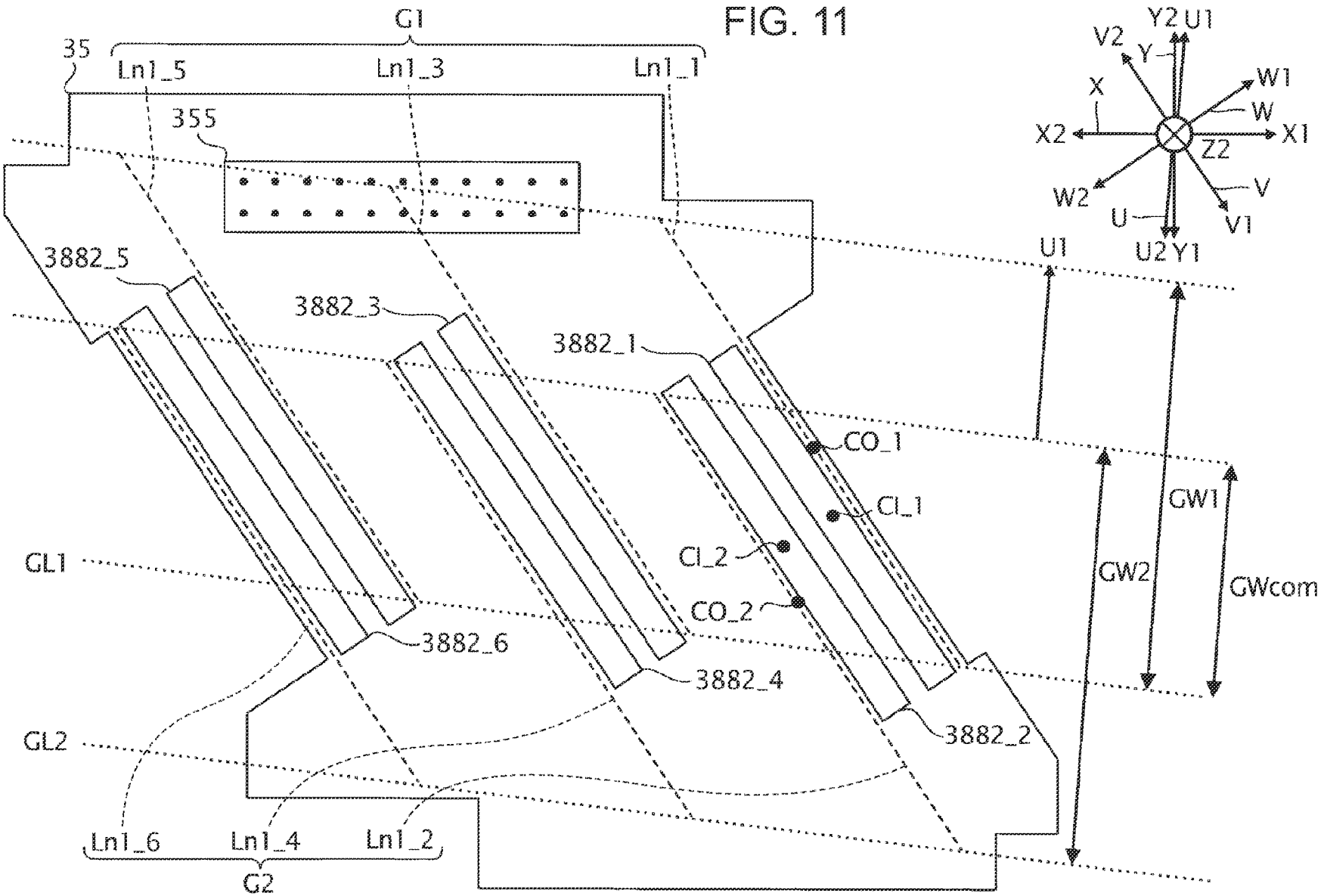
FIG. 11 is a diagram illustrating a positional relationship between the wiring substrate, the wiring member, and a nozzle row.

FIG. 11 is a diagram illustrating a positional relationship between the wiring substrate 35, the wiring member 388, and the nozzle row Ln. The figure illustrated in FIG. 11 is a view of the wiring substrate 35 viewed in the Z2 direction. As illustrated in FIG. 6, the nozzle plate 387 has a nozzle row Ln1 and a nozzle row Ln2, and in FIG. 11, only the nozzle row Ln1 is displayed for simplification of illustration. Furthermore, in FIG. 11, the display of the opening portion 351 and the terminal 353 is omitted in order to prevent the illustration from being complicated. Furthermore, in FIG. 11, the position of the nozzle row Ln1 is indicated by a broken line. Furthermore, in the following description and FIG. 11, the nozzle row Ln1 corresponding to the wiring member **388_*i* is referred to as a nozzle row Ln_i. 11** is an integer from 1 to 6.

As illustrated in FIG. 11, the liquid ejecting head 30 is provided with a plurality of nozzle rows Ln1 including a nozzle row Ln1_1 and a nozzle row Ln1_2, the wiring member 388_1 corresponding to the nozzle row Ln1_1, the wiring member 388_2 corresponding to the nozzle row Ln1_2, and the wiring substrate 35. The nozzle row Ln1_1 is an example of a "first nozzle row". The nozzle row Ln1_2 is an example of a "second nozzle row". The wiring member 388_1 includes an input terminal portion 3882_1 extending in the V2 direction. The wiring member 388_2 includes an input terminal portion 3882_2 extending in the V2 direction. The wiring substrate 35 is coupled to the input terminal portion 3882_1 and the input terminal portion 3882_2. The plurality of nozzle rows Ln are disposed in a zigzag pattern. The plurality of nozzle rows Ln1 includes a first nozzle row group G1 disposed along a virtual straight line GL1 intersecting in the V2 direction and a second nozzle row group G2 disposed along a virtual straight line GL2 parallel to the virtual straight line GL1. The extending direction of the virtual straight line GL1 and the virtual straight line GL2 is the same as the extending direction of the virtual straight line OLE The description that "the first nozzle row group G1 is disposed along the virtual straight line GL1" means that the end portion of each of the nozzle rows of the first nozzle row group G1 in the V1 direction is disposed along the virtual straight line GL1 in plan view. Similarly, the description that "the second nozzle row group G2 is disposed along the virtual straight line GL2" means that the end portion of each of the nozzle rows of the second nozzle row group G2 in the V1 direction is disposed along the virtual straight line GL2 in plan view. The description that "the first nozzle row group G1 is disposed along the virtual straight line GL1" may mean that the end portion of each of the nozzle rows of the first nozzle row group G1 in the V2 direction is disposed along a certain virtual straight line in plan view. The description that "the second nozzle row group G2 is disposed along the virtual straight line GL2" may mean that the end portion of each of the nozzle rows of the second nozzle row group G2 in the V2 direction is disposed along another virtual straight line in plan view. Alternatively, the description that "the first nozzle row group G1 is disposed along the virtual straight line GL1" may mean that the center of each of the nozzle rows of the first nozzle row group G1 in the V axis direction is disposed along a certain virtual straight line in plan view. The description that "the second nozzle row group G2 is disposed along the virtual straight line GL2" may mean that the center of each of the nozzle rows of the second nozzle row group G2 in the V axis direction is disposed along another virtual straight line in plan view.

In other words, the description that "the first nozzle row group G1 is disposed along the virtual straight line GL1" means that the end portion of each of the nozzle rows of the first nozzle row group G1 in the V1 direction is disposed side by side so as to overlap the virtual straight line GL1 in plan view. The description that "the first nozzle row group G1 is disposed along the virtual straight line GL1" may mean that the end portion of each of the nozzle rows of the first nozzle row group G1 in the V2 direction is disposed side by side so as to overlap the virtual straight line in plan view, or may mean that the center of each of the nozzle rows of the first nozzle row group G1 in the V axis direction is disposed side by side so as to overlap the virtual straight line in plan view. Similarly, the description that "the second nozzle row group G2 is disposed along the virtual straight line GL2" means that the end portion of each of the nozzle rows of the second nozzle row group G2 in the V1 direction is disposed side by side so as to overlap the virtual straight line GL2 in plan view. The description that "the second nozzle row group G2 is disposed along the virtual straight line GL2" may mean that the end portion of each of the nozzle rows of the second nozzle row group G2 in the V2 direction is disposed side by side so as to overlap the virtual straight line in plan view, or may mean that the center of each of the nozzle rows of the second nozzle row group G2 in the V axis direction is disposed side by side so as to overlap the virtual straight line in plan view.

The virtual straight line GL1 is an example of the "first virtual straight line". The virtual straight line GL2 is an example of the "second virtual straight line". Here, parallel is a concept that does not include coincidence. The virtual straight line GL1 and the virtual straight line GL2 are orthogonal to the Z axis direction and intersect in both the X axis direction and the Y axis direction. The virtual straight line GL1 is disposed in the U1 direction with respect to the virtual straight line GL2. As illustrated in FIG. 11, the nozzle rows Ln1_1, Ln1_3, and Ln1_5 are included in the first nozzle row group G1, and the nozzle rows Ln1_2, Ln1_4, and Ln1_6 are included in the second nozzle row group G2. The nozzle rows Ln1_1, Ln1_3, and Ln1_5 which are the plurality of nozzle rows correspond to each of the plurality of wiring members 388. Specifically, the nozzle row Ln1_1 corresponds to the wiring member 388_1. The nozzle row Ln1_3 corresponds to the wiring member 388_3. The nozzle row Ln1_5 corresponds to the wiring member 388_5. Similarly, the nozzle rows Ln1_2, Ln1_4, and Ln1_6 which are the plurality of nozzle rows correspond to each of the plurality of wiring members 388. Specifically, the nozzle row Ln1_2 corresponds to the wiring member 388_2. The nozzle row Ln1_4 corresponds to the wiring member 388_4. The nozzle row Ln1_6 corresponds to the wiring member 388_6. Here, the description that "the nozzle row Ln corresponds to the wiring member 388" means that the wiring member 388 is electrically coupled to a plurality of piezoelectric elements PZ that are driven to eject ink from the plurality of nozzles N constituting the nozzle row Ln. In addition, the wiring member 388 may correspond to the plurality of nozzle rows Ln, and the description that "the nozzle row Ln corresponds to the wiring member 388" includes, for example, the case where the nozzle row Ln1_1 and the nozzle row Ln2_1 correspond to the wiring member 388_1.

The first nozzle row group G1 is disposed in the U1 direction orthogonal to the straight line GL1 with respect to the second nozzle row group G2. The U1 direction is an example of the "fifth direction". The center of the input terminal portion 3882 is disposed so as to be displaced in the U2 direction with respect to the center of the nozzle row Ln corresponding to the center of the input terminal portion 3882 in plan view. The U2 direction is an example of the "sixth direction". The nozzle row Ln corresponding to the center of the input terminal portion 3882 is a nozzle row including a plurality of nozzles N on which ink is ejected by a plurality of piezoelectric elements PZ electrically coupled to the input terminal portion 3882. The center of the input terminal portion 3882 may correspond to the plurality of nozzle rows Ln, and the description that "nozzle row Ln corresponding to the center of the input terminal portion 3882" includes, for example, a case where the center of the input terminal portion 3882_1 corresponds to the nozzle row Ln1_1 and a case where the center of the input terminal portion 3882_1 corresponds to the nozzle row Ln2_1. Specifically, the center CU of the input terminal portion 3882_1 is disposed so as to be displaced in the U2 direction with respect to the center CL_1 of the nozzle row Ln1_1 corresponding to the center CI_1. The center CI_2 of the input terminal portion 3882_2 is disposed so as to be displaced in the U1 direction with respect to the center CL_2 of the nozzle row Ln1_2 corresponding to the center CI_2. Similarly, the center of the input terminal portion 3882_3 is disposed so as to be displaced in the U2 direction with respect to the center of the nozzle row Ln1_3 corresponding to the center of the input terminal portion 3882_3. The center of the input terminal portion 3882_4 is disposed so as to be displaced in the U1 direction with respect to the center of the nozzle row Ln1_4 corresponding to the center of the input terminal portion 3882_4. The center of the input terminal portion 3882_5 is disposed so as to be displaced in the U2 direction with respect to the center of the nozzle row Ln1_5 corresponding to the center of the input terminal portion 3882_5. The center of the input terminal portion 3882_6 is disposed so as to be displaced in the U1 direction with respect to the center of the nozzle row Ln1_6 corresponding to the center of the input terminal portion 3882_6. Hereinafter, the U1 direction and the U2 direction are collectively referred to as a U axis direction. The center of the nozzle row Ln is the center in the width from one end portion to the other end portion of the nozzle row Ln in the extending direction.

According to the first embodiment, even when the nozzle row Ln1 of the first nozzle row group G1 and the nozzle row Ln1 of the second nozzle row group G2 are disposed so as to be displaced in the U axis direction, the input terminal portion 3882 corresponding to the first nozzle row group G1 and the input terminal portion 3882 corresponding to the second nozzle row group G2 can be brought closer to each other. Therefore, the opening portions 351 of the wiring substrate 35 into which the input terminal portion 3882 is inserted come close to each other, and the opening portion 351 and the cutout portion 352 come close to each other. Therefore, since the region forming the opening portion 351 and the region forming the cutout portion 352 in the wiring substrate 35 can be reduced, the wiring substrate 35 can be miniaturized in the U axis direction.

In addition, the first nozzle row group G1 and the second nozzle row group G2 have a portion that overlaps each other when viewed in the direction where the virtual straight line GL1 extends. More specifically, as illustrated in FIG. 11, the width of the first nozzle row group G1 when viewed in the direction where the virtual straight line GL1 extends is the width GW1, and the width of the second nozzle row group G2 when viewed in the direction where the virtual straight line GL1 extends is the width GW2. A width GWcom illustrated in FIG. 11 is the width of the portion in which the first nozzle row group G1 and the second nozzle row group G2 overlap each other when viewed in the direction where the virtual straight line GL1 extends. Since there is a portion in which the first nozzle row group G1 and the second nozzle row group G2 overlap each other, the opening portions 351 of the wiring substrate 35 into which the input terminal portion 3882 is inserted come close to each other, and the opening portions 351 and the cutout portion 352 come close to each other, as compared with the aspect in which the first nozzle row group G1 and the second nozzle row group G2 do not overlap each other. Therefore, since the region forming the opening portion 351 and the region forming the cutout portion 352 in the wiring substrate 35 can be reduced, the wiring substrate 35 can be miniaturized.

In addition, the liquid ejecting head 30 is provided with the plurality of wiring members 388 including the wiring member 388_1 and the wiring member 388_2. The wiring substrate 35 includes the connector 355 at an end portion in the U1 direction, and a portion of the wiring member 388_3 included in the plurality of wiring members 388 overlaps the connector 355 in plan view. The wiring member 388_3 is an example of "at least one wiring member of the plurality of wiring members". Since the input terminal portion 3882_3 is shifted in the V1 direction, it is not necessary to form the opening portion 351_3 on the V2 direction side of the wiring substrate 35. Therefore, since the connector 355 can be disposed at a position overlapping a portion of the wiring member 388_3 of the wiring substrate 35 on the V2 direction side in plan view, the wiring substrate 35 can be miniaturized as compared with the aspect in which the wiring member 388_3 and the connector 355 do not overlap each other in plan view. In the present embodiment, although only one connector 355 is provided at the end portion of the wiring substrate 35 on the Y2 direction side, the number of connectors 355 is not limited to one. For example, the connector 355 may also be disposed at the end portion of the wiring substrate 35 on the Y1 direction side.

The V1 direction is a direction that intersects both the Y1 direction and the X1 direction. The Y1 direction is an example of a "medium transport direction". The X1 direction is an example of a "direction orthogonal to the transport direction". In other words, the input terminal portion 3882 and the output terminal portion 3881 extend in a direction inclined with respect to the X axis direction and the Y axis direction. By inclining with respect to the X axis direction and the Y axis direction, the liquid ejecting head 30 can be miniaturized in the Y axis direction as compared with the case where the input terminal portion 3882 and the output terminal portion 3881 extend in the Y axis direction.

In addition, the predetermined nozzle row Ln1 constituting the first nozzle row group G1 and the nozzle row Ln1 constituting the second nozzle row group G2 disposed foremost to the predetermined nozzle row Ln1 substantially all overlap when viewed in the Y1 direction. The description that substantially all overlap means that the width at which the above-described two nozzle rows Ln1 do not overlap is equal to or less than an interval between the nozzles N adjacent to each other in the V axis direction in the Y1 direction. In the example of FIG. 11, the nozzle row Ln1_1 and the nozzle row Ln1_2 disposed foremost to the nozzle row Ln1_1 substantially all overlap when viewed in the Y1 direction.

According to the first embodiment, when the color of the ink supplied to the nozzle N of the nozzle row Ln1 of the first nozzle row group G1 and the color of the ink supplied to the nozzle N of the nozzle row Ln1 of the second nozzle row group G2 are the same as each other and the nozzle N of the nozzle row Ln2 of the second nozzle row group G2 is located between the nozzles N adjacent to each other of the nozzle row Ln_1 of the first nozzle row group G1, the liquid ejecting head 30 can obtain twice the resolution of the nozzle row Ln1. When viewed in the Y1 direction, in an aspect in which the nozzle row Ln1 of the first nozzle row group G1 and the nozzle row Ln1 of the second nozzle row group G2 are separated from each other by a distance longer than the interval between the nozzles N adjacent to each other in the V axis direction in the Y1 direction, there is a portion in which twice the resolution of the nozzle row Ln1 cannot be obtained.

In addition, when the color of the ink supplied to the nozzle N of the nozzle row Ln1 of the first nozzle row group G1 and the color of the ink supplied to the nozzle N of the nozzle row Ln1 of the second nozzle row group G2 are different from each other, an unnecessary nozzle N can be eliminated in the liquid ejecting head 30.

In the first embodiment, each of the extending directions of the virtual straight line OL1, the virtual straight line OL2, the virtual straight line OL3, the virtual straight line OL4, the virtual straight line GL1, and the virtual straight line GL2 is a direction orthogonal to the Z axis direction and intersecting the X axis direction and the Y axis direction, and the extending direction may be the X axis direction.

2. Second Embodiment

In the first embodiment, as illustrated in FIG. 8, when viewed from the upper part of the wiring member 388, the right end of the input terminal portion 3882 and the right end of the output terminal portion 3881 overlap each other, and the present disclosure is not limited thereto. The second embodiment is different from the first embodiment in that the right end of the input terminal portion 3882 is located on the right side as compared with the right end of the output terminal portion 3881 when viewed from the upper part of the wiring member 388. Hereinafter, the second embodiment will be described.

Figure 12:
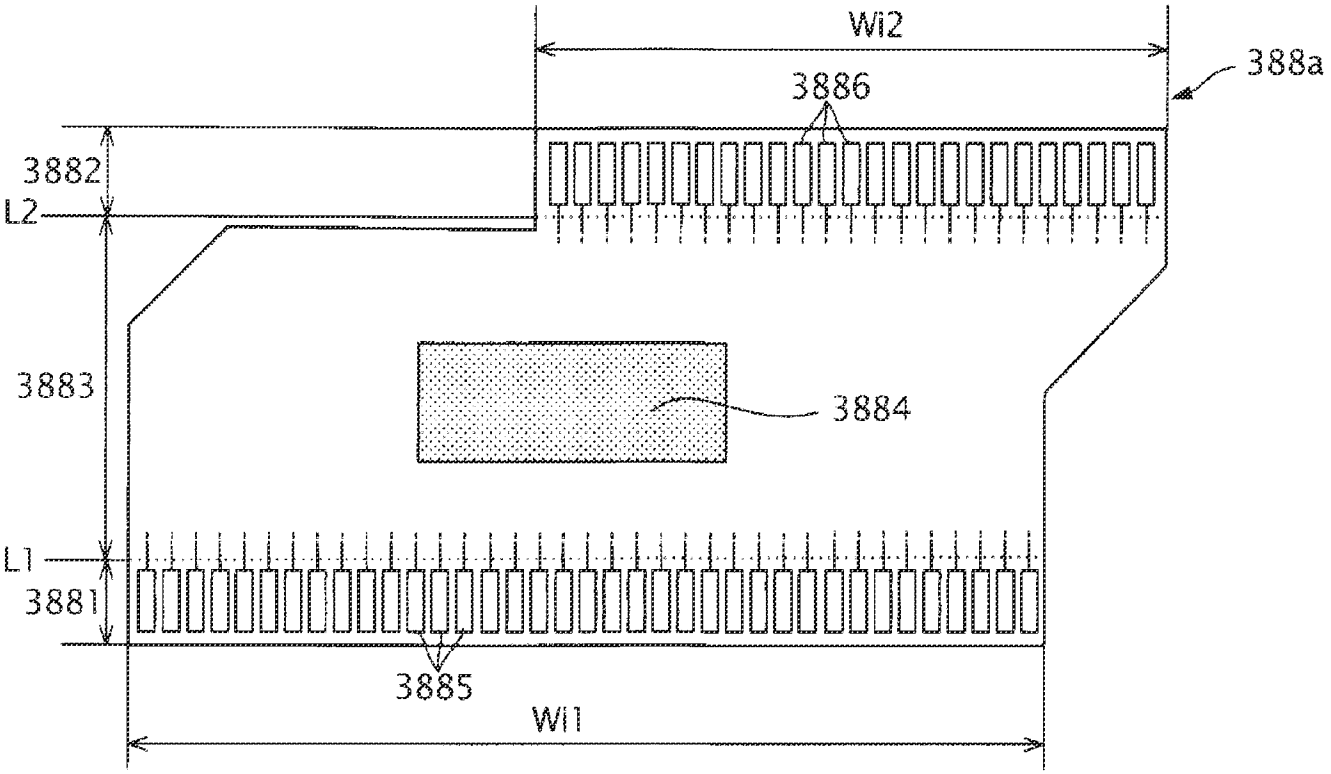
FIG. 12 is a plan view of a wiring member according to a second embodiment.

FIG. 12 is a plan view of the wiring member 388*a* according to the second embodiment. When viewed from the upper part of the wiring member 388*a*, the right end of the input terminal portion 3882 is located on the right side as compared with the right end of the output terminal portion 3881.

According to the second embodiment, by using the wiring member 388*a*, the wiring substrate 35 can be miniaturized in the V axis direction similar to the first embodiment.

3. Third Embodiment

In the first embodiment, the input terminal portion 3882, the output terminal portion 3881, and the nozzle row Ln extend in the V axis direction, and the third embodiment is different from the first embodiment in that a wiring member 388 having the same shape as the wiring member 388*a* is used and the input terminal portion 3882, the output terminal portion 3881, and the nozzle row Ln extend in the Y axis direction. Hereinafter, the third embodiment will be described.

Figure 13:
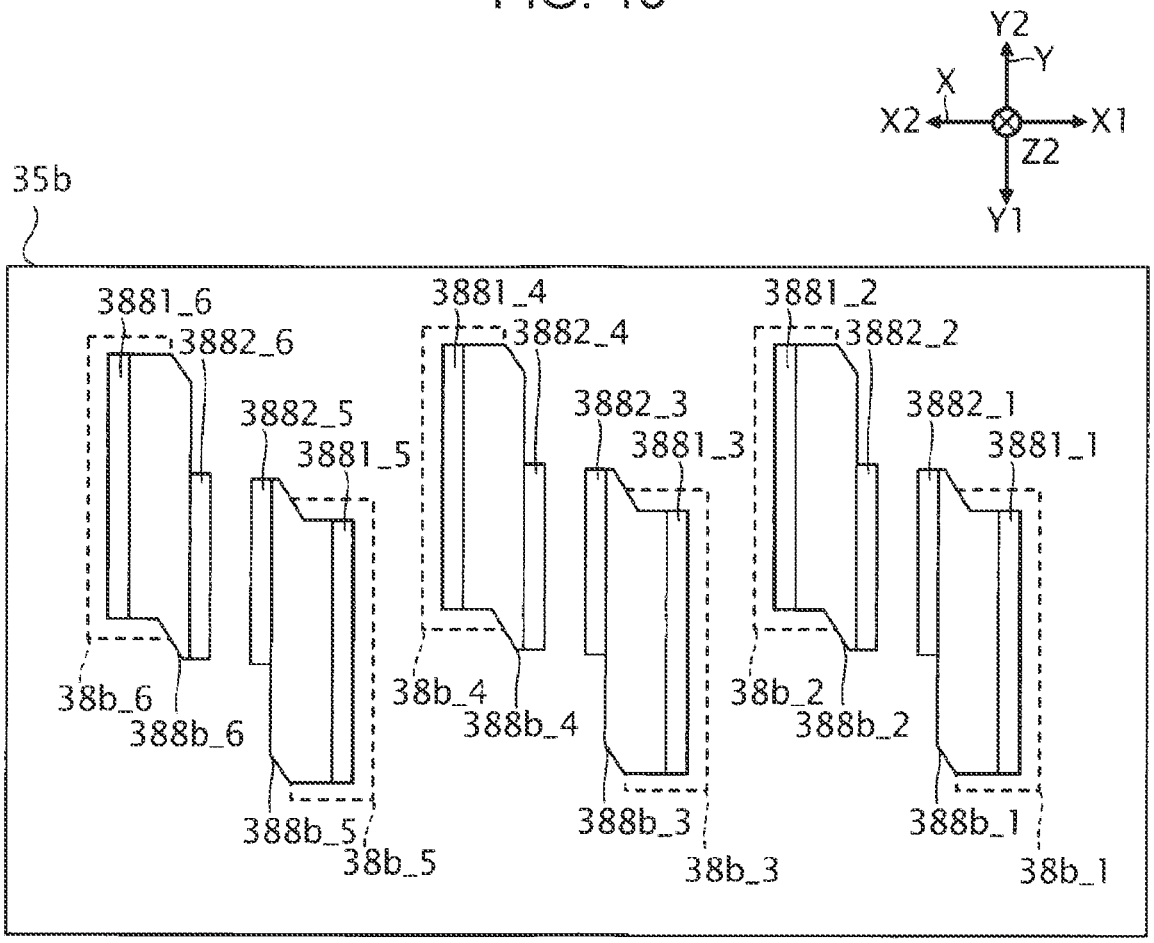
FIG. 13 is a diagram illustrating a positional relationship between a wiring substrate and a wiring member according to a third embodiment.

FIG. 13 is a diagram illustrating a positional relationship between a wiring substrate 35*b* and a wiring member 388*b* according to the third embodiment. The figure illustrated in FIG. 13 is a view of the wiring substrate 35*b* viewed in the Z2 direction. However, in order to prevent the illustration from being complicated, the display of the opening portion 351, the terminal 353, and the connector 355 is omitted. Furthermore, originally, the wiring member 388*b* is bent, and in FIG. 13, the wiring member 388*b* is not bent and the input terminal portion 3882 and the output terminal portion 3881 of the wiring member 388*b* are separated from each other and displayed in order to prevent the illustration from being complicated. Furthermore, in FIG. 13, a portion of the head unit 38*b* according to the third embodiment excluding the wiring member 388*b* is illustrated by a broken line.

The wiring member 388*b* has the same shape as that of the wiring member 388*a*. However, the input terminal portion 3882 of the wiring member 388*b* and the output terminal portion 3881 of the wiring member 388*b* extend in the Y axis direction.

In the third embodiment, a portion of the input terminal portion 3882_1 is located in the Y2 direction from the output terminal portion 3881_1, and a portion of the input terminal portion 3882_2 is located in the Y1 direction from the output terminal portion 3881_2. The amount of deviation of the head unit 38*b* in the Y axis direction is larger than the amount of deviation of the head unit 38 in the V axis direction of the first embodiment. According to the third embodiment, even when the head units 38*b* are separated from each other, the distance between the input terminal portions 3882 can be shortened. Therefore, the opening portions 351 of the wiring substrate 35 into which the input terminal portion 3882 is inserted come close to each other. Therefore, since the region forming the opening portion 351 in the wiring substrate 35 can be reduced, the wiring substrate 35 can be miniaturized while ensuring the degree of freedom in the arrangement of the head unit 38*b* and the arrangement of the nozzle N.

4. Fourth Embodiment

In the first embodiment, the plurality of head units 38 are disposed in a zigzag pattern, and the present disclosure is not limited thereto. The second embodiment is different from the first embodiment in that each of the plurality of head units 38 is disposed along a certain straight line. Hereinafter, the fourth embodiment will be described.

Figure 14:
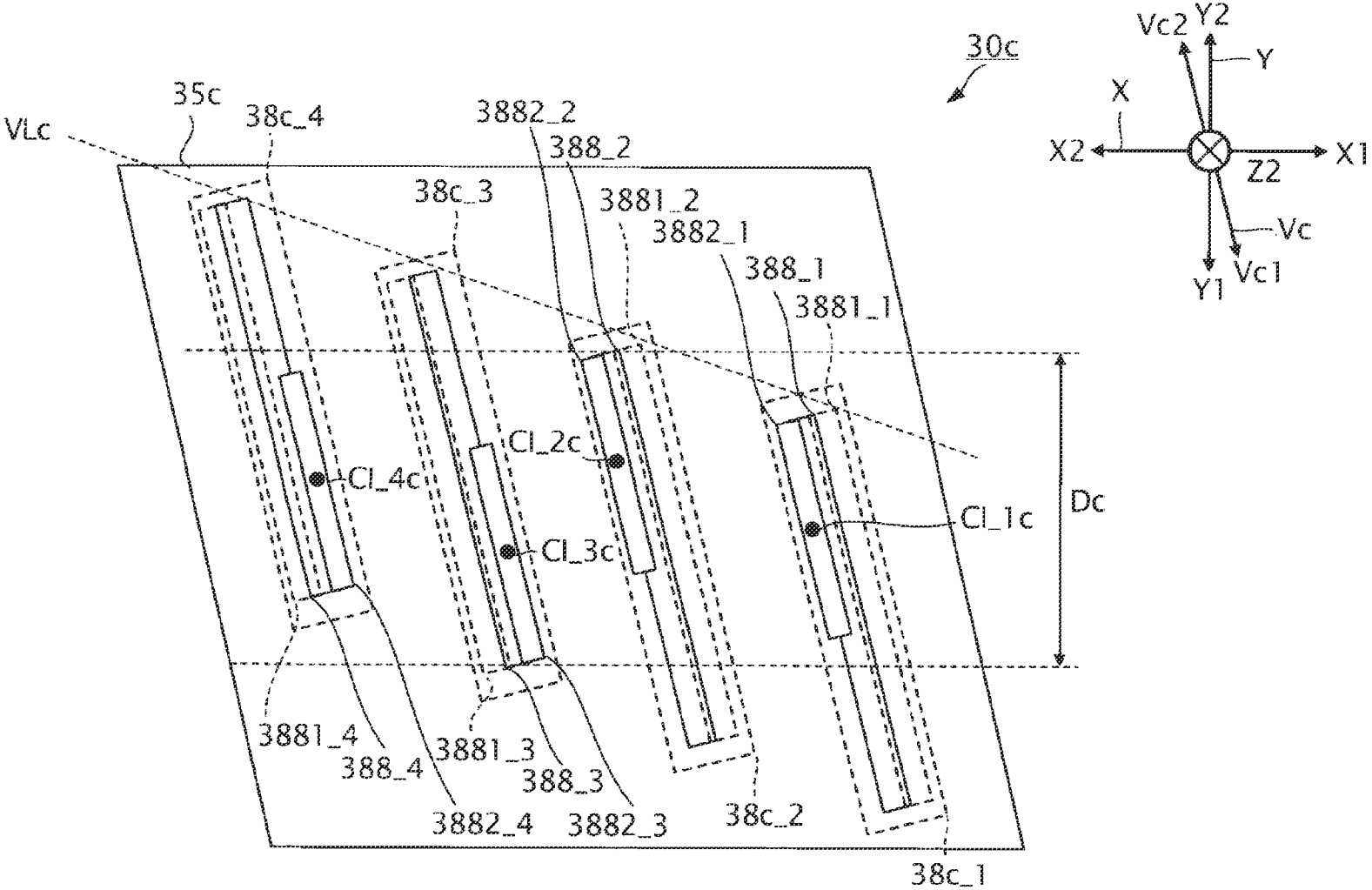
FIG. 14 is a diagram illustrating a positional relationship between a wiring substrate and a wiring member according to a fourth embodiment.

FIG. 14 is a diagram illustrating a positional relationship between the wiring substrate 35*c* and a wiring member 388*c* according to the fourth embodiment. The figure illustrated in FIG. 14 is a view of the wiring substrate 35*c* viewed in the Z2 direction. However, in order to prevent the illustration from being complicated, the display of the opening portion 351, the terminal 353, and the connector 355 is omitted in FIG. 14. Furthermore, in FIG. 14, the output terminal portion 3881 of the wiring member 388*c* and the portion of the head unit 38*c* according to the fourth embodiment excluding the wiring member 388*c* are illustrated by broken lines.

The liquid ejecting head 30*c* according to the fourth embodiment includes wiring members 388_1, 388_2, 388_3, and 388_4. In the fourth embodiment, the input terminal portion 3882 and the output terminal portion 3881 of the wiring member 388 extend in the Vc2 direction. In the following description, the Vc2 direction and the Vc1 direction opposite to the Vc2 direction may be collectively referred to as a Vc axis direction. The wiring members 388_1, 388_2, 388_3, and 388_4 are disposed along a virtual straight line VLc. The description that "the wiring member 388 is disposed along the virtual straight line VLc" means that the end portion of the wiring member 388 in the V1 direction is disposed along the virtual straight line VLc in plan view. The description that "the wiring member 388 is disposed along the virtual straight line" may mean that the end portion of the wiring member 388 in the V2 direction is disposed along the virtual straight line in plan view, or may mean that the center of the wiring member 388 in the V axis direction is disposed along the virtual straight line in plan view. The center of the wiring member 388 in the V axis direction is the center of the width of the wiring member 388, in other words, the center of the wiring member 388 in the longitudinal direction.

In other words, the description that "the wiring member 388 is disposed along the virtual straight line" means that the end portion of the wiring member 388 in the V1 direction is disposed side by side so as to overlap the virtual straight line in plan view. The description that "the wiring member 388 is disposed along the virtual straight line" may mean that the end portion of the wiring member 388 in the V2 direction is disposed side by side so as to overlap the virtual straight line in plan view, or may mean that the end portion of the wiring member 388 in the V axis direction is disposed side by side so as to overlap the virtual straight line in plan view.

As illustrated in FIG. 14, the liquid ejecting head 30*c* is provided with the plurality of wiring members 388 including the wiring member 388_1 and the wiring member 388_4. The wiring member 388_4 is an example of the "second wiring member". Each of the plurality of wiring members 388 includes the output terminal portion 3881 extending in the Vc2 direction and the input terminal portion 3882 extending in the Vc2 direction. The wiring substrate 35*c* is coupled to each of the input terminal portions 3882 of the plurality of wiring members 388. As illustrated in FIG. 14, the center CU of the input terminal portion 3882_1 is located foremost to the end portion of the wiring substrate 35*c* in the X1 direction of the centers CI_1c, CL_2c, CL_3c, and CI_4c of the input terminal portions 3882 of each of the plurality of wiring members 388. The X1 direction is an example of a "third direction orthogonal to the transport direction of the medium". The center of the input terminal portion 3882_4 is located foremost to the end portion of the wiring substrate 35 in the X2 direction of the centers of the input terminal portions 3882 of each of the plurality of wiring members 388. The X2 direction is an example of the "fourth direction". The input terminal portion 3882_1 and the input terminal portion 3882_4 have a portion that overlaps each other when viewed in the X1 direction.

Figure 15:
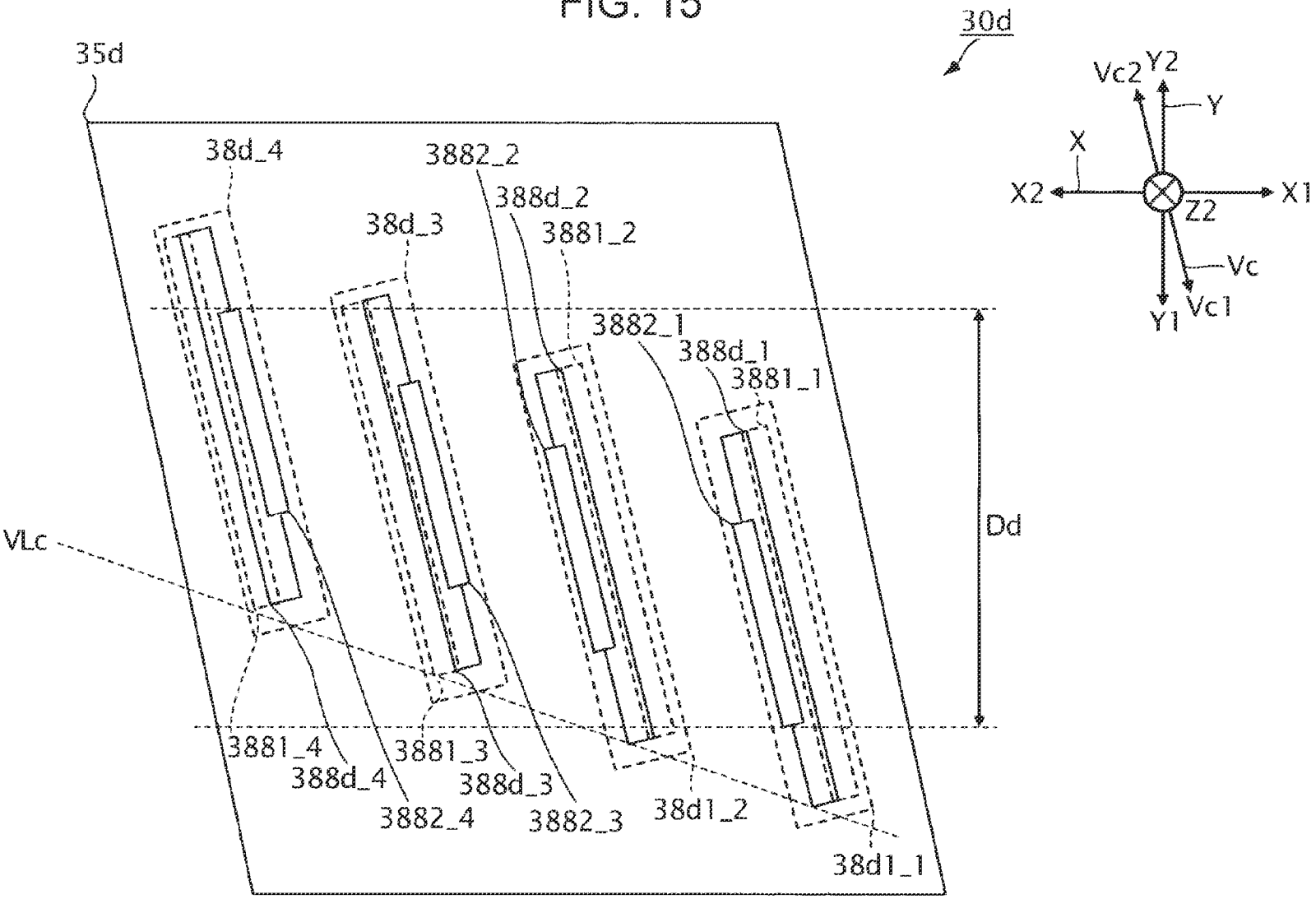
FIG. 15 is a diagram illustrating a liquid ejecting head of a comparative example corresponding to the fourth embodiment.

FIG. 15 is a diagram illustrating a liquid ejecting head 30*d* of a comparative example corresponding to the fourth embodiment. The figure illustrated in FIG. 15 is a view of the wiring substrate 35*d* in the comparative example viewed in the Z2 direction. However, in order to prevent the illustration from being complicated, the display of the opening portion 351, the terminal 353, and the connector 355 is omitted in FIG. 15. Furthermore, in FIG. 15, the output terminal portion 3881 of the wiring member 388*d* according to the comparative example and the portion of the head unit 38*d* in the fourth embodiment excluding the wiring member 388*d* are illustrated by broken lines. In plan view, the center of the input terminal portion 3882 included in the wiring member 388*d* coincides with the center of the output terminal portion 3881 included in the wiring member 388*d*. Therefore, in the arrangement direction of the plurality of head units 38*d* (extending direction of the virtual straight line VLc), the input terminal portion 3882 of the wiring member 388*d* corresponding to the pair of head units 38*d*_1 and the head unit 38*d*_2 farthest apart is the input terminal portion 3882 disposed farthest in the Y axis direction. That is, the distance Dd from the end portion located foremost in the Y1 direction to the end portion located foremost in the Y2 direction of each of the end portions of the input terminal portions 3882_1 to 3882_4 corresponds to the distance between the end portions of the input terminal portions 3882 of the wiring member 388*d* corresponding to the pair of head units 38*d*_1 and the head units 38*d*_4 farthest apart in the Y axis direction.

In the fourth embodiment, the input terminal portion 3882_1 is shifted in the Vc2 direction with respect to the center of the output terminal portion 3881_1, and the input terminal portion 3882_4 is shifted in the Vc1 direction with respect to the center of the output terminal portion 3881_4, so that the pair of input terminal portions 3882_1 and the input terminal portion 3882_4 farthest apart in the arrangement direction of the plurality of head units 38*c* (extending direction of the virtual straight line VLc) are brought close to each other in the Y axis direction. Therefore, among each of the end portions of the input terminal portions 3882_1 to 3882_4, since the distance Dc from the end portion located foremost in the Y1 direction to the end portion located foremost in the Y2 direction can be made smaller than the distance Dd of the comparative example, the wiring substrate 35*c* can be miniaturized.

In addition, in the comparative example, the input terminal portion 3882_1 and the input terminal portion 3882_4 do not have a portion that overlaps each other when viewed in the X1 direction.

In the fourth embodiment, since the input terminal portion 3882_1 and the input terminal portion 3882_4 have a portion that overlaps each other when viewed in the X1 direction, the wiring substrate 35*c* can be miniaturized as compared with the case where the input terminal portion 3882_1 and the input terminal portion 3882_4 do not have a portion that overlaps each other when viewed in the X1 direction.

5. Fifth Embodiment

In the first embodiment, the width of the input terminal portion 3882 is smaller than the width of the output terminal portion 3881, and the present disclosure is not limited thereto. The fifth embodiment is different from the first embodiment in that the width of the input terminal portion 3882 coincides with the width of the output terminal portion 3881. Hereinafter, the fifth embodiment will be described.

Figure 16:
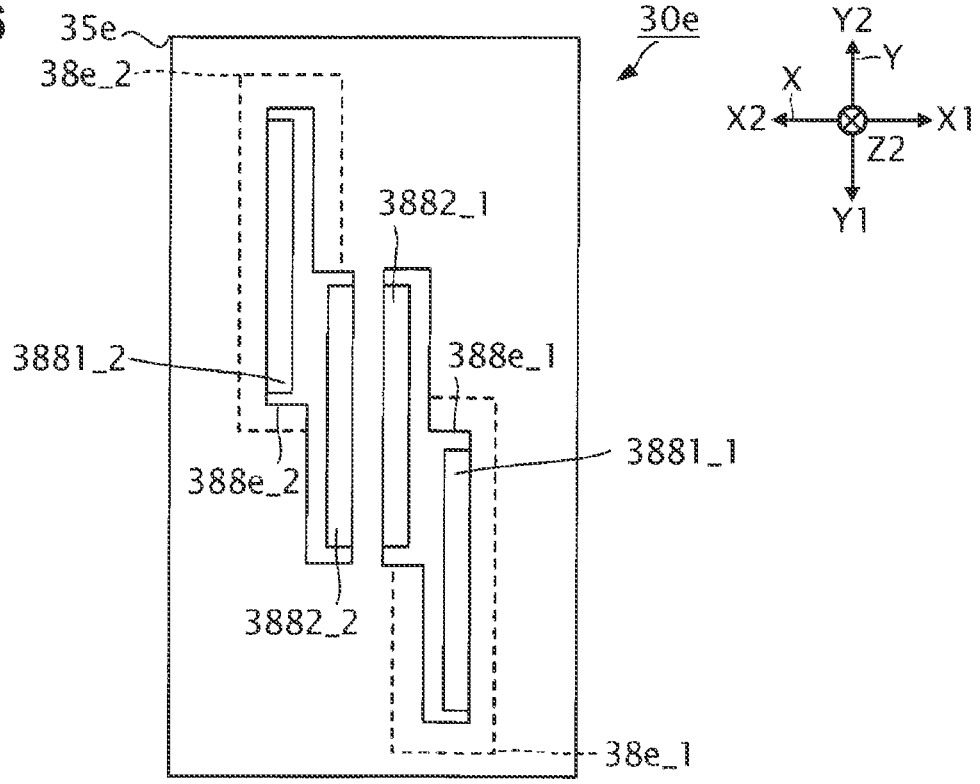
FIG. 16 is a diagram illustrating a positional relationship between a wiring substrate and a wiring member according to a fifth embodiment.

FIG. 16 is a diagram illustrating a positional relationship between the wiring substrate 35*e* and the wiring member 388*e* according to the fifth embodiment. The figure illustrated in FIG. 16 is a view of the wiring substrate 35*e* viewed in the Z2 direction. However, in order to prevent the illustration from being complicated, the display of the opening portion 351, the terminal 353, and the connector 355 is omitted. Furthermore, originally, the wiring member 388*e* is bent, and in FIG. 16, the wiring member 388*e* is not bent and the input terminal portion 3882 and the output terminal portion 3881 of the wiring member 388*e* are separated from each other and displayed in order to prevent the illustration from being complicated. Furthermore, in FIG. 16, a portion of the head unit 38*e* according to the fifth embodiment excluding the wiring member 388*e* is illustrated by a broken line.

A liquid ejecting head 30*e* according to the fifth embodiment includes wiring members 388*e*_1 and 388*e*_2. The input terminal portion 3882 and the output terminal portion 3881 of the wiring member 388*e*, and the nozzle row Ln of the head unit 38*e* extend in the Y axis direction. In the wiring member 388*e*, the width of the input terminal portion 3882 and the width of the output terminal portion 3881 are the same as each other. In the fifth embodiment, when viewed in the X1 direction, all of the input terminal portions 3882_1 overlap the input terminal portion 3882_2, so that the center of the input terminal portion 3882_1 is shifted in the Y2 direction with respect to the center of the output terminal portion 3881_1, and the center of the input terminal portion 3882_2 is shifted in the Y1 direction with respect to the center of the output terminal portion 3881_2. With such a configuration, the wiring substrate 35*e* can be miniaturized.

6. Sixth Embodiment

In the fifth embodiment, when viewed in the X1 direction, all of the input terminal portions 3882_1 overlap the input terminal portions 3882_2, and the present disclosure is not limited thereto. The sixth embodiment is different from the fifth embodiment in that a portion of the input terminal portion 3882_1 overlaps the input terminal portion 3882_2. Hereinafter, the sixth embodiment will be described.

Figure 17:
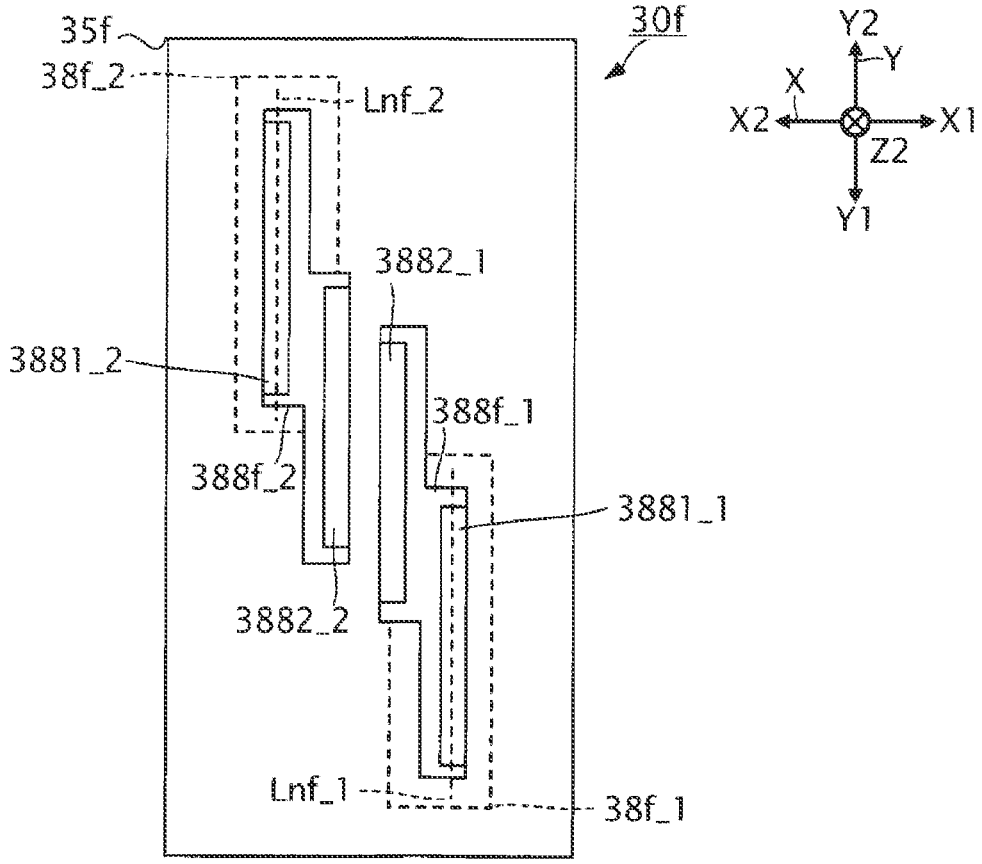
FIG. 17 is a diagram illustrating a positional relationship between a wiring substrate and a wiring member according to a sixth embodiment.

FIG. 17 is a diagram illustrating a positional relationship between the wiring substrate 35*f* and the wiring member 388*f* according to the sixth embodiment. The figure illustrated in FIG. 17 is a view of the wiring substrate 35*f* viewed in the Z2 direction. However, in order to prevent the illustration from being complicated, the display of the opening portion 351, the terminal 353, and the connector 355 is omitted. Furthermore, originally, the wiring member 388*f* is bent, and in FIG. 17, the wiring member 388*f* is not bent and the input terminal portion 3882 and the output terminal portion 3881 of the wiring member 388*f* are separated from each other and displayed in order to prevent the illustration from being complicated. Furthermore, in FIG. 17, the nozzle row Lnf according to the sixth embodiment and the portion of the head unit 38*f* according to the sixth embodiment excluding the wiring member 388*f* are illustrated by broken lines.

In the wiring member 388*f*, the width of the input terminal portion 3882 and the width of the output terminal portion 3881 are the same as each other. In the sixth embodiment, when viewed in the X1 direction, a portion of the input terminal portions 3882_1 overlap the input terminal portion 3882_2, so that the center of the input terminal portion 3882_1 is shifted in the Y2 direction with respect to the center of the output terminal portion 3881_1, and the center of the input terminal portion 3882_2 is shifted in the Y1 direction with respect to the center of the output terminal portion 3881_2. The nozzle row Lnf_1 provided in the head unit **38*f*_1 and the nozzle row Lnf 2 of the head unit 38*f*_1 extend in the Y2 direction. In the sixth embodiment, the nozzle row Lnf_1 is an example of the "first nozzle row". The nozzle row Lnf_2 is an example of a "second nozzle row". The wiring member 388*f*_1 is an example of the "first wiring member". The wiring member 388*f*_2** is an example of the "second wiring member". The Y2 direction is an example of the "first direction".

The liquid ejecting head **30*f* according to the sixth embodiment is provided with the nozzle row Lnf_1 extending in the Y2 direction and the nozzle row Lnf_2 extending in the Y2 direction. The wiring member 388*f*_1 corresponds to the nozzle row Lnf 1. The wiring member 388*f*_2 corresponds to the nozzle row Lnf_2. As illustrated in FIG. 17, the nozzle row Lnf_1 and the nozzle row Lnf_2 do not overlap each other when viewed in the X1 direction. According to the sixth embodiment, even when the nozzle rows Ln are separated from each other when viewed in the X1 direction, the distance between the input terminal portions 3882 can be shortened. Therefore, the opening portions 351 of the wiring substrate 35 into which the input terminal portion 3882 is inserted come close to each other. Therefore, since the region forming the opening portion 351 in the wiring substrate 35 can be reduced, the wiring substrate 35*f* can be miniaturized while ensuring the degree of freedom in the arrangement of the head unit 38** and the arrangement of the nozzle N.

7. Seventh Embodiment

The arrangement of each of the head units 38 according to the first embodiment is disposed along any of the two virtual straight lines, and the present disclosure is not limited thereto. The arrangement of the plurality of head units **38*g* according to the seventh embodiment is different from the fifth embodiment in that the plurality of head units 38*g*** are arranged along any of the four virtual straight lines. Hereinafter, the seventh embodiment will be described.

Figure 18:
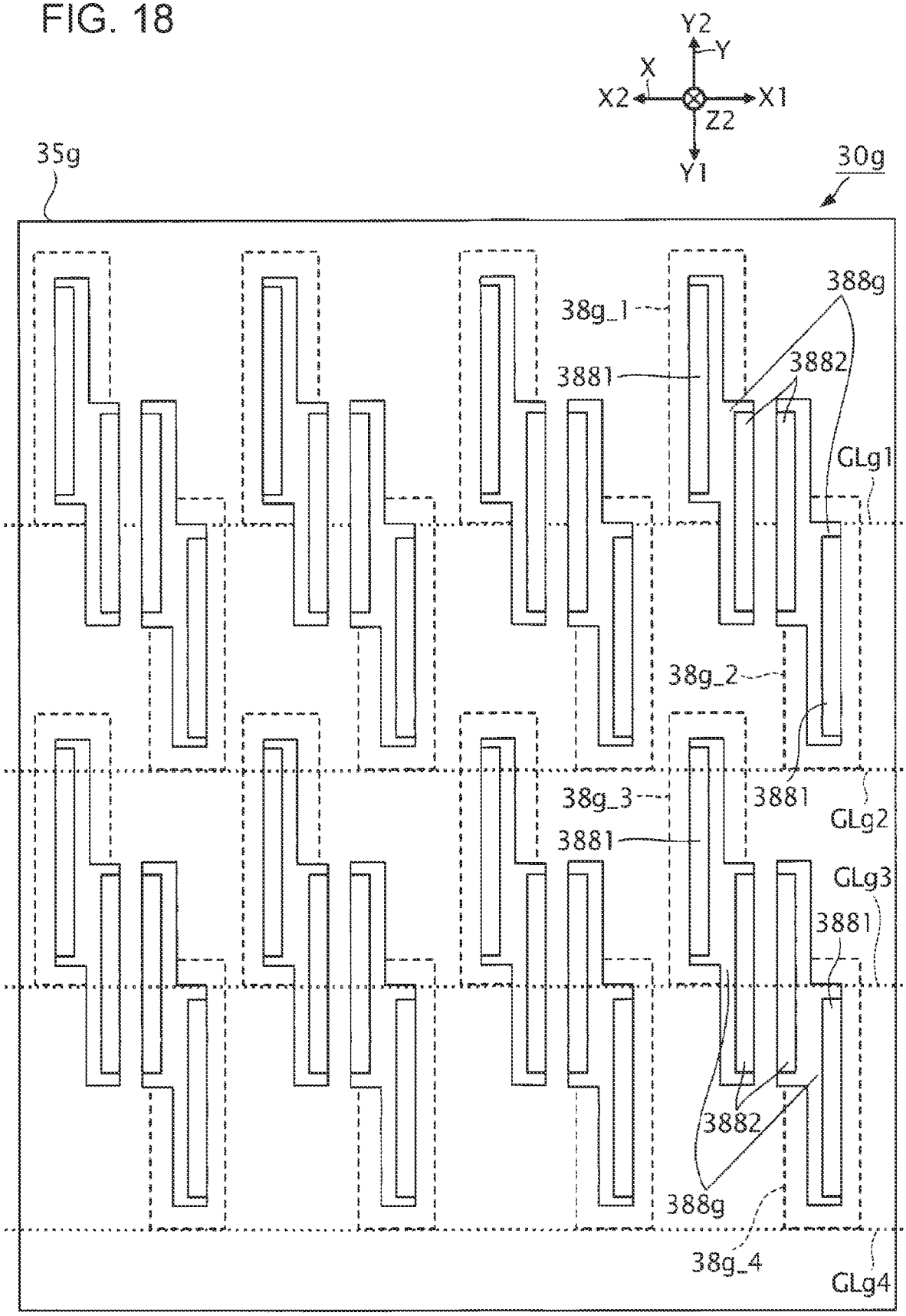
FIG. 18 is a diagram illustrating a positional relationship between a wiring substrate and a head unit according to a seventh embodiment.

FIG. 18 is a diagram illustrating a positional relationship between the wiring substrate **35*g* and the head unit 38*g* according to the seventh embodiment. The figure illustrated in FIG. 18 is a view of the wiring substrate 35*g* viewed in the Z2 direction. However, in order to prevent the illustration from being complicated, the display of the opening portion 351, the terminal 353, and the connector 355 is omitted. Furthermore, originally, the wiring member 388*g* is bent, and in FIG. 18, the wiring member 388*g* is not bent and the input terminal portion 3882 and the output terminal portion 3881 of the wiring member 388*g* are separated from each other and displayed in order to prevent the illustration from being complicated. Furthermore, in FIG. 18, the portion of the head unit 38*g* according to the seventh embodiment excluding the wiring member 388*g*** is illustrated by a broken line.

The liquid ejecting head **30*g* according to the seventh embodiment includes 16 head units 38*g*. The shape and function of the head unit 38*g* are the same as the shape and function of the head unit 38*e*. The 16 head units 38*g* are arranged along any of the virtual straight lines GLg1, GLg2, GLg3, and GLg4. Each of the virtual straight lines GLg1 to GLg4 is a straight line extending in the X axis direction, and the virtual straight line GLg1, the virtual straight line GLg2, the virtual straight line GLg3, and the virtual straight line GLg4 are disposed at intervals in the order from the Y2 direction to the Y1 direction. The description that "the head unit 38*g* is disposed along the virtual straight line" means that the end portion of the head unit 38*g* in the Y1 direction is disposed along the virtual straight line in plan view. The description that "the head unit 38*g* is disposed along the virtual straight line" may mean that the end portion of the head unit 38*g* in the Y2 direction is disposed along the virtual straight line in plan view, or may mean that the center of the head unit 38*g* in the Y axis direction is disposed along the virtual straight line in plan view. The center of the head unit 38*g* in the Y axis direction is the center of the width of the head unit 38*g*, in other words, the center of the head unit 38*g*** in the longitudinal direction.

In other words, the description that "the head unit **38*g* is disposed along the virtual straight line" means that the end portion of the head unit 38*g* in the Y1 direction is disposed side by side so as to overlap the virtual straight line in plan view. The description that "the head unit 38*g* is disposed along the virtual straight line" may mean that the end portion of the head unit 38*g* in the Y1 direction is disposed side by side so as to overlap the virtual straight line in plan view, or, may mean that the center of the head unit 38*g*** in the Y axis direction is disposed side by side so as to overlap the virtual straight line in plan view.

The 16 head units **38*g* includes four head units 38*g*_1 disposed along the virtual straight line GLg1, four head units 38*g*_2 disposed along the virtual straight line GLg2, four head units 38*g*_3 disposed along the virtual straight line GLg3, and four head units 38*g*_4 disposed along the virtual straight line GLg4. The center of the input terminal portion 3882 of the head unit 38*g*_1 disposed foremost in the Y2 direction of the 16 head units 38*g* is shifted in the Y1 direction with respect to the center of the output terminal portion 3881 of the head unit 38*g*_1. In addition, the center of the input terminal portion 3882 of the head unit 38*g*_4 disposed foremost in the Y1 direction of the 16 head units 38*g* is shifted in the Y2 direction with respect to the center of the output terminal portion 3881 of the head unit 38*g*_4. Therefore, the input terminal portion 3882 of the head unit 38*g*_1 and the input terminal portion 3882 of the head unit 38*g*_4 that are farthest apart in the Y axis direction are disposed so as to be gathered on the central side of the wiring substrate 35*g* in the Y axis direction. Therefore, the wiring substrate 35*g*** can be miniaturized in the Y axis direction.

8. Eighth Embodiment

The wiring substrate 35 according to the first embodiment extends substantially parallel to the XY plane, and the present disclosure is not limited thereto. The wiring substrate 35 according to an eighth embodiment is different from the first embodiment in that the wiring substrate 35 extends substantially parallel to the YZ plane. Hereinafter, the eighth embodiment will be described. For the elements whose actions and functions are the same as those in the first embodiment in each of the embodiments and the modification examples illustrated below, the reference numerals used in the first embodiment will be diverted and detailed description of each will be omitted as appropriate.

Figure 19:
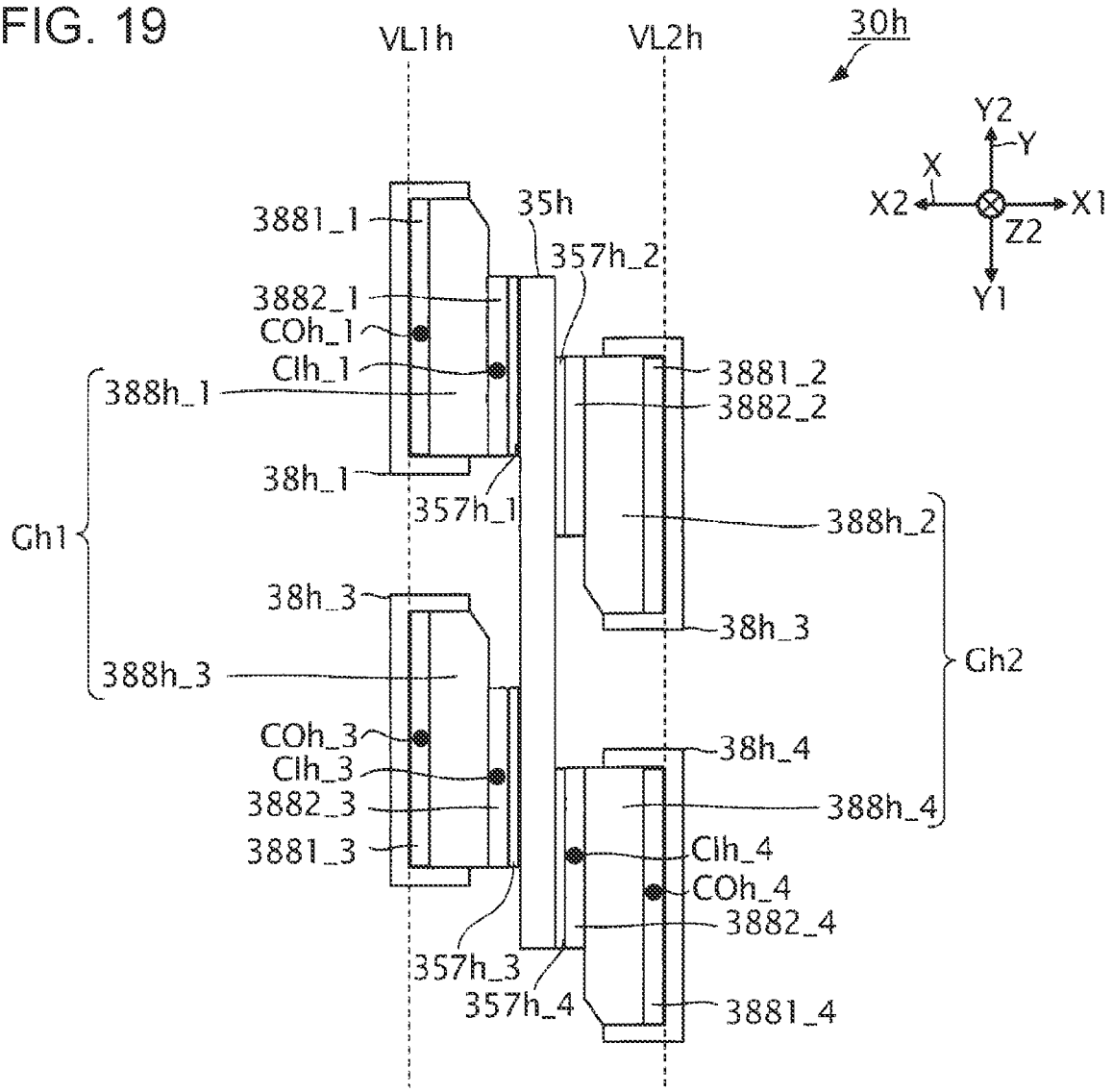
FIG. 19 is a diagram illustrating a positional relationship between a wiring substrate and a head unit according to an eighth embodiment.
Figure 20:
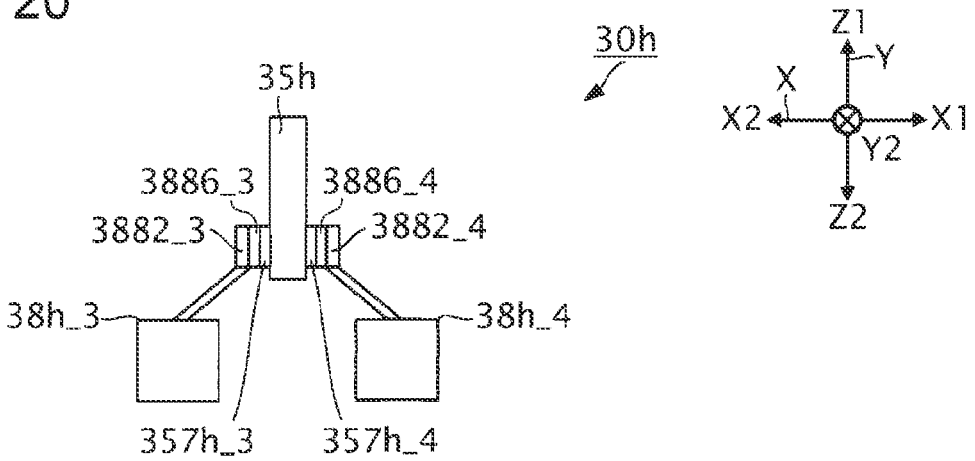
FIG. 20 is a diagram illustrating a positional relationship between the wiring substrate and the head unit according to the eighth embodiment.

FIGS. 19 and 20 are diagrams illustrating the positional relationship between a wiring substrate **35*h* and a head unit 38*h* according to the eighth embodiment. The figure illustrated in FIG. 19 is a view of the wiring substrate 35*h* and the head unit 38***h* viewed in the Z2 direction. The figure illustrated in FIG. 20 is a view of the wiring substrate 35*h* and the head unit 38*h* viewed in the Y2 direction.

A liquid ejecting head 30*h* according to the eighth embodiment includes head units 38*h*_1, 38*h*_2, 38*h*_3, and 38*h*_4. The head unit 38*h*_*i* includes a wiring member 388*h*j. i is an integer from 1 to 4. The wiring substrate 35*h* extends parallel to the YZ plane.

In the eighth embodiment, the wiring member 388*h*_1 included in the head unit 38*h*_1 is an example of the "first wiring member". In addition, the wiring member 388*h*_2 included in the head unit 38*h*_2 is an example of the "second wiring member". In addition, the wiring member 388*h*_3 included in the head unit 38*h*_3 is an example of the "third wiring member". In addition, the wiring member 388*h*_4 included in the head unit 38*h*_4 is an example of the "fourth wiring member". The output terminal portion 3881_3 of the wiring member 388*h*_3 is an example of the "third output terminal portion". The input terminal portion 3882_3 of the wiring member 388*h*_3 is an example of the "third input terminal portion". The output terminal portion 3881_4 of the wiring member 388*h*_4 is an example of the "fourth output terminal portion". The input terminal portion 3882_4 of the wiring member 388*h*_4 is an example of the "fourth input terminal portion".

The input terminal portion 3882 and the output terminal portion 3881 included in each of the wiring member 388*h*_1, the wiring member 388*h*_2, the wiring member 388*h*_3, and the wiring member 388*h*_4 extend in the Y2 direction. In the eighth embodiment, the Y2 direction is an example of the "first direction".

The wiring substrate 35*h* includes coupling portions 357*h*_1 and 357*h*_3 on the surface in the X2 direction. The coupling portion 357*h*_1 is coupled to the input terminal portion 3882_1 of the wiring member 388*h*_1. The coupling portion 357*h*_3 is coupled to the input terminal portion 3882_3 of the wiring member 388*h*_3. The wiring substrate 35*h* includes coupling portions 357*h*_2 and 357*h*_4 on the surface in the X1 direction. The coupling portion 357*h*_2 is coupled to the input terminal portion 3882_2 of the wiring member 388*h*_2. The coupling portion 357*h*_4 is coupled to the input terminal portion 3882_4 of the wiring member 388*h*_4.

The liquid ejecting head 30*h* is provided with a plurality of wiring members 388*h* including a wiring member 388*h*_1, a wiring member 388*h*_2, a wiring member 388*h*_3, and a wiring member 388*h*_4. The plurality of wiring members 388 includes a first wiring member group Gh1 disposed along a first virtual straight line VL1h in the Y2 direction and a second wiring member group Gh2 disposed along a second virtual straight line VL2h parallel to the first virtual straight line VL1h. The wiring member 388*h*_1 and the wiring member 388*h*_3 are included in the first wiring member group Gh1, and the wiring member 388*h*_2 and the wiring member 388*h*_4 are included in the second wiring member group Gh2. The wiring substrate 35*h* is coupled to the input terminal portions 3882_1, 3882_2, 3882_3, and 3882_4. The center COh_3 of the output terminal portion 3881_3 is located so as to be displaced in the Y2 direction with respect to the center COh_4 of the output terminal portion 3881_4 in plan view. The center CIh_3 of the input terminal portion 3882_3 is disposed so as to be displaced in the Y1 direction with respect to the center COh_3 of the output terminal portion 3881_3 in plan view. The Y1 direction is an example of the "second direction". The center CIh_4 of the input terminal portion 3882_4 is disposed so as to be displaced in the Y2 direction with respect to the center COh_4 of the output terminal portion 3881_4 in plan view. The wiring member 388*h*_1 is disposed foremost in the Y2 direction of the first wiring member group Gh1. The wiring member 388*h*_3 is disposed foremost in the Y1 direction of the first wiring member group Gh1. The wiring member 388*h*_2 is disposed foremost in the Y2 direction of the second wiring member group Gh2, and the wiring member 388*h*_4 is disposed foremost in the Y1 direction of the second wiring member group Gh2.

According to the eighth embodiment, since the input terminal portions 3882 of the wiring member 388*h*_1 and the wiring member 388*h*_4 which are farthest apart in the Y axis direction are shifted toward the center side, the wiring substrate 35*h* can be miniaturized in the Y axis direction.

In the above description, the positional relationship between the wiring member 388*h*_3 and the wiring member 388*h*_4 is described, and the positional relationship between the wiring member 388*h*_1 and the wiring member 388*h*_4 is the same as the positional relationship between the wiring member 388*h*_3 and the wiring member 388*h*_4. Specifically, the center COh_1 of the output terminal portion 3881_1 is located so as to be displaced in the Y2 direction with respect to the center COh_4 of the output terminal portion 3881_4 in plan view. The center CIh_1 of the input terminal portion 3882_1 is disposed so as to be displaced in the Y1 direction with respect to the center COh_1 of the output terminal portion 3881_1 in plan view. The center CIh_4 of the input terminal portion 3882_4 is disposed so as to be displaced in the Y2 direction with respect to the center COh_4 of the output terminal portion 3881_4 in plan view.

In the eighth embodiment, each of the first wiring member groups Gh1 and Gh2 includes two wiring members 388*h*, and three or more wiring members 388*h* may be included. Even when three or more wiring members 388 are included, the input terminal portions 3882 of the wiring members 388*h* farthest apart in the Y axis direction are shifted toward the center side, so that the wiring substrate 35*h* can be miniaturized in the Y axis direction.

9. Ninth Embodiment

The wiring substrate 35*h* according to the eighth embodiment is coupled to all of the input terminal portions 3882_1, 3882_2, 3882_3, and 3882_4, and the present disclosure is not limited thereto. The ninth embodiment is different from the eighth embodiment in that there are two wiring substrates 35*i*, the first wiring substrate 35*i*1 is coupled to the input terminal portions 3882_1 and 3882_2, and the second wiring substrate 35*i*2 is coupled to the input terminal portions 3882_3 and 3882_4. Hereinafter, the ninth embodiment will be described. For the elements whose actions and functions are the same as those in the first embodiment in each of the embodiments and the modification examples illustrated below, the reference numerals used in the first embodiment will be diverted and detailed description of each will be omitted as appropriate.

Figure 21:
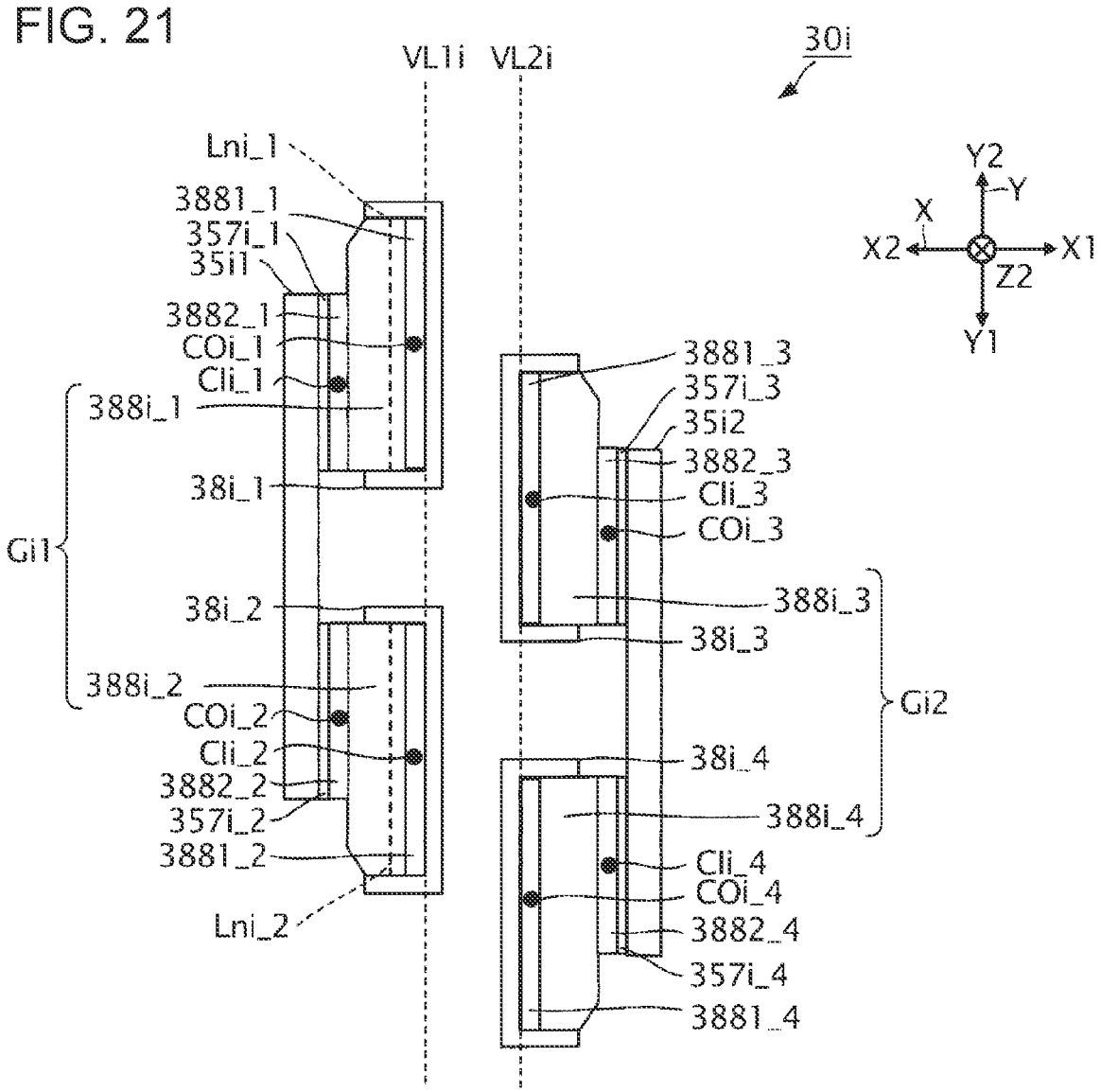
FIG. 21 is a diagram illustrating a positional relationship between a wiring substrate and a head unit according to a ninth embodiment.
Figure 22:
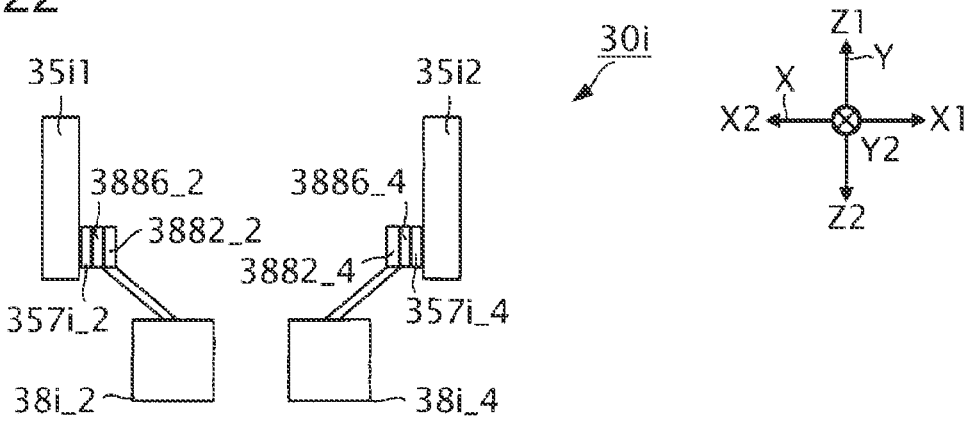
FIG. 22 is a diagram illustrating a positional relationship between the wiring substrate and the head unit according to the ninth embodiment.

FIGS. 21 and 22 are diagrams illustrating the positional relationship between the wiring substrate 35*i* and the head unit 38*i* according to the ninth embodiment. The figure illustrated in FIG. 21 is a view of the wiring substrate 35*i* and the head unit 38*i* viewed in the Z2 direction. The figure illustrated in FIG. 22 is a view of the wiring substrate 35*i* and the head unit 38*i* viewed in the Y2 direction.

The liquid ejecting head 30*i* according to the ninth embodiment includes head units 38*i*_1, 38*i*_2, 38*i*_3, and 38*i*_4. The head unit 38*i*_*x* includes a wiring member 388*i*_*x*. x is an integer from 1 to 4. The liquid ejecting head

30*i* includes a first wiring substrate 35*i*1 and a second wiring substrate 35*i*2. The first wiring substrate 35*i*1 and the second wiring substrate 35*i*2 extend parallel to the YZ plane.

In the ninth embodiment, the wiring member 388*i*_1 included in the head unit 38*i*_1 is an example of the "first wiring member". In addition, the wiring member 388*i*_2 included in the head unit 38*i*_2 is an example of the "second wiring member". In addition, the wiring member 388*i*_3 included in the head unit 38*i*_3 is an example of the "third wiring member". In addition, the wiring member 388*i*_4 included in the head unit 38*i*_4 is an example of the "fourth wiring member". The output terminal portion 3881_3 of the wiring member 388*i*_3 is an example of the "third output terminal portion". The input terminal portion 3882_3 of the wiring member 388*i*_3 is an example of the "third input terminal portion". The output terminal portion 3881_4 of the wiring member 388*i*_4 is an example of the "fourth output terminal portion". The input terminal portion 3882_4 of the wiring member 388*i*_4 is an example of the "fourth input terminal portion".

The input terminal portion 3882 and the output terminal portion 3881 included in each of the wiring member 388*h*_1, the wiring member 388*h*_2, the wiring member 388*h*_3, and the wiring member 388*h*_4 extend in the Y2 direction. In the eighth embodiment, the Y2 direction is an example of the "first direction".

The first wiring substrate 35*i*1 includes coupling portions 357*i*_1 and 357*i*_2 on the surface in the X1 direction. The coupling portion 357*i*_1 is coupled to the input terminal portion 3882_1 of the wiring member 388*i*_1. The coupling portion 357*i*_2 is coupled to the input terminal portion 3882_2 of the wiring member 388*i*_2. The second wiring substrate 35*i*2 includes coupling portions 357*i*_3 and 357*i*_4 on the surface in the X2 direction. The coupling portion 357*i*_3 is coupled to the input terminal portion 3882_3 of the wiring member 388*i*_3. The coupling portion 357*i*_4 is coupled to the input terminal portion 3882_4 of the wiring member 388*i*_4.

In the ninth embodiment, the nozzle row Lni_1 provided in the head unit 38*i*_1 and the nozzle row Lni_2 provided in the head unit 38*i*_2 are aligned linearly in the Y2 direction. According to the ninth embodiment, the wiring substrate 35*i* can be miniaturized in the Y axis direction by bringing each of the input terminal portions 3882 of the head unit 38*i*_1 and the 38*i*_2 closer to each other.

In addition, the liquid ejecting head 30*i* is provided with a plurality of wiring members 388*i* including a wiring member 388*i*_1, a wiring member 388*i*_2, a wiring member 388*i*_3, and a wiring member 388*i*_4. The plurality of wiring members 388*i* includes a first wiring member group Gil disposed along a first virtual straight line VL1i in the Y2 direction and a second wiring member group Gi2 disposed along a second virtual straight line VL2i parallel to the first virtual straight line VL1i. The wiring member 388*i*_1 and the wiring member 388*i*_2 are included in the first wiring member group Gil, and the wiring member 388*i*_3 and the wiring member 388*i*_4 are included in the second wiring member group Gi2. The first wiring substrate 35*i*1 is coupled to the input terminal portions 3882_1 and 3882_2. The second wiring substrate 35*i*2 is coupled to the input terminal portion 3882_3 and 3882_4. The center COi_3 of the output terminal portion 3881_3 is located so as to be displaced in the Y2 direction with respect to the center COi_4 of the output terminal portion 3881_4 in plan view. The center CIi_3 of the input terminal portion 3882_3 is disposed so as to be displaced in the Y1 direction with respect to the center COi_3 of the output terminal portion 3881_3 in plan view. The center CIi_4 of the input terminal portion 3882_4 is disposed so as to be displaced in the Y2 direction with respect to the center COi_4 of the output terminal portion 3881_4 in plan view. The wiring member 388*i*_1 is disposed foremost in the Y2 direction of the first wiring member group Gil. The wiring member 388*i*_2 is disposed foremost in the Y1 direction of the first wiring member group Gil. The wiring member 388*i*_3 is disposed foremost in the Y2 direction of the second wiring member group Gi2. The wiring member 388*i*_4 is disposed foremost in the Y1 direction of the second wiring member group Gi2.

According to the ninth embodiment, since the input terminal portions 3882 of the wiring member 388*i*_1 and the wiring member 388*i*_2 which are farthest apart in the Y axis direction are shifted toward the center side, the wiring substrate 35*i* can be miniaturized in the Y axis direction.

In the above description, the positional relationship between the wiring member 388*i*_3 and the wiring member 388*i*_4 is described, and the positional relationship between the wiring member 388*i*_1 and the wiring member 388*i*_2 is the same as the positional relationship between the wiring member 388*i*_3 and the wiring member 388*i*_4. Specifically, the center COi_1 of the output terminal portion 3881_1 is located so as to be displaced in the Y2 direction with respect to the center COi_2 of the output terminal portion 3881_2 in plan view. The center CIi_1 of the input terminal portion 3882_1 is disposed so as to be displaced in the Y1 direction with respect to the center COi_1 of the output terminal portion 3881_1 in plan view. The center CIi_2 of the input terminal portion 3882_2 is disposed so as to be displaced in the Y2 direction with respect to the center COi_2 of the output terminal portion 3881_2 in plan view.

In the ninth embodiment, each of the first wiring member groups Gil and Gi2 includes two wiring members 388*i*, and may include three or more wiring members 388*i*. Even when three or more wiring members 388*i* are included, since the input terminal portions 3882 of the wiring members 388*i* farthest apart in the Y axis direction are shifted toward the center side, the wiring substrate 35*i* can be miniaturized in the Y axis direction.

10. Tenth Embodiment

The first wiring substrate 35*i*1 according to the ninth embodiment is coupled to the input terminal portions 3882_1 and 3882_2 on the plane in the X1 direction, the second wiring substrate 35*i*2 is coupled to the input terminal portions 3882_3 and 3882_4 on the plane in the X2 direction, and the present disclosure is not limited thereto. The tenth embodiment is different from the ninth embodiment in that a first wiring substrate 35*j*1 is coupled to the input terminal portion 3882_1 on the plane in the X2 direction, and the second wiring substrate 35*j*2 is coupled to the input terminal portion 3882_4 on the plane in the X1 direction. Hereinafter, the tenth embodiment will be described.

Figure 23:
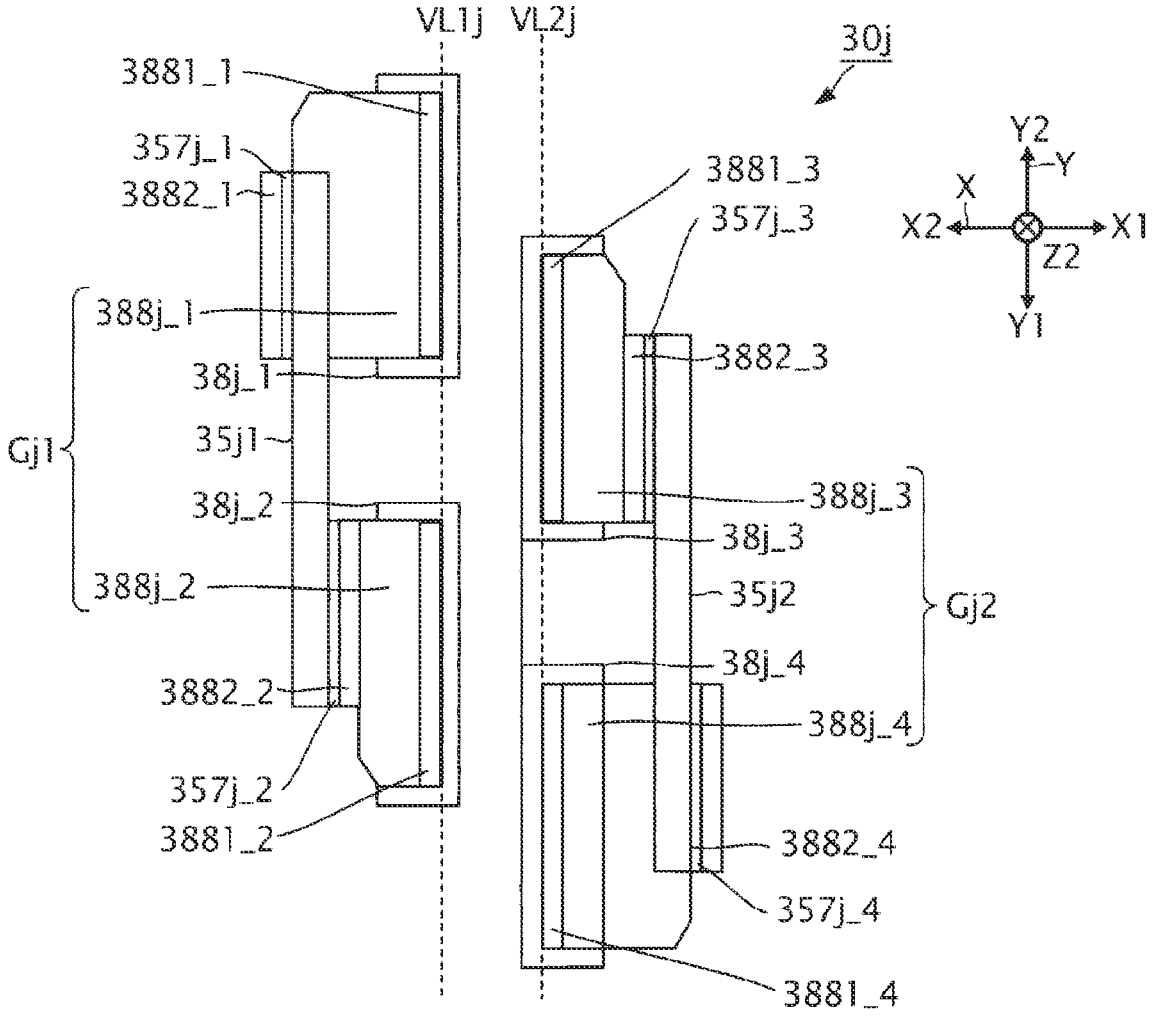
FIG. 23 is a diagram illustrating a positional relationship between a wiring substrate and a head unit according to a tenth embodiment.
Figure 24:
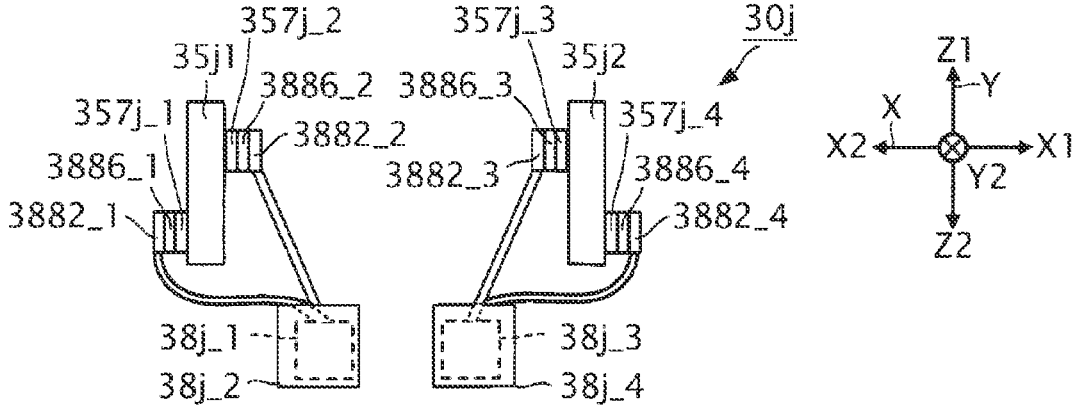
FIG. 24 is a diagram illustrating a positional relationship between the wiring substrate and the head unit according to the tenth embodiment.

FIGS. 23 and 24 are diagrams illustrating the positional relationship between the wiring substrate 35*j* and a head unit 38*j* according to the tenth embodiment. The figure illustrated in FIG. 23 is a view of the wiring substrate 35*j* and the head unit 38*j* viewed in the Z2 direction. The figure illustrated in FIG. 24 is a view of the wiring substrate 35*j* and the head unit 38*j* viewed in the Y2 direction. Furthermore, in the figure illustrated in FIG. 24, the head units 38*j*_1 and 38*j*_3 are indicated by broken lines for easy understanding. Furthermore, although the size of the head unit 38*j* is the same when each of the head units 38*j* is viewed in the Y2 direction, the head units 38j_1 and 38j_3 are displayed smaller than the head units 38j_2 and 38j_4 for easy understanding.

The liquid ejecting head 30j according to the tenth embodiment includes head units 38j_1, 38j_2, 38j_3, and 38j_4. The head unit 38j_x includes a wiring member 388j_x. x is an integer from 1 to 4. The liquid ejecting head 30j includes a first wiring substrate 35j1 and a second wiring substrate 35j2. The first wiring substrate 35j1 and the second wiring substrate 35j2 extend parallel to the YZ plane.

In the tenth embodiment, the wiring member 3880 included in the head unit 380 is an example of the "first wiring member". In addition, the wiring member 388j_2 included in the head unit 38j_2 is an example of the "second wiring member". In addition, the wiring member 388j_3 included in the head unit 38j_3 is an example of the "third wiring member". In addition, the wiring member 388j_4 included in the head unit 38j_4 is an example of the "fourth wiring member". The wiring members 388j_1, 388j_2, 388j_3, and 388j_4 have the same shape.

The input terminal portion 3882 and the output terminal portion 3881 included in each of the wiring member 388j_1, the wiring member 388j_2, the wiring member 388j_3, and the wiring member 388j_4 extend in the Y2 direction. In the tenth embodiment, the Y2 direction is an example of the "first direction".

The first wiring substrate 35j1 includes a coupling portion 357j_1 on the surface in the X2 direction and 357j_2 on the surface in the X1 direction. The coupling portion 357j_1 is coupled to the input terminal portion 3882_1. The coupling portion 357j_2 is coupled to the input terminal portion 3882_2. Furthermore, the coupling portions 357j_2 and 357j_3 are disposed in the Z1 direction as compared with the coupling portions 3570 and 357j_4.

In the tenth embodiment, the coupling portion 357j_1 is an example of the "first coupling portion". The coupling portion 357j_2 is an example of the "second coupling portion".

The second wiring substrate 35j2 includes a coupling portion 357j_3 on the surface in the X2 direction and a coupling portion 357j_4 on the surface in the X1 direction. The coupling portion 357j_3 is coupled to the input terminal portion 3882_3. The coupling portion 357j_4 is coupled to the input terminal portion 3882_4.

In the tenth embodiment, the coupling portion 357j_3 is an example of the "third coupling portion". The coupling portion 357j_4 is an example of the "fourth coupling portion".

According to the tenth embodiment, the same wiring member 388 can be used by rotating the head unit 38j 180 degrees about the Z axis direction. Since the same wiring member 388 can be used, the liquid ejecting head 30j can be easily manufactured as compared with the aspect in which the wiring members 388 having different shapes are used. More specifically, when the head unit 38 having the wiring member 388 whose input terminal portion 3882 is shifted is used, for example, when the input terminal portions of the wiring member 3880 and the wiring member 388j_2 aligned in the Y axis direction are brought close to each other, it is necessary to invert the head unit 38j. However, since the wiring member 388j of the head unit 38j is provided with the input terminal portion 3882 only on one surface, when the head unit 38j is inverted, the surface on which the input terminal portion 3882 is provided differs between the two head units 38j. Therefore, in the tenth embodiment, since the coupling portion 357j_1 is also provided on the surface of the first wiring substrate 35j1 disposed on a side opposite to the head unit 38, the relay portion 3883 can be routed from the Z2 direction of the wiring substrate 35j to couple the input terminal portion 3882 to the coupling portion 357j on the opposite surface. That is, since the coupling portions 357j are provided on both sides of the first wiring substrate 35j1, the head unit 38j having a common structure and the wiring member in which the input terminal portion 3882 is shifted can be adopted. As described above, the head unit 38j having a common structure can be adopted to facilitate manufacturing, and further, the wiring substrate 35j can be miniaturized.

Furthermore, the coupling portions 357j_2 and 357j_3 are disposed in the Z1 direction as compared with the coupling portions 357j_1 and 357j_4. The wiring member 388_1 is coupled to the first wiring substrate 35j1 by routing the relay portion 3883 from the Z2 direction of the wiring substrate 35j, whereas the wiring member 388_2 is coupled to the first wiring substrate 35j1 without routing the relay portion 3883. The relay portion 3883 of the wiring member 388_1 and the relay portion 3883 of the wiring member 388_2 have the same shape. Therefore, in the Z1 direction, when the coupling portions 357j_2 and 357j_3 are disposed at the same positions as the coupling portions 357j_1 and 357j_4, it is necessary to bend the relay portion 3883 of the wiring member 388_2 more than necessary. Therefore, by arranging the coupling portions 357j_2 and 357j_3 in the Z1 direction as compared with the coupling portions 357j_1 and 357j_4, the relay portion 3883 may not be bent more than necessary.

11. Eleventh Embodiment

The input terminal portion 3882 of the wiring member 388 according to the first embodiment is shifted in one direction with respect to the output terminal portion 3881, and the present disclosure is not limited thereto. The eleventh embodiment is different from the first embodiment in that the entire wiring member 388 is shifted in one direction with respect to the portion of the head unit 38 excluding the wiring member 388. Hereinafter, the eleventh embodiment will be described. For the elements whose actions and functions are the same as those in the first embodiment in each of the embodiments and the modification examples illustrated below, the reference numerals used in the first embodiment will be diverted and detailed description of each will be omitted as appropriate.

Figure 25:
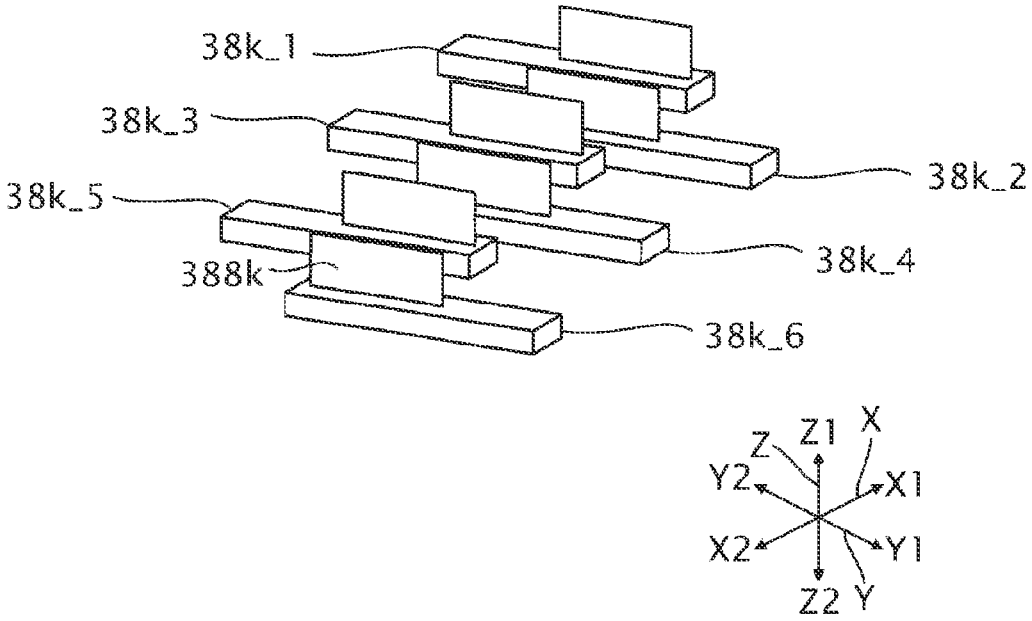
FIG. 25 is a perspective view of a head unit according to an eleventh embodiment.

FIG. 25 is a perspective view of the head unit 38k according to the eleventh embodiment. As illustrated in FIG. 25, the wiring member 388k included in the head unit 38k has a rectangular shape.

Figure 26:
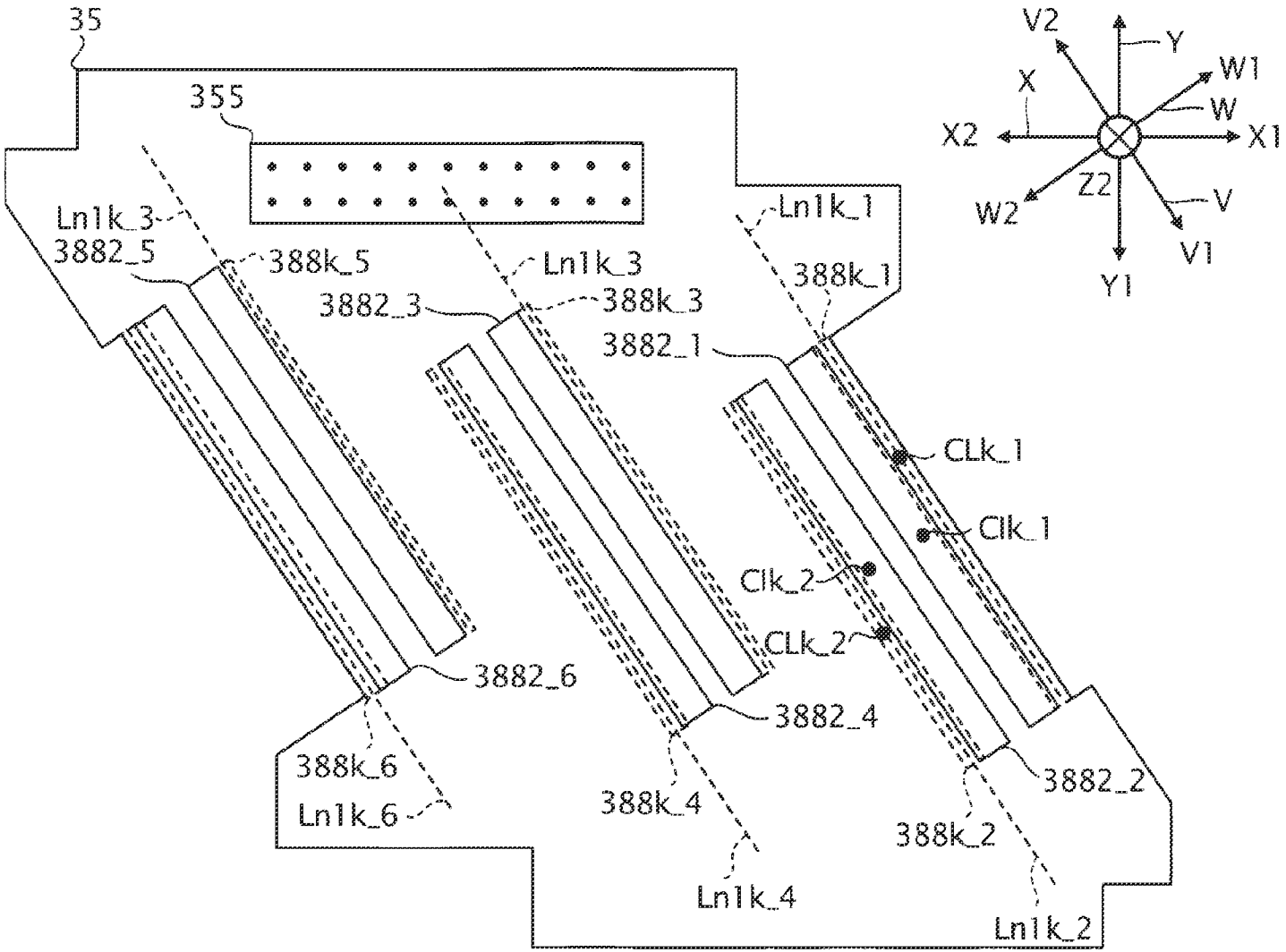
FIG. 26 is a diagram illustrating a positional relationship between the wiring substrate, a wiring member, and the nozzle row.

FIG. 26 is a diagram illustrating a positional relationship between the wiring substrate 35, the wiring member 388k, and the nozzle row Ln. As illustrated in FIG. 6, the nozzle plate 387 has the nozzle row Ln1 and the nozzle row Ln2, and in FIG. 26, only the nozzle row Ln1 is displayed for simplification of illustration. In FIG. 26, the display of the opening portion 351 and the terminal 353 is omitted in order to prevent the illustration from being complicated. Furthermore, in FIG. 26, the position of the nozzle row Ln1 is illustrated by a broken line.

The liquid ejecting head 30 according to the eleventh embodiment is provided with the nozzle row Ln1_1 extending in the V2 direction, the nozzle row Ln1_2 extending in the V2 direction, a wiring member 388k_1, a wiring member 388k_2, and the wiring substrate 35. The wiring member 388k_1 includes the input terminal portion 3882_1 that corresponds to the nozzle row Ln1_1 and extends in the V2 direction. The wiring member 388*k*_1 includes the input terminal portion 3882_2 that corresponds to the nozzle row Ln1_2 and extends in the V2 direction. The wiring substrate 35 is coupled to the input terminal portion 3882_1 and the input terminal portion 3882_2. The center CLk_1 of the nozzle row Ln1_1 is located so as to be displaced in the V1 direction with respect to the center CLk_2 of the nozzle row Ln1_2 in plan view. The center CIk_1 of the input terminal portion 3882_1 is disposed so as to be displaced in the V1 direction with respect to the center CLk_1 of the nozzle row Ln1_1 in plan view. The center CIk_2 of the input terminal portion 3882_2 is disposed so as to be displaced in the V1 direction with respect to the center CLk_2 of the nozzle row Ln1_2 in plan view.

According to the eleventh embodiment, even when the head unit 38*k*, in other words, the nozzle row Ln1 is disposed so as to be displaced in the V axis direction, by bringing the plurality of wiring members 388*k*, in other words, the input terminal portions 3882, closer to each other, the wiring substrate 35 can be miniaturized in the V axis direction.

12. Twelfth Embodiment

In the first embodiment, the wiring substrate 35 is miniaturized by bringing each of the input terminal portions 3882 of the wiring members 388 included in the plurality of head units 38 closer to each other, and the present disclosure is not limited thereto. The twelfth embodiment is different from the first embodiment in that when the liquid ejecting head 30 includes the plurality of wiring members for coupling the plurality of head units 38 to each other, by bringing each of the input terminal portions of the plurality of wiring members closer to each other, the wiring substrate coupled to the plurality of wiring members can be miniaturized. Hereinafter, the twelfth embodiment will be described. For the elements whose actions and functions are the same as those in the first embodiment in each of the embodiments and the modification examples illustrated below, the reference numerals used in the first embodiment will be diverted and detailed description of each will be omitted as appropriate.

Figure 27:
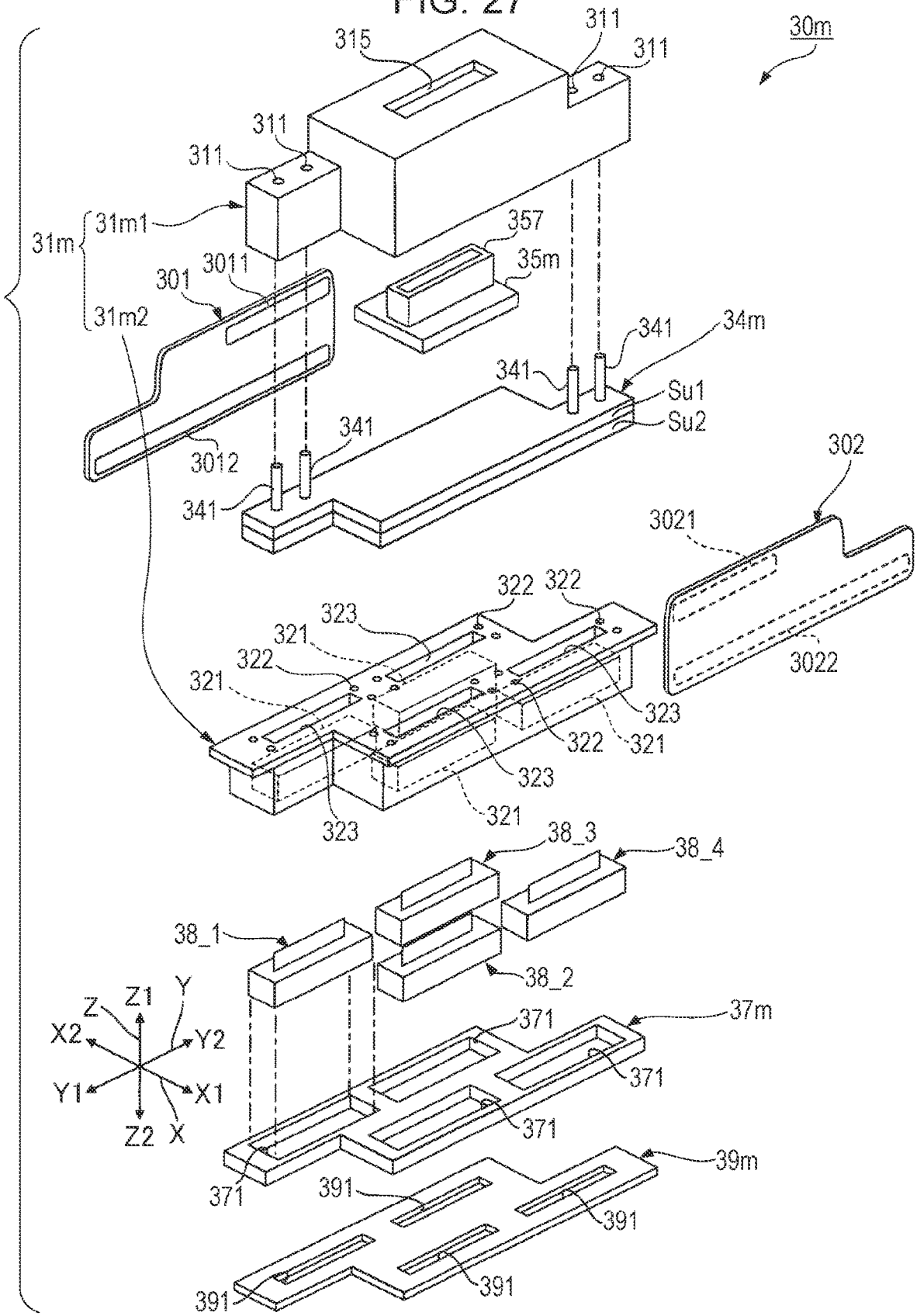
FIG. 27 is an exploded perspective view of a liquid ejecting head according to a twelfth embodiment.

FIG. 27 is an exploded perspective view of the liquid ejecting head 30*m* according to the twelfth embodiment. As illustrated in FIG. 27, the liquid ejecting head 30*m* includes a housing 31*m*, a flow path structure 34*m*, a wiring substrate 35*m*, a first wiring member 301, a second wiring member 302, a flow path distribution portion 37*m*, and a fixing plate 39*m*. Furthermore, the liquid ejecting head 30*m* includes head units 38_1, 38_2, 38_3, and 38_4. In addition, the flow path structure 34*m* includes a flow path plate Su1, a flow path plate Su2, and four supply coupling portions 341.

Since the flow path structure 34*m*, the flow path distribution portion 37*m*, and the fixing plate 39*m* only change in shape from the first embodiment and have the same functions, the description thereof will be omitted.

The housing 31*m* includes a first housing portion 31*m*1 and a second housing portion 31*m*2. The first housing portion 31*m*1 accommodates the flow path structure 34*m*. The second housing portion 31*m*2 accommodates the plurality of head units 38. The first housing portion 31*m*1 includes four supply holes 311 and a wiring substrate hole 315.

The second housing portion 31*m*2 includes a plurality of recessed portions 321, a plurality of ink holes 322, and a plurality of wiring holes 323. Each recessed portion 321 is a recessed portion that opens in the Z2 direction. A head unit 38 is disposed in each recessed portion 321. Each ink hole 322 is a hole through which ink flows between the flow path structure 34*m* and the head unit 38. Each wiring hole 323 communicates with the recessed portion 321. Each wiring hole 323 is a hole through which the wiring member 388 included in the head unit 38 is passed.

The wiring substrate 35*m* is disposed between the first housing portion 31*m*1 and the flow path structure 34*m*. A wiring member 357 is provided on the wiring substrate 35*m*. The wiring member 357 is a member for electrically coupling the liquid ejecting head 30 and the control unit 8. The wiring member 357 is, for example, a connector. The wiring member 357 may be, for example, a signal cable such as an FFC. In addition, the wiring substrate 35*m* and the wiring member 357 may be integrated with each other.

The first wiring member 301 and the second wiring member 302 are disposed so as to interpose the flow path structure 34*m*. Each of the first wiring member 301 and the second wiring member 302 is electrically coupled to the wiring substrate 35*m*. The first wiring member 301 is disposed corresponding to the head unit 38_1 and the head unit 38_3. The second wiring member 302 is disposed corresponding to the head unit 38_2 and the head unit 38_4.

The first wiring member 301 includes an output terminal portion 3011 and an input terminal portion 3012 on a surface in the X1 direction. The output terminal portion 3011 and the input terminal portion 3012 extend in the Y2 direction. The output terminal portion 3011 is electrically coupled to the wiring member 388 of the head unit 38_1 and the wiring member 388 of the head unit 38_3. The input terminal portion 3012 is electrically coupled to the wiring substrate 35*m*.

The second wiring member 302 includes an output terminal portion 3021 and an input terminal portion 3022 on a surface in the X2 direction. The output terminal portion 3021 and the input terminal portion 3022 extend in the Y2 direction. The output terminal portion 3021 is electrically coupled to the wiring member 388 of the head unit 38_2 and the wiring member 388 of the head unit 38_4. The input terminal portion 3012 is electrically coupled to the wiring substrate 35*m*.

Figure 28:
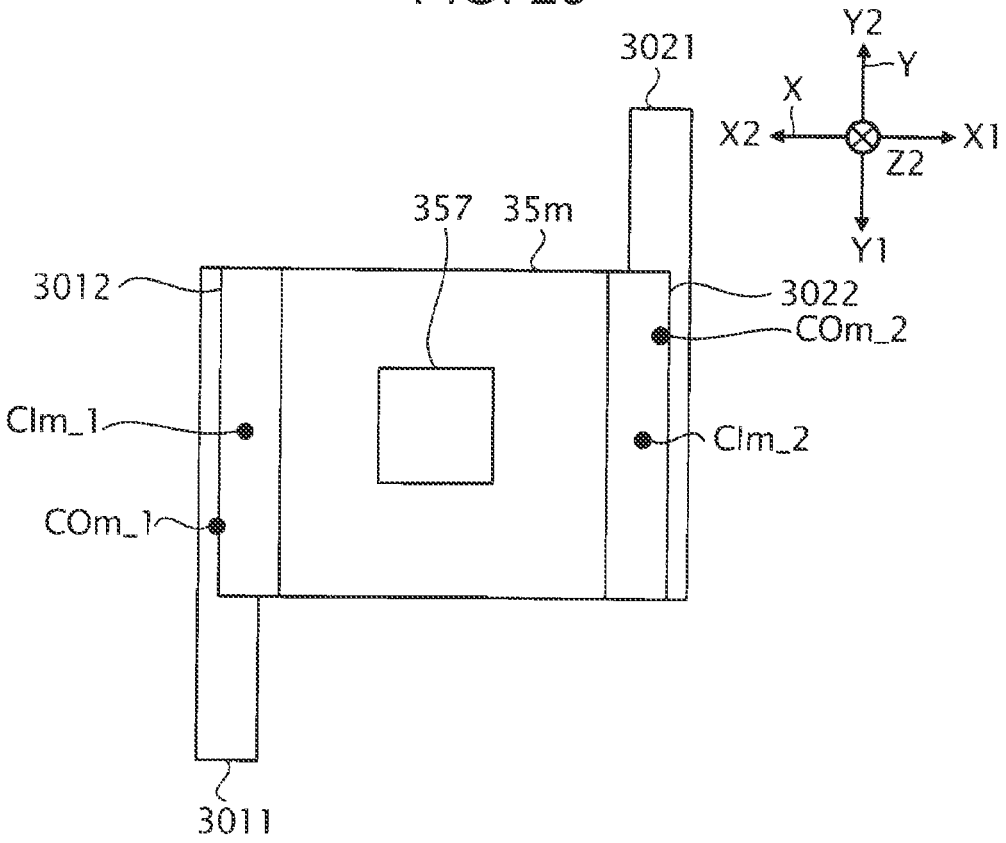
FIG. 28 is a diagram illustrating a positional relationship between a wiring substrate, a first wiring member, and a second wiring member.

FIG. 28 is a diagram illustrating the positional relationship between the wiring substrate 35*m*, the first wiring member 301, and the second wiring member 302. The figure illustrated in FIG. 28 illustrates the wiring substrate 35*m*, the first wiring member 301, and the second wiring member 302 when viewed in the Z2 direction.

As illustrated in FIG. 28, a center COm_1 of the output terminal portion 3011 is located so as to be displaced in the Y1 direction with respect to a center COm_2 of the output terminal portion 3881_2. A center CIm_1 of the input terminal portion 3012 is disposed so as to be displaced in the Y2 direction with respect to the center COm_1 of the output terminal portion 3011 in plan view. A center CIm_2 of the input terminal portion 3022 is disposed so as to be displaced in the Y1 direction with respect to the center COm_2 of the output terminal portion 3021 in plan view. According to the twelfth embodiment, the wiring substrate 35*m* can be miniaturized.

13. Modification Example

Each of the above illustrated embodiments can be modified in various manners. A specific aspect of modification is illustrated below. Two or more aspects randomly selected from the following examples can be appropriately merged to the extent that these aspects do not contradict each other.

13.1. First Modification Example

The liquid ejecting apparatus 100 described above is a so-called line type liquid ejecting apparatus in which the head module 3 is fixed and printing is performed only by transporting the medium 11, and the configuration of the line type recording apparatus is not limited to the apparatus described above. For example, each of the above aspects can also be applied to a so-called serial type liquid ejecting apparatus in which a head module 3 or a plurality of liquid ejecting heads 30 are mounted on a carriage, the head module 3 or the plurality of liquid ejecting heads 30 are moved in the X axis direction, and a medium 11 is transported for printing.

13.2. Second Modification Example

In each of the above-described aspects, the aspect in which the connector 355 is disposed in the space formed by the input terminal portion 3882 being shifted in one direction is described, and the element disposed in this space is not limited to the connector 355. For example, an ink flow path may be disposed.

Figure 29:
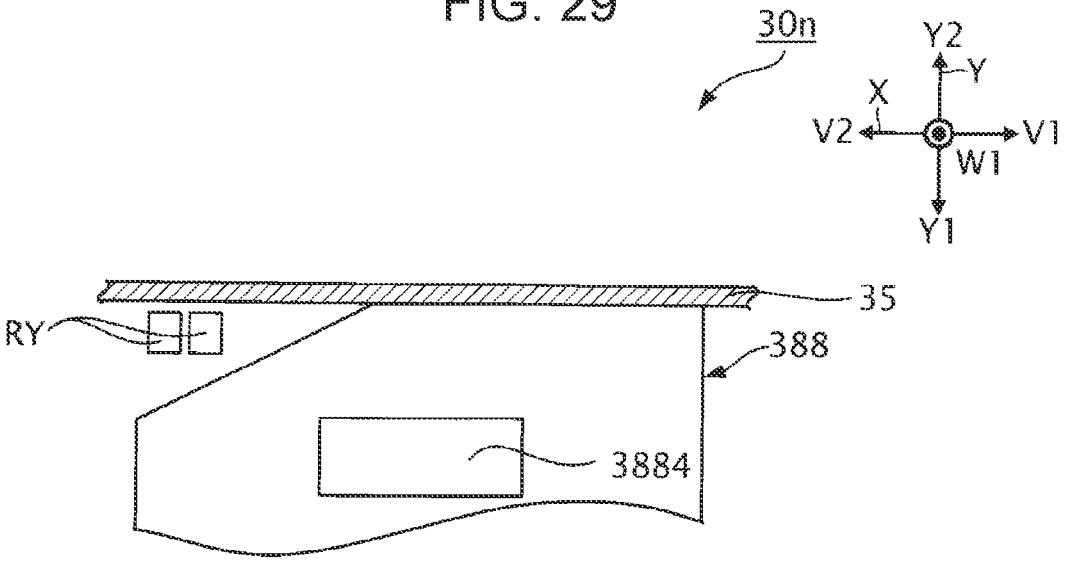
FIG. 29 is a cross-sectional view of a vicinity of a wiring member in a liquid ejecting head according to a second modification example.

FIG. 29 is a cross-sectional view of the liquid ejecting head 30*n* according to the second modification example when the vicinity of the wiring member 388 is broken in parallel to the VZ plane. In the second modification example, a flow path RY through which the liquid flows is disposed in a space in the V2 direction with respect to the input terminal portion 3882, which is generated by the input terminal portion 3882 of the wiring member 388 being shifted in the V1 direction, in other words, a space between the relay portion 3883 of the wiring member 388 and the wiring substrate 35.

13.3. Third Modification Example

As an energy generating element that generates energy in the pressure chamber CB for ejecting ink, a heat generating element may be used instead of the piezoelectric element used in each of the above aspects.

13.4. Other Modification Example

Although it is described that the wiring member 388 is a flexible substrate, the wiring member 388 may be a rigid substrate. In addition, the above-described liquid ejecting apparatus can be adopted in various apparatuses such as a facsimile machine and a copier, in addition to an apparatus dedicated to printing. However, the application of the liquid ejecting apparatus of the present disclosure is not limited to printing. For example, a liquid ejecting apparatus that ejects a solution of a coloring material is used as a manufacturing apparatus for forming a color filter of a liquid crystal display device. In addition, a liquid ejecting apparatus for ejecting a solution of a conductive material is used as a manufacturing apparatus for forming wiring and electrodes on a wiring substrate.

14. Appendix

From the embodiments exemplified above, for example, the following configuration can be grasped.

According to Aspect 1 of a preferred aspect, there is provided a liquid ejecting head that ejects a liquid, including a plurality of wiring members that includes a first wiring member having a first output terminal portion extending in a first direction and a first input terminal portion extending in the first direction, and a second wiring member having a second output terminal portion extending in the first direction and a second input terminal portion extending in the first direction; and a first wiring substrate coupled to the first input terminal portion and the second input terminal portion, in which a center of the first output terminal portion is located so as to be displaced in the first direction with respect to a center of the second output terminal portion in plan view in a direction ejecting the liquid, a center of the first input terminal portion is disposed so as to be displaced in a second direction opposite to the first direction with respect to the center of the first output terminal portion in the plan view, and a center of the second input terminal portion is disposed so as to be displaced in the first direction with respect to the center of the second output terminal portion in the plan view.

According to Aspect 1, even when the first wiring member is disposed so as to be displaced in the first direction with respect to the second wiring member, by bringing the plurality of input terminal portions closer to each other, respectively, a portion with which the first input terminal portion provided on the first wiring substrate is fitted and a portion with which the second input terminal portion is fitted come close to each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

In Aspect 2, which is a specific example of Aspect 1, a width of the first input terminal portion is smaller than a width of the first output terminal portion, and a width of the second input terminal portion is smaller than a width of the second output terminal portion.

According to Aspect 2, by disposing the first wiring member inverted with respect to the second wiring member, it is easy to bring the plurality of input terminal portions closer to each other, respectively.

In Aspect 3, which is a specific example of Aspect 1 or 2, at least a portion of the first input terminal portion and at least a portion of the second input terminal portion overlap each other in a direction orthogonal to the first direction.

According to Aspect 3, at least a portion of the first input terminal portion and at least a portion of the second input terminal portion overlap each other. Therefore, the portion with which the first input terminal portion is fitted and the portion with which the second input terminal portion is fitted come close to each other, as compared with the aspect in which the first input terminal portion and the second input terminal portion do not overlap each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

In Aspect 4, which is a specific example of Aspect 3, the liquid ejecting head further includes a first nozzle row that extends in the first direction; and a second nozzle row that extends in the first direction, in which the first wiring member corresponds to the first nozzle row, the second wiring member corresponds to the second nozzle row, and the first nozzle row and the second nozzle row do not overlap each other when viewed in the direction orthogonal to the first direction.

According to Aspect 4, even when the first nozzle row and the second nozzle row are separated from each other in the direction orthogonal to the first direction, the distance between the first input terminal portion and the second input terminal portion can be shortened. Therefore, the opening portions 351 of the wiring substrate 35 into which the input terminal portion 3882 is inserted come close to each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

In Aspect 5, which is a specific example of Aspect 1 or 2, the liquid ejecting head further includes a first nozzle row that extends in the first direction; and a second nozzle row that extends in the first direction, in which the first wiring member corresponds to the first nozzle row, the second wiring member corresponds to the second nozzle row, and the first nozzle row and the second nozzle row are aligned linearly in the first direction.

According to Aspect 5, the first input terminal portion and the second input terminal portion can be brought closer to each other. Therefore, in the first wiring substrate, since the region forming the portion with which the first input terminal portion is fitted and the region forming the portion with which the second input terminal portion is fitted can be reduced, the first wiring substrate can be miniaturized in the first direction.

The first wiring substrate can be miniaturized in the first direction.

In Aspect 6, which is a specific example of any one of Aspects 1 to 5, a portion of the first input terminal portion is located in the second direction from the first output terminal portion, and a portion of the second input terminal portion is located in the first direction from the second output terminal portion.

According to Aspect 6, even when the first output terminal portion and the second output terminal portion are separated from each other, the distance between the first input terminal portion and the second input terminal portion can be shortened. Therefore, in the first wiring substrate, since the region forming the portion with which the first input terminal portion is fitted and the region forming the portion with which the second input terminal portion is fitted can be reduced, the first wiring substrate can be miniaturized in the first direction.

In Aspect 7, which is a specific example of any one of Aspects 1 to 6, the first wiring member and the second wiring member have the same shape as each other and are disposed so as to be point-symmetrical with each other. Since the first wiring member and the second wiring member are disposed so as to be point-symmetrical, the second wiring member can include a member common to the first wiring member. That is, the liquid ejecting head can include a common wiring member. By sharing the wiring members, the cost required for manufacturing the liquid ejecting head can be reduced, and the manufacturing of the liquid ejecting head can be facilitated.

In Aspect 8, which is a specific example of any one of Aspects 1 to 7, a width of the first input terminal portion is larger than half a width of the first output terminal portion, and a width of the second input terminal portion is larger than half a width of the second output terminal portion. When the nozzles have a high density, the width of the first input terminal portion is larger than the width of the first output terminal portion, and even in such a configuration, the distance between the first input terminal portion and the second input terminal portion can be shortened. Therefore, in the first wiring substrate, since the region forming the portion with which the first input terminal portion is fitted and the region forming the portion with which the second input terminal portion is fitted can be reduced, the first wiring substrate can be miniaturized in the first direction.

In Aspect 9, which is a specific example of any one of Aspects 1 to 3, the plurality of wiring members include a third wiring member and a fourth wiring member, the third wiring member has a third output terminal portion extending in the first direction and a third input terminal portion extending in the first direction, the fourth wiring member has a fourth output terminal portion extending in the first direction and a fourth input terminal portion extending in the first direction, the plurality of wiring members is disposed in a zigzag pattern, respectively, the plurality of wiring members include a first wiring member group disposed along a first virtual straight line in the first direction, and a second wiring member group disposed along a second virtual straight line parallel to the first virtual straight line, the first wiring member and the second wiring member are included in the first wiring member group, the third wiring member and the fourth wiring member are included in the second wiring member group, the liquid ejecting head further includes a second wiring substrate coupled to the third input terminal portion and the fourth input terminal portion, a center of the third output terminal portion is located so as to be displaced in the first direction with respect to a center of the fourth output terminal portion in the plan view, a center of the third input terminal portion is disposed so as to be displaced in the second direction with respect to the center of the third output terminal portion in the plan view, a center of the fourth input terminal portion is disposed so as to be displaced in the first direction with respect to the center of the fourth output terminal portion in the plan view, the first wiring member is disposed foremost in the first direction of the first wiring member group, the second wiring member is disposed foremost in the second direction of the first wiring member group, the third wiring member is disposed foremost in the first direction of the second wiring member group, and the fourth wiring member is disposed foremost in the second direction of the second wiring member group.

According to Aspect 9, the first input terminal portion of the first wiring member disposed foremost in the first direction and the second input terminal portion of the second wiring member disposed foremost in the second direction are shifted to the center side. Therefore, the first input terminal portion and the second input terminal portion can be brought closer to each other. Therefore, in the first wiring substrate, since the region forming the portion with which the first input terminal portion is fitted and the region forming the portion with which the second input terminal portion is fitted can be reduced, the first wiring substrate can be miniaturized in the first direction.

In Aspect 10, which is a specific example of Aspect 9, the first wiring member, the second wiring member, the third wiring member, and the fourth wiring member have the same shape as each other, one surface of the first wiring substrate has a first coupling portion configured to be coupled to the first input terminal portion, the other surface of the first wiring substrate has a third coupling portion configured to be coupled to the third input terminal portion, one surface of the second wiring substrate has a second coupling portion configured to be coupled to the second input terminal portion, and the other surface of the second wiring substrate has a fourth coupling portion configured to be coupled to the fourth input terminal portion.

According to Aspect 10, the same wiring member can be used by inverting the second wiring substrate and the fourth wiring substrate. Since the same wiring member can be used, the manufacturing of the liquid ejecting head can be facilitated as compared with the aspect in which the wiring members having different shapes are used. More specifically, when the wiring member whose input terminal portion is shifted is used, for example, when the input terminal portions of the first wiring member and the second wiring member disposed side by side in the first direction are brought close to each other, it is necessary to invert the second wiring member. However, since the second wiring member is provided with the input terminal portion only on one surface, when the second wiring member is inverted, the surface on which the input terminal portion is provided differs between the first wiring member and the second wiring member. Therefore, in Aspect 10, the coupling portion is also provided on the surface of the first wiring substrate disposed on the side opposite to the first output terminal portion of the first wiring member and the second output terminal portion of the second wiring member. Therefore, the input terminal portion can be coupled to the coupling portion on the opposite surface by routing the second wiring member. That is, since the coupling portions are provided on both sides of the first wiring substrate, it is possible to adopt a wiring member having a common structure in which the input terminal portions are shifted. As described above, it is possible to facilitate manufacturing by adopting a wiring member having a common structure, and further, it is possible to miniaturize the wiring substrate.

In Aspect 11, which is a specific example of any one of Aspects 1 to 3, the plurality of wiring members include a third wiring member and a fourth wiring member, the third wiring member has a third output terminal portion extending in the first direction and a third input terminal portion extending in the first direction, the fourth wiring member has a fourth output terminal portion extending in the first direction and a fourth input terminal portion extending in the first direction, the plurality of wiring members are disposed in zigzag patterns, the plurality of wiring members includes a first wiring member group disposed along a first virtual straight line in the first direction, and a second wiring member group disposed along a second virtual straight line parallel to the first virtual straight line, the first wiring member and the third wiring member are included in the first wiring member group, the second wiring member and the fourth wiring member are included in the second wiring member group, the first wiring substrate is further coupled to the third input terminal portion and the fourth input terminal portion, a center of the third output terminal portion is located so as to be displaced in the first direction with respect to a center of the fourth output terminal portion in the plan view, a center of the third input terminal portion is disposed so as to be displaced in the second direction with respect to the center of the third output terminal portion in the plan view, a center of the fourth input terminal portion is disposed so as to be displaced in the first direction with respect to the center of the fourth output terminal portion in the plan view, the first wiring member is disposed foremost in the first direction of the first wiring member group, the third wiring member is disposed foremost in the second direction of the first wiring member group, the second wiring member is disposed foremost in the first direction of the second wiring member group, and the fourth wiring member is disposed foremost in the second direction of the second wiring member group.

In Aspect 11, the first input terminal portion of the first wiring member disposed foremost in the first direction and the fourth input terminal portion of the fourth wiring member disposed foremost in the second direction are shifted to the center side. Therefore, the wiring substrate can be miniaturized in the first direction by bringing the first input terminal portion and the fourth input terminal portion closer to each other.

In Aspect 12, which is a specific example of any one of Aspects 1 to 3, the liquid ejecting head which is used in a liquid ejecting apparatus including a transport portion that transports a medium in a transport direction, in which the plurality of wiring members has an output terminal portion extending in the first direction and an input terminal portion extending in the first direction, respectively, the first wiring substrate is coupled to the output terminal portions of the plurality of wiring members, respectively, the output terminal portions of the plurality of wiring members is disposed along a direction intersecting both a third direction orthogonal to the transport direction and the transport direction in the plan view, respectively, the first wiring member is disposed foremost in the third direction of the plurality of wiring members, and the second wiring member is disposed foremost in a fourth direction opposite to the third direction of the plurality of wiring members.

According to Aspect 12, the first input terminal portion is shifted in the first direction with respect to the center of the first output terminal portion, and the second input terminal portion is shifted in the second direction with respect to the center of the second output terminal portion, so that the pair of input terminal portions farthest apart in the direction intersecting both of the transport directions are close to each other in the transport direction. Therefore, among the input terminal portions included in the plurality of wiring members, respectively, since the distance from the end portion in the first direction of the first input terminal portion located foremost in the first direction to the end portion in the second direction of the second input terminal portion located foremost in the second direction can be reduced as compared with the aspect in which the first input terminal portion is not shifted in the first direction with respect to the center of the first output terminal portion, the first wiring substrate can be miniaturized.

In Aspect 13, which is a specific example of Aspect 12, the first input terminal portion and the second input terminal portion have a portion that overlaps each other when viewed in the third direction.

According to Aspect 13, as compared with the aspect in which the first input terminal portion and the second input terminal portion do not overlap each other when viewed in the third direction, the portion with which the first input terminal portion is fitted and the portion with which the second input terminal portion is fitted in the first wiring substrate come close to each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

According to Aspect 14 of a preferred aspect, there is provided a liquid ejecting head including: a first nozzle row group in which a plurality of first nozzle rows extending in a first direction are disposed along a first virtual straight line intersecting the first direction; a second nozzle row group in which a plurality of second nozzle rows extending in the first direction are disposed along a second virtual straight line parallel to the first virtual straight line; a plurality of first wiring members corresponding to the plurality of first nozzle rows, respectively; a plurality of second wiring members corresponding to the plurality of second nozzle rows, respectively; and a first wiring substrate coupled to the plurality of first wiring members and the plurality of second wiring members, in which the plurality of first wiring members has a first input terminal portion extending in the first direction, respectively, the plurality of second wiring members has a second input terminal portion extending in the first direction, respectively, the first nozzle row group is disposed in a fifth direction perpendicular to the first virtual straight line with respect to the second nozzle row group, a center of the first input terminal portion is disposed so as to be displaced in a sixth direction opposite to the fifth direction with respect to a center of the first nozzle row corresponding to the center of the first input terminal portion in plan view in a direction ejecting a liquid, and a center of the second input terminal portion is disposed so as to be displaced in the fifth direction with respect to a center of the second nozzle row corresponding to the center of the second input terminal portion in the plan view.

According to Aspect 14, even when the nozzle row of the first nozzle row group and the nozzle row of the second nozzle row group are disposed so as to be displaced in the fifth direction, the input terminal portion corresponding to the first nozzle row group and the input terminal portion corresponding to the second nozzle row group can be brought closer to each other. Therefore, since the region forming the portion with which the first input terminal portion is fitted and the region forming the portion with which the second input terminal portion is fitted can be reduced, the wiring substrate can be miniaturized in the fifth direction.

In Aspect 15, which is a specific example of Aspect 14, the first nozzle row group and the second nozzle row group have a portion that overlaps each other when viewed in a direction where the first virtual straight line extends. Since there is a portion in which the first nozzle row group and the second nozzle row group overlap each other, the portion into which the first input terminal portion is fitted and the portion into which the second input terminal portion is fitted in the first wiring substrate come close to each other, as compared with the aspect in which the first nozzle row group and the second nozzle row group do not overlap each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

In Aspect 16, which is a specific example of Aspect 14 or 15, the first wiring substrate has a connector at an end portion in the fifth direction, and a portion of at least one first wiring member of the plurality of first wiring members has a portion that overlaps the connector in the plan view. Since the first input terminal portion is shifted in the first direction, a portion for fitting the first wiring may not be provided in the second direction of the first wiring substrate. Therefore, since the connector can be disposed at a position overlapping a portion of the first wiring member on the second direction side in plan view, the first wiring substrate can be miniaturized as compared with the aspect in which a portion of the first wiring member and the connector do not overlap each other in plan view.

In Aspect 17, which is a specific example of any one of Aspects 14 to 16, the liquid ejecting head which is used in a liquid ejecting apparatus including a transport portion that transports a medium in a transport direction, in which the first direction is a direction intersecting both the transport direction of the medium and a direction orthogonal to the transport direction. Since the input terminal portion and the output terminal portion are inclined with respect to both the transport direction and the direction orthogonal to the transport direction, the liquid ejecting head can be miniaturized in the transport direction as compared with the case where the input terminal portion and the output terminal portion extend in the transport direction.

In Aspect 18, which is a specific example of Aspect 17, a predetermined nozzle row constituting the first nozzle row group and a nozzle row disposed foremost to the predetermined nozzle row overlap all when viewed in the transport direction.

According to Aspect 18, when the color of the ink supplied to the nozzles of the nozzle row of the first nozzle row group and the color of the ink supplied to the nozzles N of the nozzle row of the second nozzle row group are the same as each other, and the nozzles of the nozzle row of the second nozzle row group are located between the nozzles adjacent to each other of the nozzle row of the first nozzle row group, the liquid ejecting head can obtain twice the resolution of the nozzle row. When viewed in the first direction, in the aspect in which the nozzle row of the first nozzle row group and the nozzle row of the second nozzle row group are separated from each other by a distance longer than the interval between the nozzles adjacent to each other in the first direction in the first direction, there is a portion in which twice the resolution of the nozzle row cannot be obtained. In addition, when the color of the ink supplied to the nozzles of the nozzle row of the first nozzle row group and the color of the ink supplied to the nozzles of the nozzle row of the second nozzle row group are different from each other, the liquid ejecting head can be eliminate unnecessary nozzles.

According to Aspect 19 of a preferred aspect, there is provided a liquid ejecting head including: a first nozzle row extending in a first direction; a second nozzle row extending in the first direction; a first wiring member corresponding to the first nozzle row and having a first input terminal portion extending in the first direction; a second wiring member corresponding to the second nozzle row and having a second input terminal portion extending in the first direction; and a first wiring substrate coupled to the first input terminal portion and the second input terminal portion, in which a center of the first nozzle row is located so as to be displaced in the first direction with respect to a center of the second nozzle row in plan view in a direction ejecting a liquid, a center of the first input terminal portion is disposed so as to be displaced in a second direction opposite to the first direction with respect to the center of the first nozzle row in the plan view, and a center of the second input terminal portion is disposed so as to be displaced in the first direction with respect to the center of the second nozzle row in the plan view.

According to Aspect 19, even when the plurality of wiring members are displaced in the first direction with respect to the first nozzle row and the second nozzle row, by bringing the plurality of wiring members, in other words, the first input terminal portion and the second input terminal portion closer to each other, the portion into which the first input terminal portion provided on the first wiring substrate is fitted and the portion into which the second input terminal portion is fitted come close to each other. Therefore, in the first wiring substrate, since a region forming the portion with which the first input terminal portion is fitted and a region forming the portion with which the second input terminal portion is fitted can be reduced, the first wiring substrate can be miniaturized in the first direction.

According to Aspect 20 of a preferred aspect, there is provided a liquid ejecting apparatus including: the liquid ejecting head according to any one of Aspects 1 to 19; and a transport portion that transports a medium.

According to Aspect 20, it is possible to provide the liquid ejecting apparatus in which the first wiring substrate is miniaturized.

What is claimed is:

1. A liquid ejecting head configured to eject a liquid, comprising:

wiring members including a first wiring member having a first output terminal portion extending in a first direction and a first input terminal portion extending in the first direction, and a second wiring member having a second output terminal portion extending in the first direction and a second input terminal portion extending in the first direction; and a first wiring substrate coupled to the first input terminal portion and the second input terminal portion, wherein a center of the first output terminal portion is located in the first direction with respect to a center of the second output terminal portion in plan view in a direction ejecting the liquid, a center of the first input terminal portion is disposed in a second direction opposite to the first direction with respect to the center of the first output terminal portion in the plan view, and a center of the second input terminal portion is disposed in the first direction with respect to the center of the second output terminal portion in the plan view.

2. The liquid ejecting head according to claim 1, wherein a width of the first input terminal portion is smaller than a width of the first output terminal portion, and a width of the second input terminal portion is smaller than a width of the second output terminal portion.

3. The liquid ejecting head according to claim 1, wherein at least a portion of the first input terminal portion and at least a portion of the second input terminal portion overlap each other in a direction orthogonal to the first direction.

4. The liquid ejecting head according to claim 3, further comprising:

a first nozzle row extending in the first direction; and a second nozzle row extending in the first direction, wherein the first wiring member corresponds to the first nozzle row, the second wiring member corresponds to the second nozzle row, and the first nozzle row and the second nozzle row do not overlap each other when viewed in the direction orthogonal to the first direction.

5. The liquid ejecting head according to claim 1, further comprising:

a first nozzle row extending in the first direction; and a second nozzle row extending in the first direction, wherein the first wiring member corresponds to the first nozzle row, the second wiring member corresponds to the second nozzle row, and the first nozzle row and the second nozzle row are aligned linearly in the first direction.

6. The liquid ejecting head according to claim 1, wherein a portion of the first input terminal portion is located in the second direction from the first output terminal portion, and a portion of the second input terminal portion is located in the first direction from the second output terminal portion.

7. The liquid ejecting head according to claim 1, wherein the first wiring member and the second wiring member have the same shape as each other and are disposed so as to be point-symmetrical with each other.

8. The liquid ejecting head according to claim 1, wherein a width of the first input terminal portion is larger than half a width of the first output terminal portion, and a width of the second input terminal portion is larger than half a width of the second output terminal portion.

9. The liquid ejecting head according to claim 1, wherein the wiring members include a third wiring member and a fourth wiring member, the third wiring member has a third output terminal portion extending in the first direction and a third input terminal portion extending in the first direction, the fourth wiring member has a fourth output terminal portion extending in the first direction and a fourth input terminal portion extending in the first direction, the wiring members are disposed in a zigzag pattern, the wiring members include a first wiring member group disposed along a first virtual straight line in the first direction, and a second wiring member group disposed along a second virtual straight line parallel to the first virtual straight line, the first wiring member and the second wiring member are included in the first wiring member group, the third wiring member and the fourth wiring member are included in the second wiring member group, the liquid ejecting head further comprises a second wiring substrate coupled to the third input terminal portion and the fourth input terminal portion, a center of the third output terminal portion is located in the first direction with respect to a center of the fourth output terminal portion in the plan view, a center of the third input terminal portion is disposed in the second direction with respect to the center of the third output terminal portion in the plan view, a center of the fourth input terminal portion is disposed in the first direction with respect to the center of the fourth output terminal portion in the plan view, the first wiring member is disposed foremost in the first direction of the first wiring member group, the second wiring member is disposed foremost in the second direction of the first wiring member group, the third wiring member is disposed foremost in the first direction of the second wiring member group, and the fourth wiring member is disposed foremost in the second direction of the second wiring member group.

10. The liquid ejecting head according to claim 9, wherein the first wiring member, the second wiring member, the third wiring member, and the fourth wiring member have the same shape as each other, one surface of the first wiring substrate has a first coupling portion configured to be coupled to the first input terminal portion, the other surface of the first wiring substrate has a third coupling portion configured to be coupled to the third input terminal portion, one surface of the second wiring substrate has a second coupling portion configured to be coupled to the second input terminal portion, and the other surface of the second wiring substrate has a fourth coupling portion configured to be coupled to the fourth input terminal portion.

11. The liquid ejecting head according to claim 1, wherein the wiring members include a third wiring member and a fourth wiring member, the third wiring member has a third output terminal portion extending in the first direction and a third input terminal portion extending in the first direction, the fourth wiring member has a fourth output terminal portion extending in the first direction and a fourth input terminal portion extending in the first direction, the wiring members are disposed in zigzag patterns, the wiring members include a first wiring member group disposed along a first virtual straight line in the first direction, and a second wiring member group disposed along a second virtual straight line parallel to the first virtual straight line, the first wiring member and the third wiring member are included in the first wiring member group, the second wiring member and the fourth wiring member are included in the second wiring member group, the first wiring substrate is further coupled to the third input terminal portion and the fourth input terminal portion, a center of the third output terminal portion is located in the first direction with respect to a center of the fourth output terminal portion in the plan view, a center of the third input terminal portion is disposed in the second direction with respect to the center of the third output terminal portion in the plan view, a center of the fourth input terminal portion is disposed in the first direction with respect to the center of the fourth output terminal portion in the plan view, the first wiring member is disposed foremost in the first direction of the first wiring member group, the third wiring member is disposed foremost in the second direction of the first wiring member group, the second wiring member is disposed foremost in the first direction of the second wiring member group, and the fourth wiring member is disposed foremost in the second direction of the second wiring member group.

12. The liquid ejecting head according to claim 1, which is used in a liquid ejecting apparatus including a transport portion that transports a medium in a transport direction, wherein the wiring members have an output terminal portion extending in the first direction and an input terminal portion extending in the first direction, respectively, the first wiring substrate is coupled to the output terminal portions of the wiring members, respectively, the output terminal portions each of the wiring members are disposed in a direction intersecting both a third direction orthogonal to the transport direction and the transport direction in the plan view, the first wiring member is disposed foremost in the third direction of the wiring members, and the second wiring member is disposed foremost in a fourth direction opposite to the third direction of the wiring members.

13. The liquid ejecting head according to claim 12, wherein the first input terminal portion and the second input terminal portion have a portion that overlaps each other when viewed in the third direction.

14. A liquid ejecting head comprising:

a first nozzle row group in which first nozzle rows extending in a first direction are disposed along a first virtual straight line intersecting the first direction;

a second nozzle row group in which second nozzle rows extending in the first direction are disposed along a second virtual straight line parallel to the first virtual straight line;

first wiring members respectively corresponding to the first nozzle rows;

second wiring members respectively corresponding to the second nozzle rows; and a first wiring substrate coupled to the first wiring members and the second wiring members, wherein the first wiring members has a first input terminal portion extending in the first direction, respectively, the second wiring members has a second input terminal portion extending in the first direction, respectively, the first nozzle row group is disposed in a fifth direction perpendicular to the first virtual straight line with respect to the second nozzle row group, a center of the first input terminal portion is disposed in a sixth direction opposite to the fifth direction with respect to a center of the first nozzle row corresponding to the center of the first input terminal portion in plan view in a direction ejecting a liquid, and a center of the second input terminal portion is disposed in the fifth direction with respect to a center of the second nozzle row corresponding to the center of the second input terminal portion in the plan view.

15. The liquid ejecting head according to claim 14, wherein the first nozzle row group and the second nozzle row group have a portion that overlaps each other when viewed in a direction where the first virtual straight line extends.

16. The liquid ejecting head according to claim 14, wherein the first wiring substrate has a connector at an end portion in the fifth direction, and a portion of at least one first wiring member of the first wiring members overlaps the connector in the plan view.

17. The liquid ejecting head according to claim 14, which is used in a liquid ejecting apparatus including a transport portion that transports a medium in a transport direction, wherein the first direction is a direction intersecting both the transport direction of the medium and a direction orthogonal to the transport direction.

18. The liquid ejecting head according to claim 17, wherein a predetermined nozzle row constituting the first nozzle row group and a nozzle row disposed foremost to the predetermined nozzle row overlap all when viewed in the transport direction.

19. A liquid ejecting head comprising:

a first nozzle row extending in a first direction;

a second nozzle row extending in the first direction;

a first wiring member corresponding to the first nozzle row and having a first input terminal portion extending in the first direction;

a second wiring member corresponding to the second nozzle row and having a second input terminal portion extending in the first direction; and a first wiring substrate coupled to the first input terminal portion and the second input terminal portion, wherein a center of the first nozzle row is located in the first direction with respect to a center of the second nozzle row in plan view in a direction ejecting a liquid, a center of the first input terminal portion is disposed in a second direction opposite to the first direction with respect to the center of the first nozzle row in the plan view, and a center of the second input terminal portion is disposed in the first direction with respect to the center of the second nozzle row in the plan view.

20. A liquid ejecting apparatus comprising:

the liquid ejecting head according to claim 1; and a transport portion that transports a medium.

* * * * *